US008591206B2

(12) United States Patent
Krenik

(10) Patent No.: US 8,591,206 B2
(45) Date of Patent: Nov. 26, 2013

(54) AIR CYCLE HEAT PUMP TECHNIQUES AND SYSTEM

(76) Inventor: Thomas R. Krenik, Garland, TX (US)

( * ) Notice: Subject to any disclaimer, the term of this patent is extended or adjusted under 35 U.S.C. 154(b) by 503 days.

(21) Appl. No.: 12/620,457

(22) Filed: Nov. 17, 2009

(65) Prior Publication Data

US 2010/0139306 A1 Jun. 10, 2010

Related U.S. Application Data

(60) Provisional application No. 61/120,392, filed on Dec. 6, 2008, provisional application No. 61/156,409, filed on Feb. 27, 2009.

(51) Int. Cl.
*F04B 19/00* (2006.01)

(52) U.S. Cl.
USPC ..... 417/436; 310/309

(58) Field of Classification Search
USPC ..... 417/48, 436; 310/309; 165/80.2, 80.3, 165/80.4
See application file for complete search history.

(56) References Cited

U.S. PATENT DOCUMENTS

| | | | | |
|---|---|---|---|---|
| 2,491,351 | A * | 12/1949 | Zeitlin | 418/150 |
| 4,965,699 | A * | 10/1990 | Jorden et al. | 361/706 |
| 5,642,015 | A * | 6/1997 | Whitehead et al. | 310/309 |
| 5,712,329 | A * | 1/1998 | Cargnello et al. | 523/179 |
| 7,255,816 | B2 * | 8/2007 | Palacio et al. | 264/37.1 |
| 7,411,331 | B2 * | 8/2008 | Dubowsky et al. | 310/309 |
| 2007/0164641 | A1 * | 7/2007 | Pelrine et al. | 310/800 |
| 2008/0083240 | A1 * | 4/2008 | Su | 62/262 |
| 2010/0272585 | A1 * | 10/2010 | Raleigh et al. | 417/273 |

FOREIGN PATENT DOCUMENTS

| | | | | |
|---|---|---|---|---|
| JP | 01233796 | A * | 9/1989 | H01L 23/36 |
| JP | 04368481 | A * | 12/1992 | H02N 1/00 |

OTHER PUBLICATIONS

Machine Translation of Japanese Patent JP 04368481 to Okanda et al (also referred to as Horiguchi et al in the office action).*
Machine Translation of Japanese Patent JP 01233796 to Wakino.*

* cited by examiner

*Primary Examiner* — Peter J Bertheaud
*Assistant Examiner* — Dnyanesh Kasture

(57) ABSTRACT

In one aspect, there is provided a heat pump system which comprises an enclosure and an electrostatic compressor. The enclosure is substantially filled with a first fluid and includes a plurality of compressor vanes, a heat exchanger, and a control module. The plurality of compressor vanes are responsive to electrical stimulus and are substantially separated from each other so that the first fluid extends to and at least partially occupies a space between adjoining pairs of the compressor vanes. The heat exchanger is thermally coupled to the first fluid in the space between the compressor vanes and to a second fluid substantially outside the enclosure. The control module is responsive to input information and includes an electrical circuit that provides the electrical stimulus to the compressor vanes. The compressor vanes respond to the electrical stimulus by compressing and releasing the first fluid between the adjoining pairs of compressor vanes.

21 Claims, 35 Drawing Sheets

AIR CYCLE HEAT PUMP TECHNIQUES AND SYSTEM

CROSS-REFERENCE TO RELATED APPLICATION

This application claims the benefit of U.S. Provisional Application Ser. No. 61/120,392, filed by Thomas R. Krenik on Dec. 6, 2008, entitled "AIR CYCLE COOLING SYSTEM," and also claims the benefit of U.S. Provisional Application Ser. No. 61/156,409, filed by Thomas R. Krenik on Feb. 27, 2009, entitled "AIR CYCLE COOLING TECHNIQUES AND SYSTEM," commonly assigned with this application and incorporated herein by reference.

TECHNICAL FIELD

Embodiments of this invention relate to techniques for compressing air and possibly other gases in close proximity to a heat exchanger and applying those techniques in cooling systems, heating systems, and other applications.

BACKGROUND

Most commercial, automotive, residential and other refrigeration systems, heat pumps and air conditioning systems today are based on use of a refrigerant as a working fluid to pump heat between heat exchangers. In the case of a typical air conditioning system, for example, internal building air is cooled by action of a working fluid at a first heat exchanger and the heat collected by the working fluid is then released outside the building at a second heat exchanger. Such a system involves a compressor to compress the working fluid, piping between the internal and external heat exchangers, fans to generate air flow, and controls to manage the system operation. Due to the large number of expensive, power consuming systems involved, such systems are expensive, heavy, and consume substantial energy during operation. Additionally, refrigerant working fluids are often hazardous or polluting to the environment. And since the working fluid must be contained for the system to work, such systems are difficult and expensive to install and maintain. Normally, specially trained technicians are required to properly service such a system, and the working fluids used are often regulated by government agencies due to their harmful characteristics.

Consequently, a system that doesn't use a hazardous or harmful working fluid is highly desirable. In fact, air conditioning or heat pumping systems based on using an enclosure's internal air as a working fluid have been successfully designed. Such systems are often referred to as air cycle cooling systems since air itself is used as the working fluid. In such a system, building air is compressed to raise its temperature, a heat exchanger is used to cool it back to near outside ambient temperature while retaining some elevated pressure, and the cooled and compressed air is then expanded to generate a cooled flow of air. While such systems are simple to operate, install, and maintain they are regrettably inefficient compared with systems using refrigerant working fluids and, hence, are only used in special applications. It is noteworthy that jet aircraft frequently use air cycle cooling systems as explained here since they have a high capacity compressor already available on the jet engine intake and for the safety benefits of a system using only air as a working fluid.

Accordingly, what is needed in the art is a system that overcomes the above-mentioned problems with the existing art.

SUMMARY

To address the above-discussed deficiencies of the prior art, in one embodiment, there is provided an electrostatic compressor. In this embodiment, the electrostatic compressor comprises a plurality of compressor vanes, a heat exchanger, and an electrical circuit. The compressor vanes are responsive to electrical stimulus and are substantially separated from each other so that a fluid at least partially occupies a space between adjoining pairs of the compressor vanes. The heat exchanger is thermally coupled to the fluid in the space between the compressor vanes. The electrical circuit provides the electrical stimulus. The compressor vanes respond to the electrical stimulus by compressing and releasing the fluid between the adjoining pairs of compressor vanes.

In another embodiment there is provided a method to transfer heat in and out of a fluid. In this particular embodiment, the method comprises causing a fluid to flow in proximity of an electrostatic compressor and actuating a plurality of compressor vanes of the electrostatic compressor. The plurality of compressor vanes of the electrostatic compressor are actuated by an electrical stimulus such that at least a portion of the fluid is compressed and released between adjoining pairs of the compressor vanes thereby transferring heat out of the fluid through a heat exchanger thermally coupled to the fluid.

In yet another embodiment there is provided a heat pump system. In this embodiment, the system comprises an enclosure and an electrostatic compressor. The enclosure is substantially filled with a first fluid. The electrostatic compressor includes a plurality of compressor vanes, a heat exchanger, and a control module. The plurality of compressor vanes are responsive to electrical stimulus and are substantially separated from each other so that the first fluid extends to and at least partially occupies a space between adjoining pairs of the compressor vanes. The heat exchanger is thermally coupled to the first fluid in the space between the compressor vanes and is also thermally coupled to a second fluid substantially outside the enclosure. The control module is responsive to input information and includes an electrical circuit that provides the electrical stimulus to the compressor vanes. The compressor vanes respond to the electrical stimulus by compressing and releasing the first fluid between the adjoining pairs of compressor vanes.

DETAILED DESCRIPTION

Figure 1:
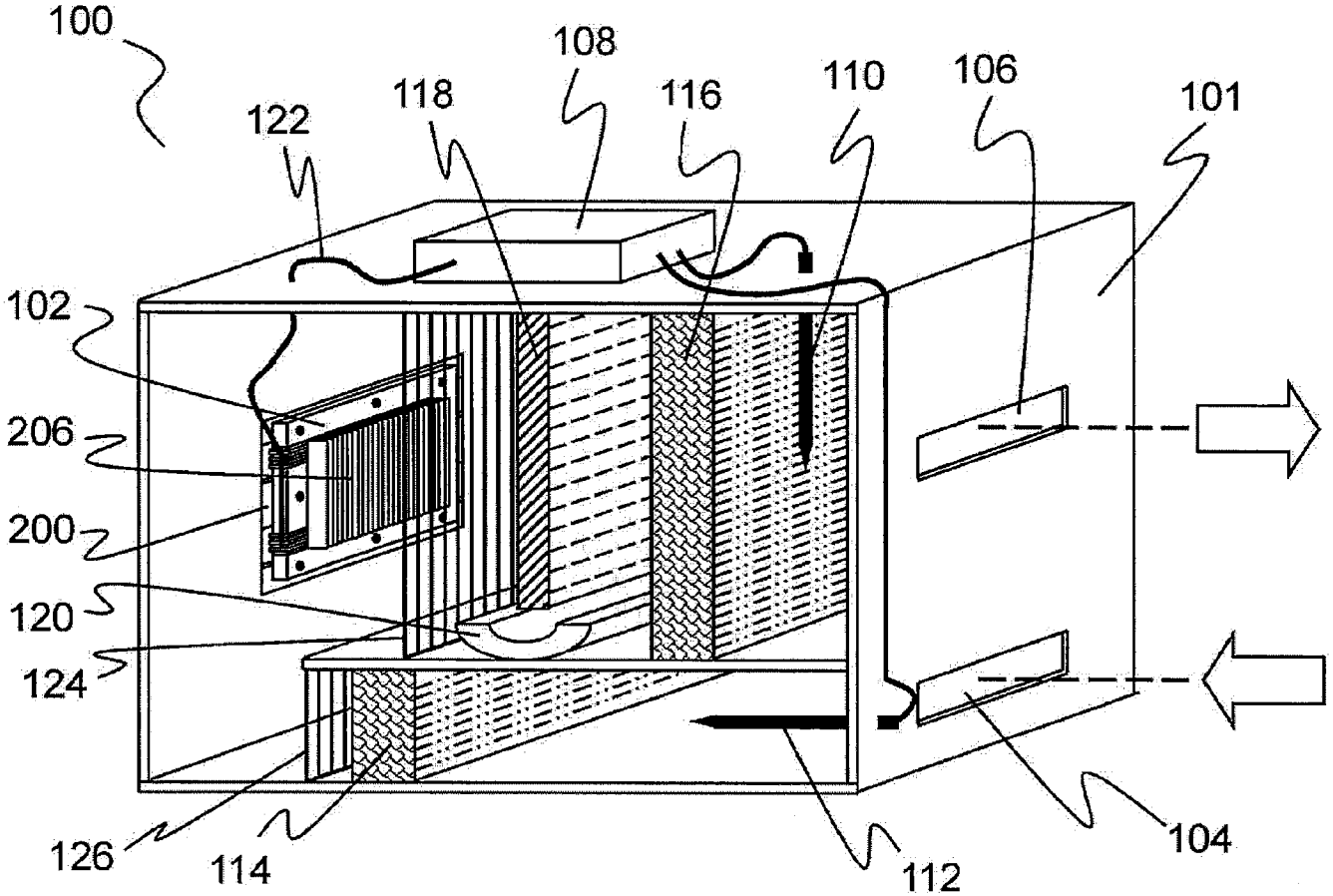
FIG. 1 illustrates an embodiment of an air cycle heat pump system with one side of the system enclosure removed so that the internal operation and components can be observed.

FIG. 1 illustrates an air cycle heat pump 100 with one side of the system's enclosure 101 removed so that the internal structure can be explained. In actual operation of this system, air intake port 104 may be tied to an intake duct so that air could be input to the system. With the front side of the enclosure 101 in place (again, this side is removed in FIG. 1), the enclosure 101 would be substantially sealed so that the air flowing into intake port 104 would pass through the air cycle heat pump 100 and then flow out of exhaust port 106. The air flowing through the system may be forced with a fan or may only be moved through natural flow and the operation of the electrostatic compressor 206 as will be described later. As use of an external fan is optional, no fan is shown in FIG. 1, but it is noted that such a system may include a fan either external to the system or within the enclosure 101. If a fan is included, it may be an axial flow fan, a centrifugal fan, or other types of fan. An embodiment of the air cycle heat pump 100 is configured as shown and will be described embodied as a cooling system, even though the system could provide either cooling or heating operation (some modification is required for heating and this will be described later). In this case, warm air is input through intake port 104 and cooled air is exhausted through exhaust port 106 through external ducts (not shown). The direction and flow of air into and out of the air cycle heat pump 100 in FIG. 1 is also shown by the large box arrows on the right side of the figure. The electrostatic compressor and heat exchanger assembly 102 performs operations on the air flowing through the air cycle heat pump 100 to chill it. These operations will be described in detail as the other figures are explained. The electrostatic compressor 206 may be sensitive to dust for some designs, so the incorporation of intake filter 114 and exhaust filter 116 are included. While some embodiments of this invention may operate suitably with only an intake filter 114 and with no filter in the exhaust, or no filters at all, many implementations will benefit from both filters as shown. It is also possible to include filters in the ducts, or other locations in the system tied to the air cycle heat pump 100 so that they would not be required within the enclosure 101 shown in FIG. 1. The intake filter 114 ensures that the incoming air flow through the system does not contain large particles that could interfere with operation of the electrostatic compressor 206. The exhaust filter 116 ensures that reverse airflow that may occur through the system when it is not in active operation does not introduce particles into the electrostatic compressor 206. The exhaust filter 116 may also help to ensure that any small particles of material that may be released from the electrostatic compressor 206 due to wear or system break down do not contaminate the exhaust air flow. The intake filter 114 and exhaust filter 116 may be implemented with High Efficiency Particulate Air (HEPA) technology or with other suitable filter technologies; electrostatic air filters are also an option. It is also possible to cascade multiple filters so that larger particulates are filtered out before reaching a finer size filter closer to the electrostatic compressor 206. For simplicity, no structure is shown for how the intake filter 114 or the exhaust filter 116 can be removed for cleaning or replacement. Clearly, there are many common techniques that can be applied for properly mounting air filters. As the electrostatic compressor 206 operates, it moves heat out of the enclosure 101 through a heat exchanger 200 mounted on the enclosure 101. This heat exchanger 200 is only partially visible in FIG. 1 and will be described further in FIG. 2. To avoid unwanted conduction of heat, enclosure 101 would normally be constructed of an insulating material or would be lined with thermal insulation. Similarly, the exposed portion of the heat exchanger 200 that is visible in FIG. 1 would also normally be covered with thermal insulation. This insulation has been left out of FIG. 1 to make the figure less cluttered.

The electrostatic compressor 206 compresses and releases air in such a manner that the released air can help to drive circulation of air through the air cycle heat pump 100. In FIG. 1, the electrostatic compressor 206 is positioned beneficially in this regard so that air flow exiting the electrostatic compressor 206 is directed towards the exhaust port 106 so that it will facilitate airflow through the system. It is noteworthy that in this embodiment, the air cycle heat pump 100 does not process all the air flowing through the system with the electrostatic compressor 206. That is, some air will pass through the system without being compressed and expanded to generate cooling action. This is advantageous as it allows for a simple system implementation, reduces costs, and the air flow through the system improves ventilation.

Condenser 118 in FIG. 1 may be implemented as a metal mesh or screen, but other materials that allow airflow and provide heat conduction are also suitable. Cold air from the electrostatic compressor 206 is directed to the condenser 118 so that the condenser 118 surface is cold, causing air flowing over it to condense moisture. As this moisture builds up, it flows to the bottom of the condenser 118 and into the condensate drain 120. Condensate drain 120 is shown as an open-ended trough, but could be closed on one end to avoid leakage of water and could be plumbed to a water drain on one or both ends. Since the condensate collected in condensate drain 120 is very cold, it could also be used to collect heat from the heat exchanger 200. If this system improvement is implemented, external or internal piping to the enclosure 101 could be used to direct the condensate to a part of the heat exchanger 200. The cold condensate could be flowed over the surface of the heat exchanger or could be flowed through internal passages in the heat exchanger and then drained or evaporated away. The condensate may be pumped or the heat exchanger 200 could be positioned on the enclosure 101 so that gravity flow of the condensate could be possible. It is noted that in some conditions frost or ice may build up on the condenser 118 and/or the electrostatic compressor 206. In most situations, the frost or ice would simply melt during the system idle time (i.e. when the system is not actively cooling) or could be caused to melt by increasing the warm air flow through the system or flowing warm air through the system without operating the electrostatic compressor 206. In some embodiments, a defrost cycle in which the condenser is heated to allow frozen moisture to melt may also be implemented. Since the condenser 118 may be made from an electrically conductive material, a defrost cycle could be implemented by heating it by passing an electrical current through it. Other defrost techniques are also possible.

It is also possible to use other techniques to remove moisture through the air flowing through the air cycle heat pump 100. For example, a desiccant may be used to absorb moisture that could later be removed by ventilating the desiccant material with outside air, by heating the desiccant, or by other techniques. It may also be beneficial to build the condenser 118 with hydrophobic surfaces so that it easily beads and sheds water. Some other surfaces in the air cycle heat pump 100 may benefit if they are designed with hydrophilic surfaces (perhaps similar to the surfaces used on self-cleaning glass). For example, the compressor vanes 400 to be described later may benefit if their surfaces are hydrophilic since they will then spread water substantially evenly over their surface area.

The control module 108 is an electronic controller that receives control inputs, monitors system operation and drives the electrostatic compressor 206. The control inputs to control module 108 may include temperature set-points, humidity set-points, or other control parameters. Although not shown in FIG. 1, these control points may be made from a keyboard or other controls on the control module 108 itself, or may be sent through a wired or wireless connection from other sources. Any of a wide variety of ways to provide these inputs is possible including direct input on a keyboard, use of switches or knobs, external thermostats, external controllers, or other methods. Control module 108 may include analog circuitry, power control circuitry, logic circuitry, memory, microprocessors, relays, printed wiring boards, motors, and other electronic, electrical, mechanical, or electro-mechanical elements. The construction and design of such a module that would be suitable for use in the systems described in embodiments of this invention are well known and so will not be explained in detail here. Also, the control module 108 is shown mounted outside the enclosure 101, but other mounting and system integration options are also possible. The control module 108 could also be mounted inside the enclosure 101 or could be mounted outside the enclosure 101 as a separate assembly connected to the enclosure 101 only through electrical wiring, other options are also possible. In the embodiment illustrated in FIG. 1, an intake port temperature sensor 112 is connected to the control module 108 through the wiring shown and allows the control module 108 to monitor the intake air temperature. Similarly, exhaust port temperature sensor 110 allows the control module 108 to monitor the cool air flow leaving the system. Control module 108 is also connected to the electrostatic compressor 206 through wiring harness 122 and directly drives and controls it. The control module 108 can alter how it drives the electrostatic compressor 206 to minimize system power use and noise. Of course, since the control module 108 has direct knowledge of the intake and exhaust air temperatures, it can also optimize system operation on an ongoing basis. Many well known system optimization algorithms such as the Least Mean Squares (LMS) algorithm or other well known algorithms are possible. Additional sensors may also be included to allow the system to further optimize performance. As one example, a humidity sensor can be included in the intake to allow the system to operate in a manner that is beneficial in controlling humidity. If substantially reducing humidity of the intake air is desired, the system could operate the electrostatic compressor 206 at a higher or lower level to enhance moisture removal. If, for example, only mild cooling were demanded from the system, it may be necessary to operate the electrostatic compressor 206 at a higher level so that the condenser 118 is sufficiently cold to allow moisture removal (clearly, it must be below the dew point of the air flow for condensation to occur). Alternatively, it may be optimal in some cases to allow the system to operate longer at a lower level to achieve more moisture removal before over-cooling the room or other enclosure being cooled. Also, if the intake air is already at an acceptable humidity level, the system may operate more quietly and efficiently if the electrostatic compressor 206 is operated at a reduced level. The electrostatic compressor 206 can be operated at higher or lower levels, within limits, by increasing or decreasing the voltage and/or the frequency of the waveforms driving it as described later. The addition of sensors to sense air flow, humidity, air pressure, air temperature outside the enclosure 101, the temperature of heat exchanger 200, system noise level, and other parameters are all possible so that the control module 108 can optimize system performance in view of those parameters.

The use of the control module 108 with sensors may also allow the control module 108 to detect fault conditions including either the failure or symptoms indicating a likelihood of failure of certain components in the system. Such faults could be signaled to indicate the need for maintenance or servicing.

While sensing the intake and/or the exhaust air temperature with intake port temperature sensor 112 and exhaust port temperature sensor 110 is desirable, it is possible to build an air cycle heat pump 100 without doing so. That is, the system may also operate only by chilling air when it is turned on and stopping when it is shut off with no monitoring of temperature, pressure, or other variables. It is also possible to operate the system in this manner with a thermostat to turn the system on and off on demand depending on how the actual building or enclosure temperature compares to a thermostat setting. Operating an air cycle heat pump 100 without sensors to monitor air temperatures and other variables may provide reduced system cost or may be practical in cases where the air temperatures or other variables do not vary substantially from nominal levels.

Since the electrostatic compressor 206 makes use of electrical signals that may include elevated voltage levels, the air cycle heat pump 100 may include safety features to ensure that persons operating or servicing it will not experience electric shocks. Service doors, panels, and other openings may have interlock switches installed so that the control module 108 can monitor them and shut electrical power off to the electrostatic compressor 206 when they are opened. The wiring harness 122 and other electrical connections should be properly insulated and mounted. Also, the enclosure 101 may be connected to earth ground so that the system remains safe in the event of an electrical power short. The air cycle heat pump 100 may be connected to external electric power through a properly installed fuse, circuit breaker, or other protection devices in accordance with regulations and good safety practices. Additionally, protective devices to protect the air cycle heat pump 100 from power surges, lightning strikes, or other possible hazards may be included. The inclusion of grounded safety screens may also be beneficial. In the embodiment illustrated in FIG. 1, air cycle heat pump 100 includes intake port safety screen 126 and exhaust port safety screen 124 to ensure that a person changing filters, cleaning, or servicing the system would be further protected from electrical shock. These safety screens could be made from bars, screens, meshes, or other configurations. It is further noted that the missing side panel of the enclosure 101 shown in FIG. 1 could be formed in sections so that part of it could be opened or removed to allow some service to be performed on the system while keeping the more dangerous portion of the system near the electrostatic compressor 206 not accessible (due to the panel design and the presence of the safety screens). Grounded safety screens and other grounded components (where and when possible) in the air cycle heat pump 100 may also be beneficial in minimizing the build up of static electrical charge. It is also noted that some applications of the air cycle heat pump 100, such as automotive and other mobile applications, may benefit from shut down features that could automatically shut down the electrostatic compressor 206 and remove potentially hazardous electrical levels in the event of a vehicle collision or the detection of other conditions that may indicate putting the air cycle heat pump 100 in a safe mode could be beneficial.

Figure 2:
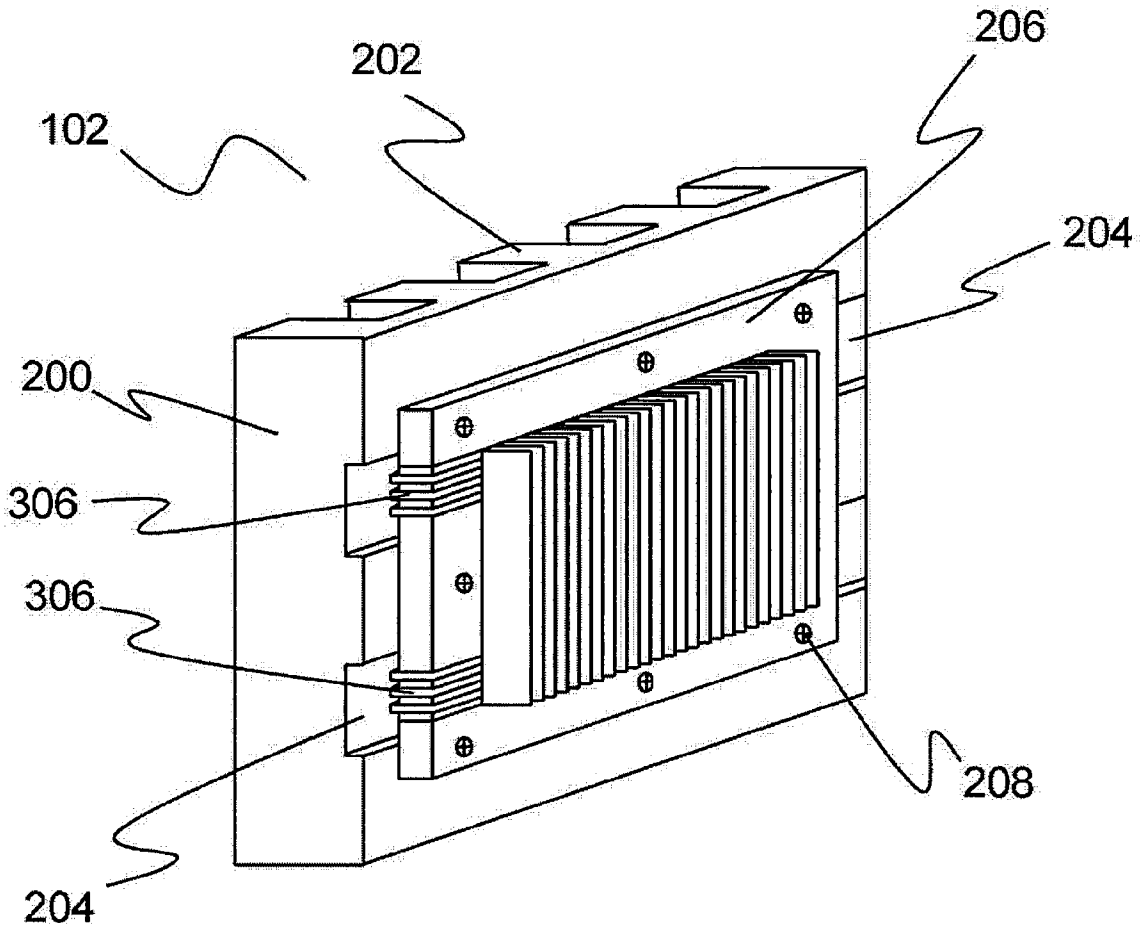
FIG. 2 illustrates an embodiment of an electrostatic compressor and heat exchanger assembly.

FIG. 2 illustrates an embodiment of the electrostatic compressor and heat exchanger assembly 102 shown in FIG. 1. It consists of the electrostatic compressor 206 mounted to heat exchanger 200 with mounting screws 208. The heat exchanger 200 includes relief areas 204 to avoid contact of the electrical wiring 306 with the heat exchanger 200. Heat exchanger 200 also includes cooling fins 202 to facilitate heat flow from the electrostatic compressor 206 through the heat exchanger 200 and on to the air outside enclosure 101. It is noted that while the heat exchanger 200 is shown as air cooled with air cooling fins 202 in this embodiment, the heat exchanger 200 might also release heat through liquid cooling, thermal conduction to other structures, electronic cooling, other forms of chillers or air conditioners, or through other mechanisms. It is also possible to use thermal energy harvesters or scavengers on the heat exchanger 200 to recover electrical energy from the heat being released. The heat exchanger 200 can be constructed from a highly thermally conductive material such as aluminum, but other materials such as copper, brass, and other metals or non-metal heat conductors could be used in this application. The heat exchanger 200 may also benefit from the incorporation of carbon nanotubes or other nanostructures to improve its ability to absorb, conduct, and/or release heat. The use of mounting screws 208 is also optional and the electrostatic compressor 206 could be mounted to the heat exchanger 200 through a wide variety of techniques including bolts, clips, wedges, adhesives, solder, welding and/or other techniques. It is noted that techniques for mounting the electrostatic compressor 206 to the heat exchanger 200 should provide an intimate and high quality thermal conduction path and that thermal compounds, gaskets, thermal grease, or a metallic contact such as solder or welding, or other techniques may be used to reduce the thermal impedance. Additionally, the ability to easily remove the electrostatic compressor 206 from the heat exchanger 200 is beneficial in allowing it to be removed for maintenance, repair, or replacement.

Figure 3:
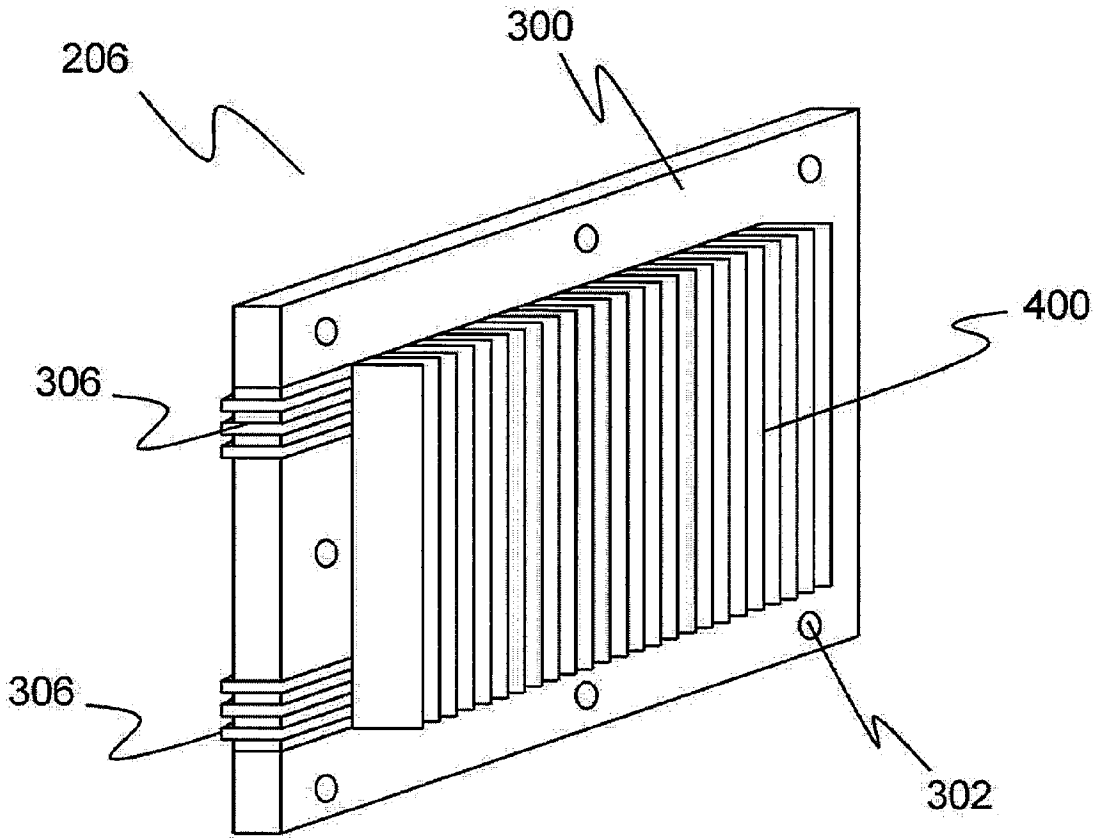
FIG. 3 illustrates an embodiment of an electrostatic compressor.

The electrostatic compressor 206 is illustrated in FIG. 3. It consists of a mounting plate 300, compressor vanes 400, mounting screw holes 302, and electrical wiring 306. As noted above, construction of the electrostatic compressor 206 as a removable and modular unit is beneficial for maintenance and repair purposes. The electrostatic compressor mounting plate 300 could be constructed from metals or from plastics or other materials. Since the mounting plate 300 is thermally contacted to the heat exchanger 200, it is desirable for the mounting plate 300 to be thermally insulating or to be coated with insulation to avoid thermal conduction through it. As shown in FIG. 3, the mounting plate 300 also includes electrical wiring 306 that could be formed as lithographically patterned conductors on the surface of the mounting plate 300, as conductors that extend through the mounting plate 300, or through other possible constructions. The electrical wiring 306 on the mounting plate 300 will adjoin and provide electrical conduction to electrical vias formed on the compressor vanes 400 and vane spacers described later.

Figure 4:
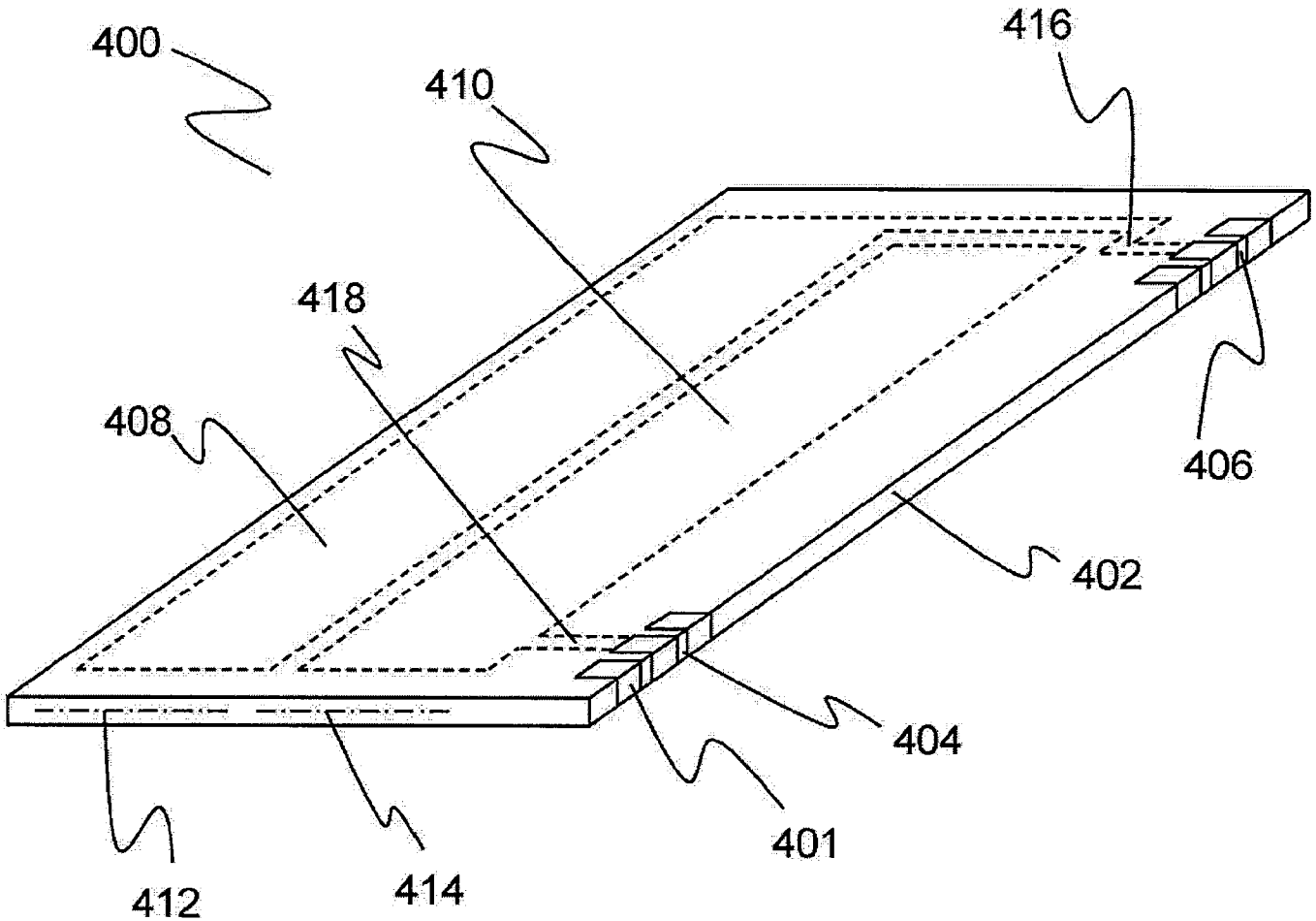
FIG. 4 illustrates an embodiment of a typical vane used in an electrostatic compressor.
Figure 14:
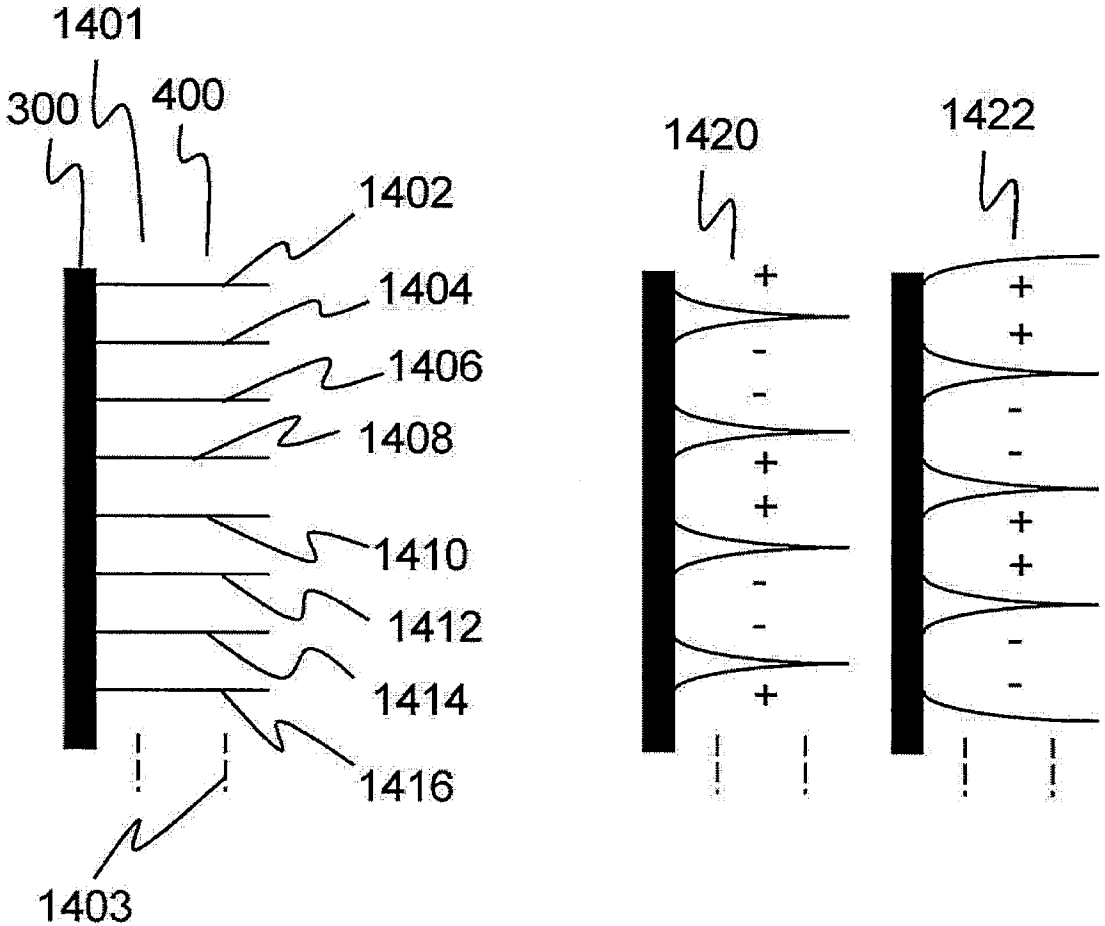
FIG. 14 illustrates a schematic diagram for an implementation of an electrostatic compressor with two phase operation.
Figure 16:
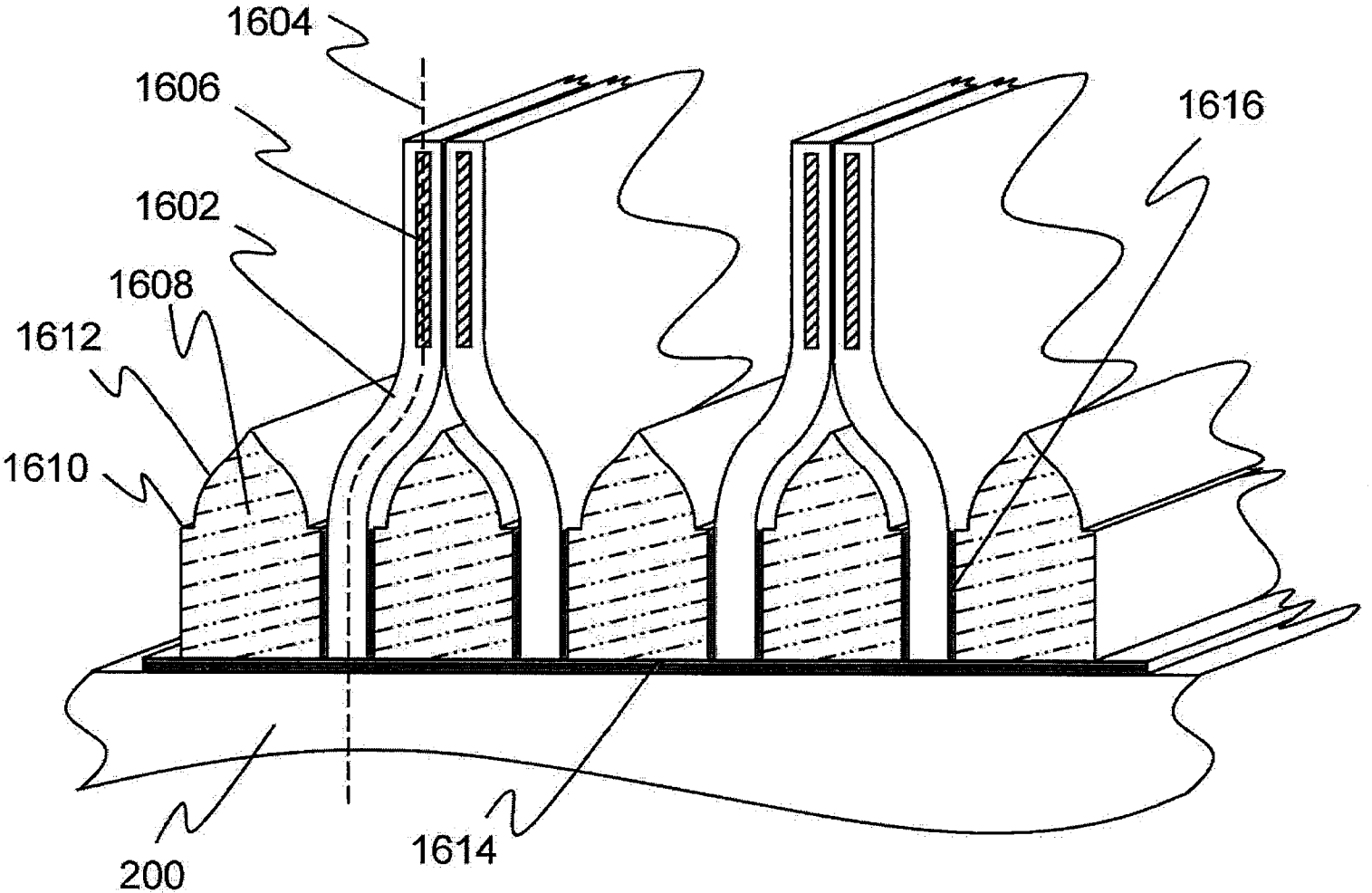
FIG. 16 illustrates an embodiment of an electrostatic compressor with enhanced vane spacers.
Figure 19A:
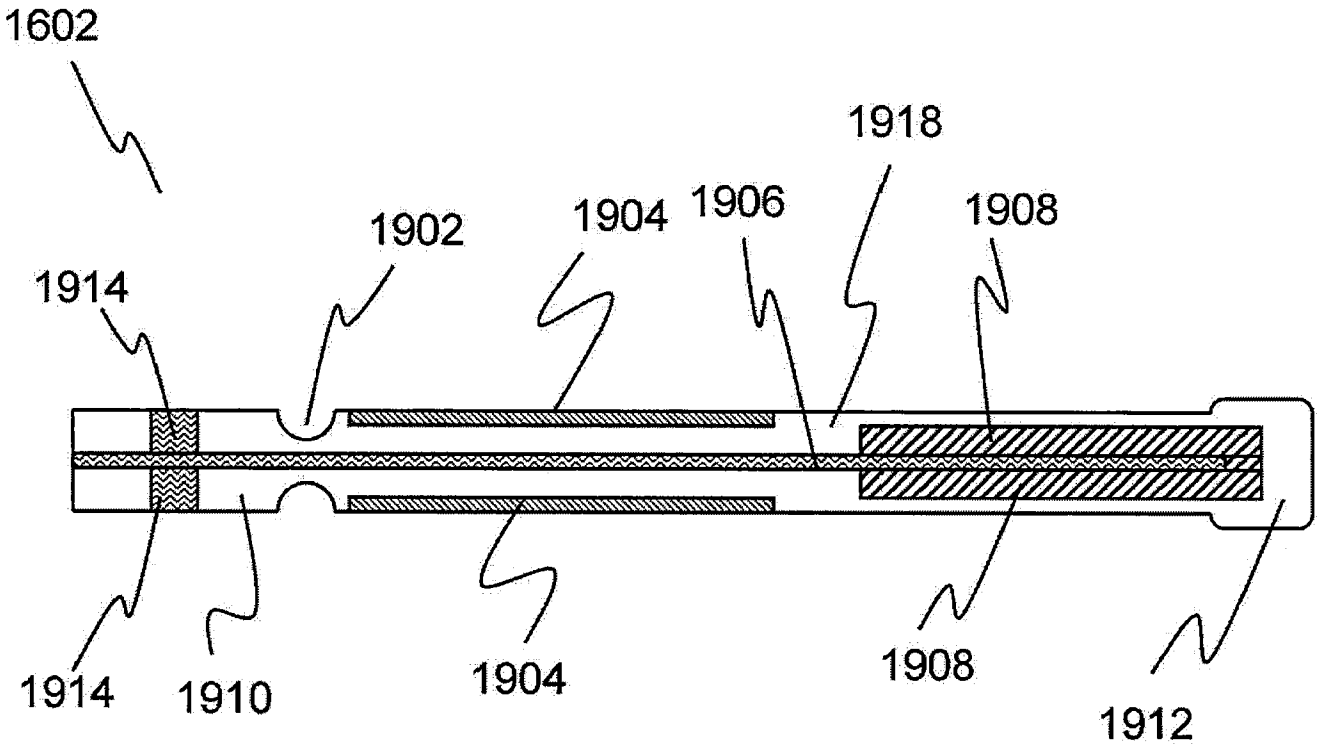
FIG. 19*a* illustrates a cross section of a compressor vane with enhanced construction.
Figure 19B:
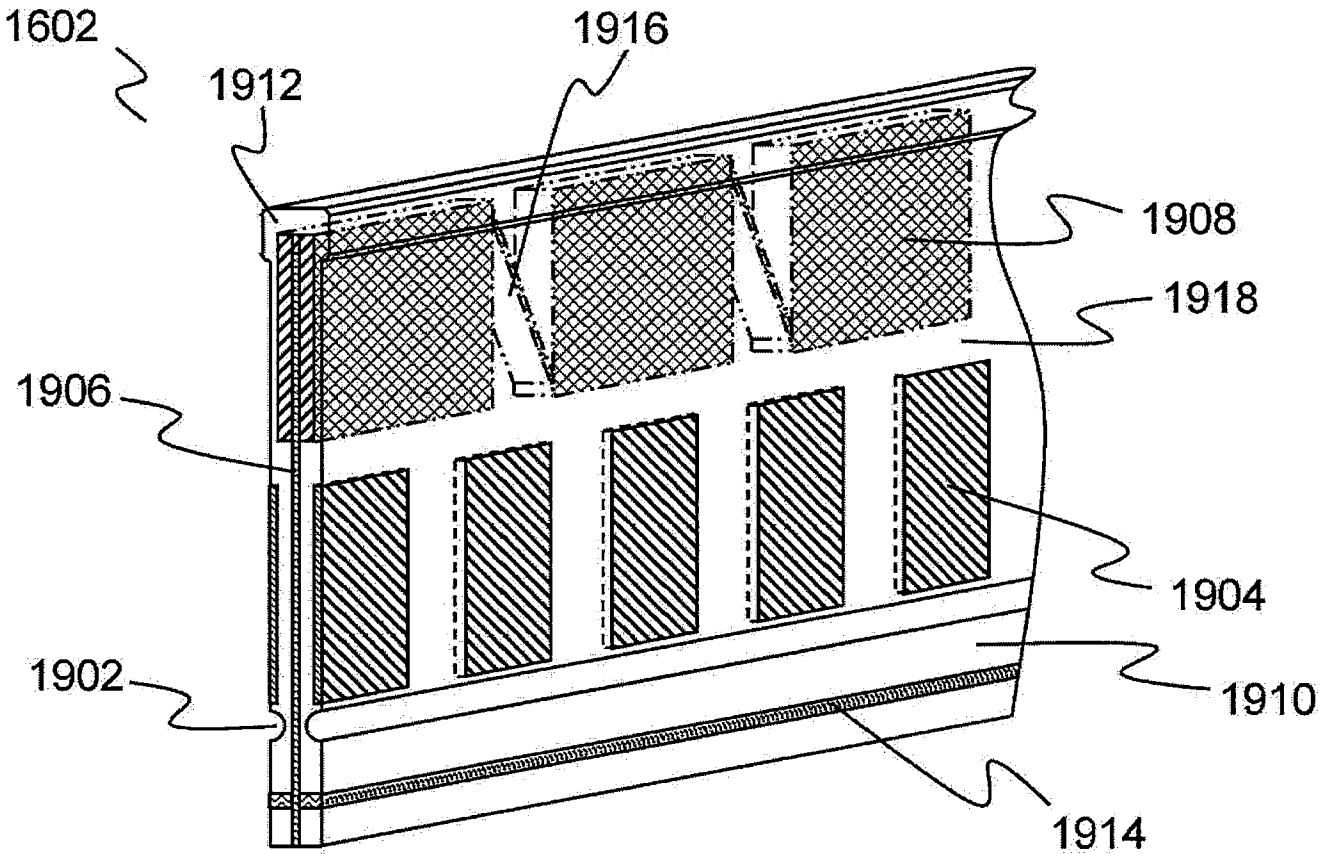
FIG. 19*b* illustrates a side view of a compressor vane with enhanced construction.

FIG. 4 illustrates an embodiment of compressor vane 400. Here, the word "vanes" or "vane" will be used at times to refer generally to the compressor vane 400. In the electrostatic compressor 206 of FIG. 3, the compressor vanes 400 are controlled by applying voltages to conductive regions embedded in the compressor vanes 400. In this embodiment, each compressor vane 400 has two conductive regions, an inner conductive region 410 and an outer conductive region 408. These conductive regions and their associated electrical connections are shown as dashed lines in FIG. 4 as they are thin planes of conductive material embedded in the compressor vane 400 or are covered by electrical insulation and may not be normally visible. While the drawing in FIG. 4 does not convey a thickness associated with the inner conductive region 410 or the outer conductive region 408 (since they are embedded layers and only their outline is shown), these are actual layers of conductive material embedded in the compressor vane 400 with a finite thickness. Additional embodiments of compressor vanes are shown in FIG. 16, FIG. 19*b*, and several other figures that provide additional views of their internal construction. Compressor vanes 400 with a single conductive region or with more than two conductive regions are also possible, as are conductive regions of different sizes and shapes. It is noted that the convention of referring to the inner conductive region 410 shall be used in reference to the part of the compressor vane 400 closer to the mounting plate 300 and, of course, also closer to the heat exchanger 200 in the final assembled electrostatic compressor and heat exchanger assembly 102. The outer conductive region 408, is then the region further from the mounting plate 300 and the heat exchanger 200. This convention for referring to elements as "inner" and "outer" depending on their location relative to the mounting plate 300 and heat exchanger 200 will be used for later descriptions as well. The compressor vane body 402 is either made from an electrically insulating material or the compressor vanes 400 are coated with electrical insulation. In this embodiment, it is assumed that the compressor vane 400 is made from an electrically insulating material covering the conductive regions and that the body 402 of the compressor vane 400 is composed of an electrically insulating material. The compressor vanes 400 may be subjected to high levels of stress and elevated temperatures. Consequently, the compressor vanes 400 may include carbon fiber, graphite fiber, polyimide, para-aramid or aramid fibers such as Kevlar (a registered trademark of E. I. du Pont de Nemours and Company), silicon dioxide, silicon nitride, diamond, and nanotube yarns or sheets. Such materials may be incorporated throughout the body 402 of the compressor vane 400, may be composed in a layer of material over which the compressor vane 400 is formed, or may be applied in other ways. In some embodiments, small dimensions and spacing of the compressor vanes 400 may allow materials such as silicon, glass, ceramics, metals, and many other materials to be used. The inner conductive region 410 and the outer conductive region 408 may be constructed from metals such as nickel, titanium, aluminum, copper, gold, or other metals; or from conductive polymers, conductive fiber, nanotube yarns, nanotube sheets, or other conductive materials. As there are many well-known methods for molding or laminating conductors with insulating polymers or other materials, they will not be further described here. Other constructions are also possible. For example, FIG. 14 illustrates an embodiment in which the compressor vanes 400 are constructed with a single conductive region. In such a case, a solid conductive compressor vane 400 coated with an insulating film or layer on the outer surface and around vias 401 would be possible. In this case, constructing the compressor vanes 400 from metals, silicon, semiconductors, glass, synthetic fibers, ceramics, diamond, diamond-like materials, polymers, carbon fiber, nano-fiber, and many other materials may be possible.

In the embodiment illustrated in FIG. 4, the conductive vias 401 are organized into a first conductive via bank 404 and a second conductive via bank 406. The term "via" is widely used in electronic design to designate a conductor that provides an electrical path from one layer or area of circuitry to another, and it is used here with the same meaning. In the embodiment of FIG. 4, each of these via banks includes three vias 401 for a total of six vias 401 on compressor vane 400. Note that the inner conductive region 410 is shown with electrical connection 418 connecting it to a via in the first via bank 404 and the outer conductive region 408 is similarly connected through electrical connection 416 to a via in the second via bank 406. As will become clear, either of the conductive regions may be connected to any of the vias 401 in either via bank depending on which drive signals are needed for appropriate operation. The vias 401 shown in FIG. 4 are used to propagate electrical signals through the structure of the electrostatic compressor 206 so that each specific compressor vane 400 has access to the signals that drive it.

It is noted to ensure clarity that the conductive regions in FIG. 4, the inner conductive region 410 and the outer conductive region 408, are embedded in the compressor vane 400 or are covered with electrical insulating material. Hence if viewed from the end of the vane, these regions may appear as the image of the outer conductive region 412 and the image of the inner conductive region 414 that are shown as dashed lines since they are the surface view of an inner thin element and not actual elements themselves. It is also noted that the electrical vias 401 shown in FIG. 4 may be formed as electrical conductors wrapped around the outside of the compressor vane 400, as solid metal elements that extend through the vane entirely, or with other construction techniques. In every case, the vias 401 perform the function to allow electrical signals to pass through or over the compressor vane 400.

The compressor vane 400 may benefit in some embodiments from use of two layers of conductors making up the conductive regions. For example, in FIG. 4, the inner conductive region 410 and the outer conductive region 408 could be made from two planes of conductive material each stacked above each other. In this way, the compressor vane body 402 can be kept sufficiently thick to maintain mechanical strength, but the conductive regions can be kept thin and close to the surfaces of the compressor vane 400. This use of thin planes of conductive material for the inner conductive region 410 and the outer conductive region 408 may be beneficial in making the compressor vane 400 more flexible and may help improve the actuation of the compressor vanes 400 as the electric charge on them will be more fully concentrated near the surfaces of the compressor vanes 400.

Figure 5:
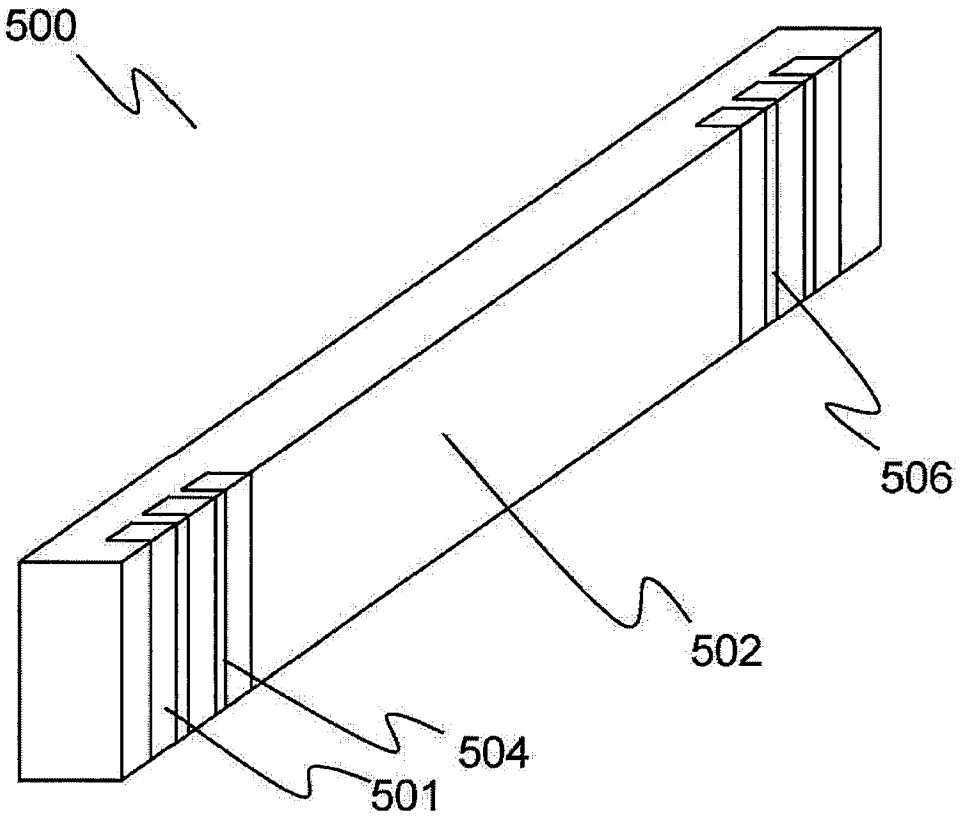
FIG. 5 illustrates an embodiment of a vane spacer used in an electrostatic compressor.

FIG. 5 illustrates an embodiment of vane spacer 500. Vane spacers 500 include vane spacer body 502 made from a heat conductive material that is electrically insulating so that heat can be conducted through the vane spacer 500 but the electrical vias 501 in first via bank 504 and second via bank 506 are kept electrically isolated. For such an implementation, a material such as alumina, diamond, or similar materials would be appropriate, but many other materials are also possible. Alternatively, the vane spacer body 502 could be built out of a material such as a metal that is both thermally and electrically conductive. If such a construction is used, electrically insulating inserts or insulating layers are required between the electrical vias 501 and the vane spacer body 502 to ensure that the vias 501 are not electrically shorted out. It is noted that the vias 501 in FIG. 5 incorporated in the vane spacer 500 may be of identical or of a different implementation, dimension, or construction from the vias 401 in the compressor vane 400. However, they serve the identical purpose to pass electrical signals through the vane spacer 500. It is noted that silicon may be a good material choice for the vane spacer 500 if a conducting or semi-conducting vane spacer body 502 material is chosen. Since silicon processing is highly advanced and forming insulators and conductors on silicon is routinely done in manufacturing processes today, such a construction should be relatively easy to implement. In addition, silicon has good thermal conductivity. Of course, many other materials including other semiconductors, metals, ceramics, polymers, and other materials are also possible.

Figure 6A:
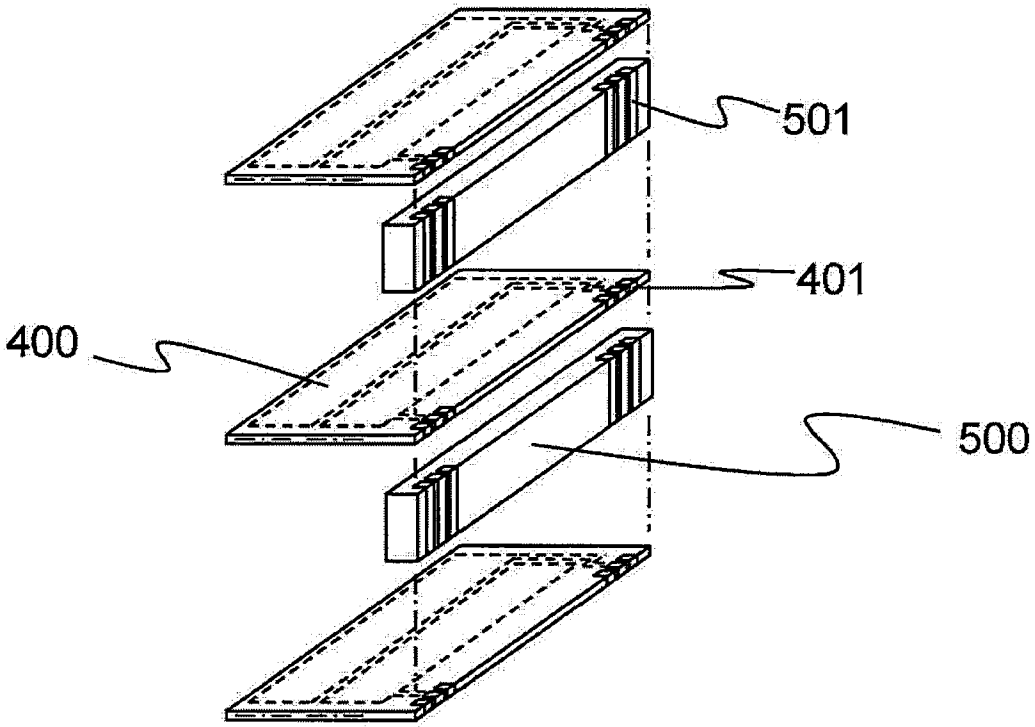
FIG. 6*a* illustrates an embodiment of an assembly of the vanes and spacers of FIG. 4 and FIG. 5 to form an electrostatic compressor.

FIG. 6*a* illustrates a basic technique for construction of the electrostatic compressor 206. Compressor vanes 400 are stacked alternately with vane spacers 500 so that a series of separated vanes are produced that have electrical connection through the electrical vias 501 and 401 included in both the vane spacers 500 and the compressor vanes 400, respectively. As is clear in FIG. 6*a*, the vias 401 on the compressor vanes 400 and the vias 501 of vane spacers 500 are aligned so that a continuous conductor is formed for each electrical signal once the electrostatic compressor 206 is assembled. In the construction of an electrostatic compressor 206, the compressor vanes 400 and vane spacers 500 could be bonded together with adhesive, glue, other bonding techniques, or alternately, could be held together with mechanical fasteners such as snaps, clips, screws, bolts, or other possible fasteners. The mounting plate 300 shown in FIG. 3 can be affixed to the assembled compressor vanes 400 and vane spacers 500 through similar means, that is, with adhesives, glues, mechanical fasteners, with other techniques or a combination of techniques. As some embodiments of the electrostatic compressor 206 may include a very large number of compressor vanes 400 and vane spacers 500, it is noted that automated assembly of the electrostatic compressor 206 using robotics or other automation technology may be beneficial.

Figure 6B:
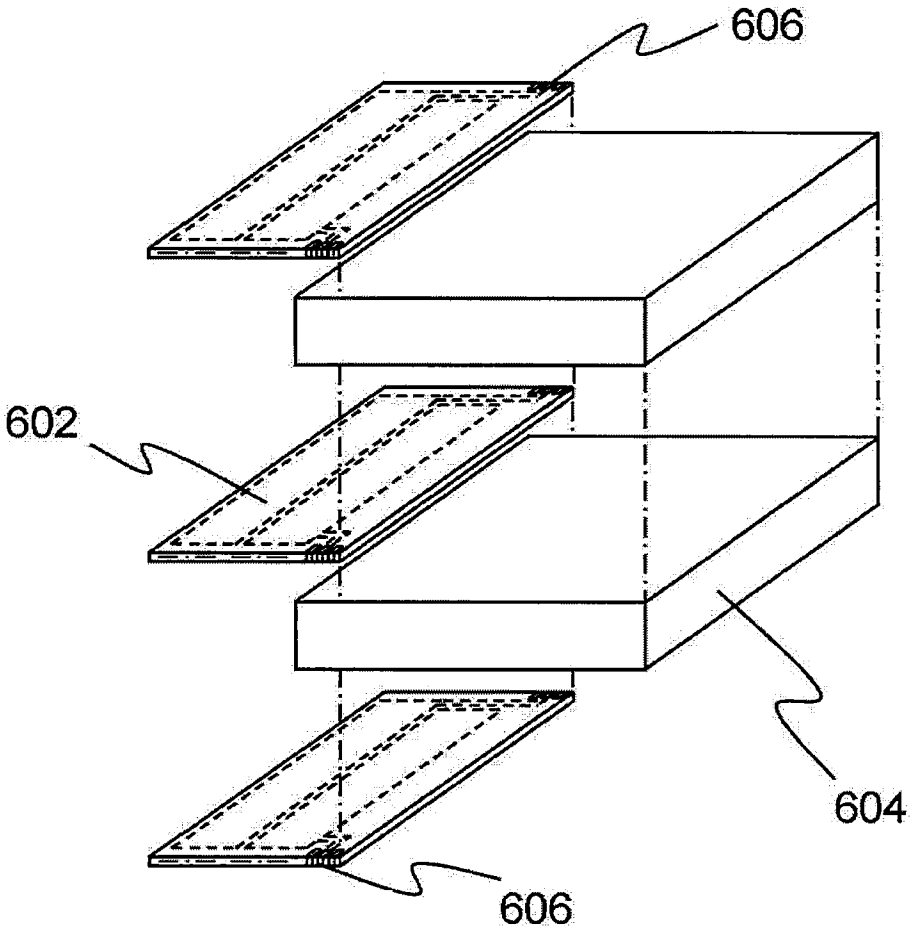
FIG. 6*b* illustrates an alternative embodiment for the assembly of the electrostatic compressor in which the vias in the vanes are on the vane ends and the vane spacers extend beyond the vanes.

FIG. 6*b* illustrates an alternative embodiment for the assembly of the electrostatic compressor 206 in which the vias of the vanes are on the vane ends and the vane spacers extend beyond the vanes. To avoid confusion, these vias on the vane 602 ends are referred to as end vias 606 even though they serve the same purpose as the vias 401 already described and are only located differently on the vanes 602. Vanes 602 with end vias 606 are shown with extended vane spacers 604. The inclusion of end vias 606 on the ends of the vanes 602 allows the extended vane spacers 604 to be electrically bypassed so that the extended vane spacers 604 need not include vias. The use of end vias 606 may also be implemented to remove the need for vias 501 in the conventional vane spacer 500 already described. Using end vias 606 may allow lower manufacturing costs, more flexibility in the choice of materials for the vane spacers 500 or extended vane spacers 604 and, as will be seen in FIG. 7*b*, may improve the flow of heat through the system. Other options for including vias, such as moving them away from the edges of the compressor vanes 400 or vanes 602 to the interior of these structures are also possible.

Figure 7A:
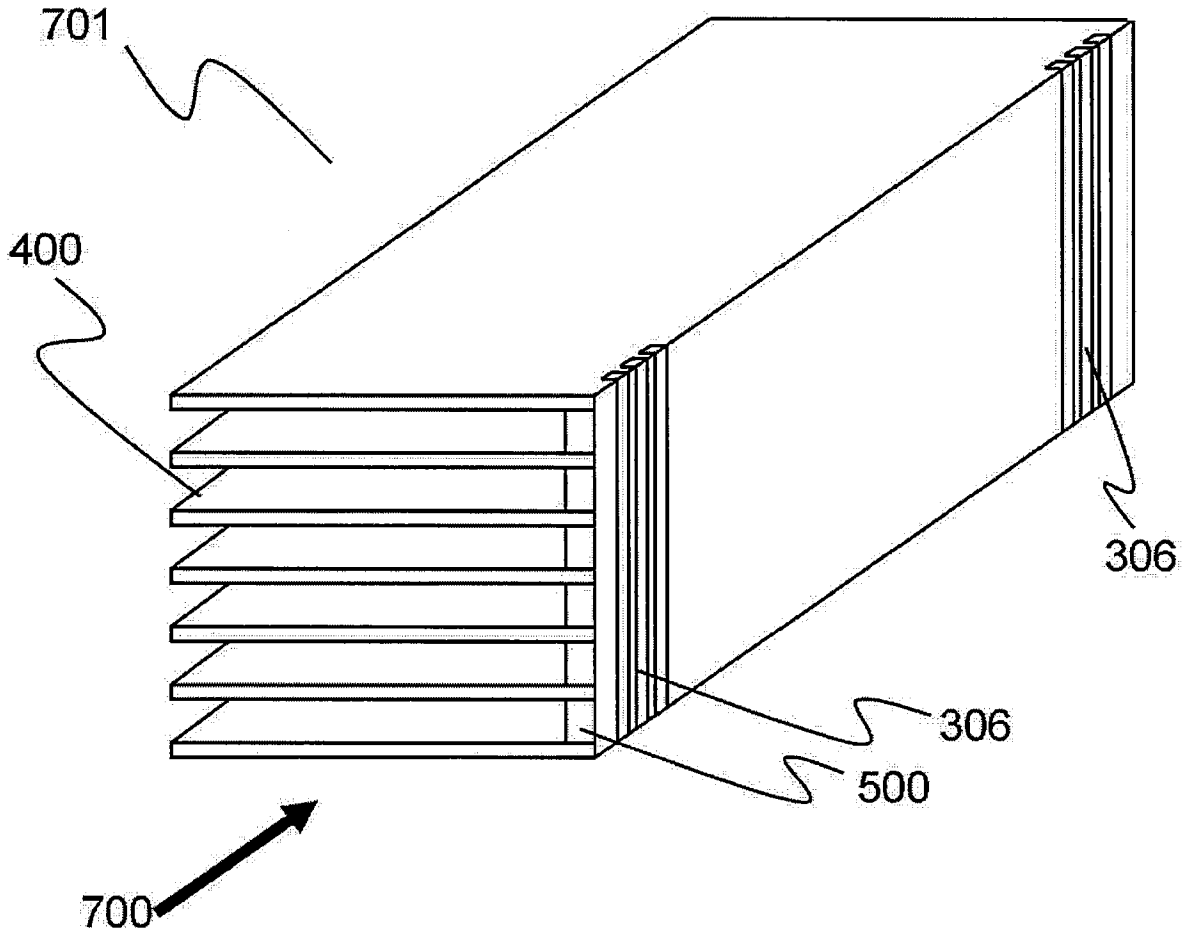
FIG. 7*a* illustrates an embodiment of a partially assembled electrostatic compressor based on the assembly shown in FIG. 6*a*.

FIG. 7*a* illustrates an embodiment of a partially completed electrostatic compressor subassembly 701. Compressor vanes 400 are shown extending from the side of the subassembly 701 where the vane spacers 500 are located. The stacked structure of compressor vanes 400 and vane spacers 500 creates continuous conductors formed from the vias (the vias 401 of compressor vanes 400 and the vias 501 of vane spacers 500) along the base of the subassembly 701. These conductors are shown explicitly as the electrical wiring 306. The electrical wiring 306 shown in FIG. 7*a* is part of the same electrical wiring 306 that is shown in FIG. 2 and FIG. 3 and is numbered identically to make this clear. It is noted incidentally that an additional conductor, conductive layer, or solder layer could be added to the individual vias 401 and 501 making up the electrical wiring 306 to ensure a consistent connection across the structure and avoid the dependence on perfect contact to both sides of each via 401 and 501 on every compressor vane 400 and vane spacer 500. Other configurations where the vias 401 and 501 are embedded inside the compressor vanes 400 and vane spacers 500 (that is, where the vias are not at the edges of these structures) are also possible. A fully assembled electrostatic compressor 206 may include hundreds or even many thousands of compressor vanes 400. Once the fully constructed compressor sub-assembly 701 is complete with all the vanes and spacers in place, it could then be mounted to the mounting plate 300 as shown in FIG. 3. The electrostatic compressor end view 700 is shown in FIG. 7*a* to make the term "end view" clear as it is referred to in some subsequent figures. The electrostatic compressor end view 700 is simply the view of the compressor vanes 400, vane spacers 500, and/or the mounting plate 300 as viewed in the direction as shown by the arrow in FIG. 7*a* (note that the mounting plate 300 is not shown in FIG. 7*a*, but that it would normally appear in the end view of the electrostatic compressor 206 and for that reason it is mentioned here). Additionally, the term length or longitudinal direction will be used to refer to the direction along the length of the compressor vane 400, referencing the length as being along the longest rectangular dimension of the compressor vane 400 as shown in FIG. 7*a* (i.e. the longest straight non-diagonal dimension). It is noted for additional clarity that the arrow in FIG. 7*a* denoting the end view 700 points in a longitudinal direction as defined here. The width of the compressor vane 400, is then taken as the dimension of the compressor vane 400 orthogonal to the length across it's larger flat surface. And the thickness of the compressor vane 400 is the smallest rectilinear dimension of the compressor vanes 400 shown in FIG. 7*a*. Of course, the thickness is orthogonal to both the width and the length.

The electrostatic compressor 206 consists of a plurality of compressor vanes 400 that can be actuated by controlling the electrical polarity and voltage applied to them. Small amounts of air are trapped between the vanes and the vanes are actuated in a manner to compress the air against the vane spacers 500. Since the vane spacers 500 are thermally conductive and the compressed air is at elevated temperature heat flows readily from the compressed air through the vane spacers 500 and on to the heat exchanger 200. Once the heat has been transferred, the vanes can be relaxed so that the air expands and drops in temperature. In this fashion, the air is chilled and is suitable for cooling purposes. Depending on how the system is configured and the specific application, the vane spacing, vane thickness, vane width and length, voltages uses, and operating frequency may vary considerably. Applications with vanes that are only a centimeter wide (or less) and are spaced at a fraction of a millimeter, and operate at several kilohertz are possible. However, very substantially larger and even smaller dimension systems are also possible, as are a very wide range of operating voltages and frequencies.

Figure 7B:
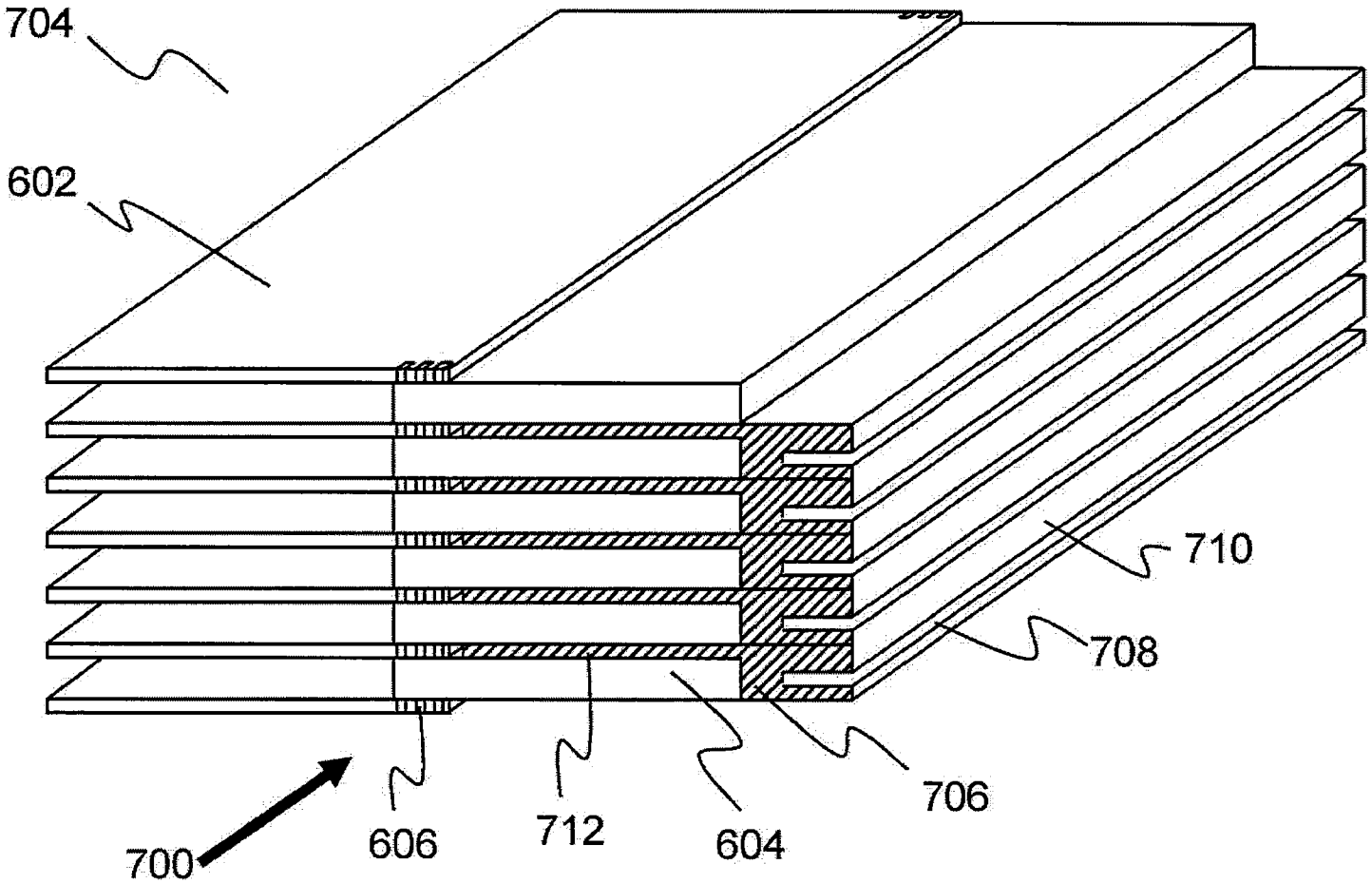
FIG. 7*b* illustrates an embodiment of a partially assembled electrostatic compressor based on the assembly shown in FIG. 6*b* and including some portions of a heat exchanger.

FIG. 7*b* shows a partially completed subassembly 704 including vanes 602, extended vane spacers 604, end vias 606, and heat exchanger pieces 706. Each heat exchanger piece 706 includes fins 710 and notches 708 to facilitate air flow and heat transfer. Each heat exchanger piece 706 also includes a flat section 712 that mates to a portion of a corresponding extended vane spacer 604 as shown in FIG. 7*b*. It is clear from FIG. 7*b* that the extended vane spacer 604 allow a larger area for heat transfer to the heat exchanger 200 than is possible with the vane spacers 500 already described. In fact, the heat exchanger 200 could be formed entirely from extended vane spacers 604 by adding fins 710 and notches 708 directly to the extended vane spacer 604 or even by simply flowing air through the openings formed between the extended vane spacers 604 if the heat exchanger pieces 706 were not included in FIG. 7*b*. It is noted that the compressor vanes 602, themselves could also be extended to help create the structure of a heat exchanger and they may also be formed partially or fully from materials that conduct heat to benefit their operation in this manner (although it may often be preferred that the compressor vanes 602 be thermally insulating, at least in the areas where they contact the air being cooled, to avoid reversed flow of heat through the system). Clearly, many other options to include materials, use thermal grease, bond materials together, machine surfaces, flow cooling fluids, create textures, use colors to enhance thermal emission, and many other approaches to alternatively construct or enhance the electrostatic compressor 206 are possible. The end view 700 shown in FIG. 7*b* has an identical meaning as was explained with regard to FIG. 7*a*. It is also noted that the end vias 606 would normally be connected together so that each end via 606 is electrically connected to the end vias 606 directly above and below it in FIG. 7*b*. Other configurations for connecting the end vias 606 to a wiring harness so that the vanes 602 can be properly controlled are also possible. And, it is also noted that if the extended vane spacers 604 are electrically conductive, that measures (such as the addition of a layer of electrically insulating material around the end vias 606) should be taken to avoid shorting out the end vias 606.

Figure 8:
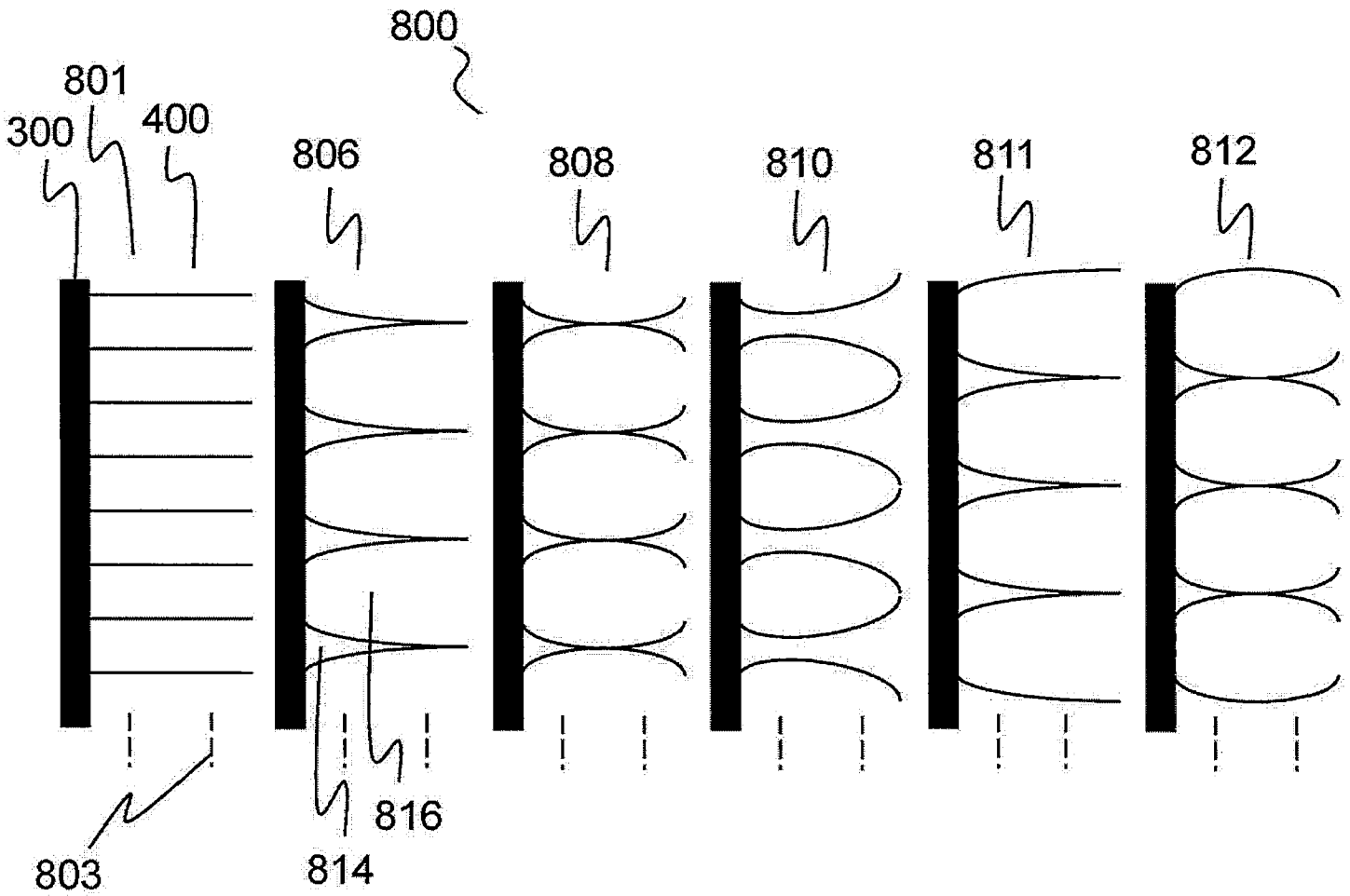
FIG. 8 illustrates a schematic diagram explaining how the vanes of the electrostatic compressor are actuated to compress air or other gases.
Figure 9:
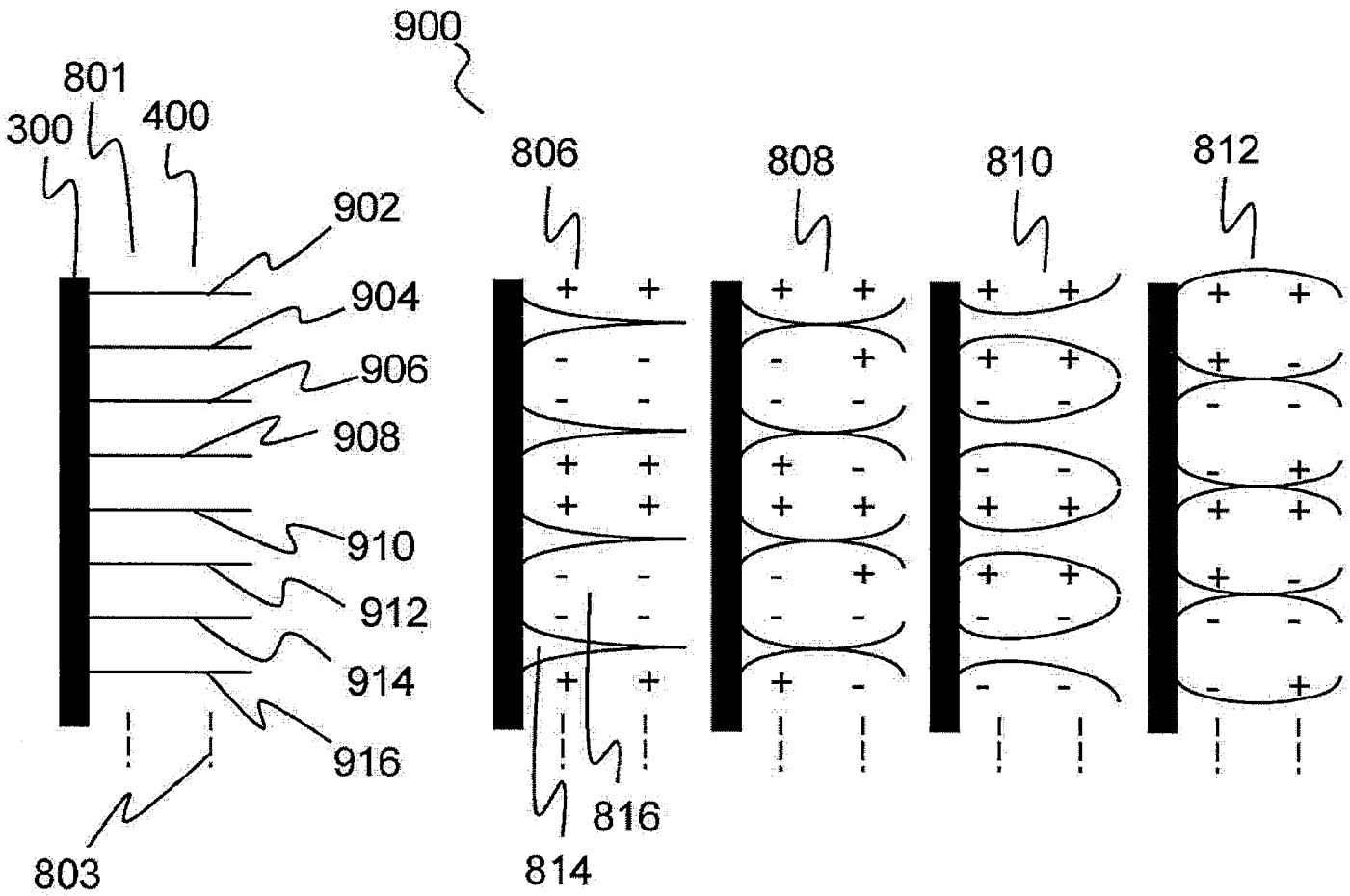
FIG. 9 illustrates a schematic diagram including four operating phases and including charging polarities used on the vanes to produce the desired actuation.

FIG. 8 and FIG. 9 illustrate a schematic view of the vanes and assembly of the electrostatic compressor 206 so that the application of electrical signals and the associated actuation of the vanes can be described. The compressor operational schematic 800 consists of six views of rest and various operating phases. Each view is an end view 700 of the compressor vanes 400 and mounting plate 300. To avoid any confusion, the direction of an end view 700 is shown explicitly in FIGS. 7*a* and 7*b* as the electrostatic compressor end view 700. As the mounting plate 300 obstructs the view of the vane spacers 500 they are not visible in this schematic view. The length of the compressor vanes 400 would extend vertically into the page so that the view shown in FIG. 8 provides a cross-sectional view of how the compressor vanes 400 trap and compress air. Only eight compressor vanes 400 are shown in FIG. 8 to avoid needless clutter in the figure. And while an electrostatic compressor 206 may contain as few as two vanes, the electrostatic compressor 206 may include hundreds or even many thousands of vanes. For that reason, the dashed lines 803 are included in FIG. 8 to note that many additional vanes may be included in a full implementation. The rest phase 801 illustrated in FIG. 8 is for the condition when there is substantially no electrical bias to the conducting regions of the vanes. In this condition, the vanes extend substantially orthogonally from the mounting plate 300. It is noted that in some cases, it may be desirable for the rest phase 801 to electrically bias all the vanes to the same positive or negative potential to facilitate a rest condition for them in which all the vanes are substantially separated and consistently spaced. The first operating phase 806 illustrated in FIG. 8 is for the condition when air has been trapped and compressed between pairs of vanes in the compressed regions 814. The compressed regions 814 and the adjacent regions 816 refer here to the areas between the compressor vanes 400 where air is presently compressed and to the areas adjacent where air is not compressed, respectively. The compressed regions 814 and adjacent regions 816 are interchanged in some phases of operation as air is compressed on both sides of the compressor vanes 400 in different operating phases in this embodiment. The second operating phase 808 illustrated in FIG. 8 is entered by opening the outer portion of the compressed vanes and the third operating phase 810 illustrates the condition in which the inner portions of the compressed vanes are also released. As noted earlier, the inner portion of the compressor vanes 400 refers to the portion of the vane closest to the mounting plate 300, while the outer portion of the compressor vanes 400 refers to the portion further from the mounting plate 300. The operating condition shown for the delayed view of the third operating phase 811 is shown for clarity only. The delayed view of the third operating phase 811 has the identical electrical biasing conditions as the third operating phase 810, it is only a delayed view of how the vanes would appear at the end of this phase. The fourth operating phase 812 is the condition in which the outer portion of the compressed vanes from the third operating phase 810 have been released. After the fourth operating phase 812, the inner portion of the compressed vanes are also released and the first operating phase 806 is re-established. It is clear from FIG. 8 that there are four operating phases that are repeated in a cyclical manner to trap, compress, and release air in the electrostatic compressor 206. It is noted that the actuation applied to release air from the compressed regions 814 in the third operating phase 810, for example, also serves to compress the air in the adjacent regions 816. In this manner, air is released and compressed in a single operation and trapped in a separate operation. Only these two fundamental operations take place, but as air is compressed on both sides of the compressor vanes 400, they are repeated twice in each cycle so that four total operating phases are used.

It is noted with regard to FIG. 8 that the actuation of the compressor vanes 400 as shown is advantageous to efficient operation. The second operating phase 808 and the fourth operating phase 812 serve to trap air between the compressor vane 400 surfaces so that it can be compressed in the subsequent operating phases. Adopting this technique for trapping air offers benefit as when the inner portion of the vanes are released, for example in the third operating phase 810, the expansion of the air in the compressed regions 814 serves to further close and compress the adjacent regions 816. Elastic energy stored through the bending of the compressor vanes 400 during the compression process is similarly recovered, at least partially, in a similar fashion by helping to compress air in the adjacent regions 816 and to bend the compressor vanes 400 in the opposite direction as needed in the subsequent phase.

FIG. 9 illustrates an example of a compressor biasing schematic 900. It is noted for clarity that the electrostatic compressor 206 is so-named since the compressor vanes 400 are controlled with electrostatic forces (but it will be explained later that other sources of force may also be used to control them). It is not to imply that the electrical conditions in the electrostatic compressor 206 are static and unchanging. As will be very clear, time varying waveforms are needed to control and properly drive the electrostatic compressor 206. It is also noted that, for simplicity, only positive and negative biases are referred to in the description of FIG. 9, FIG. 10*a*, and FIG. 10*b* as the actual voltage levels used may vary widely depending on the specific design under study. That is, depending on operating frequency, physical dimensions, the materials used, and other aspects of a specific design the actual voltage levels could be considerably different. Finally, standard electrical conventions are taken for positive and negative polarity bias levels (that is, the build up of positive charge leads to positive levels and negative charge to negative levels).

The compressor biasing schematic 900 is identical to the compressor operational schematic 800 of FIG. 8 except that the delayed view of the third operating phase 811 has been eliminated so that only the four actual operating phases and the rest phase 801 are shown. FIG. 9 includes the electrical biases that are applied in each operating phase to the inner conductive region 410 and outer conductive region 408 of each compressor vane 400. These biasing polarities are shown explicitly with the plus (+) and minus (−) signs on the diagrams respectively near the inner and outer portions of the compressor vanes 400. That is, the plus (+) or minus (−) sign nearest the mounting plate 300 in each of the phases represents the polarity of the bias applied to the inner conductive region 410 of that compressor vane 400. Similarly, the plus (+) or minus (−) sign furthest from the mounting plate 300 in each of the phases represents the polarity of the bias applied to the outer conductive region 408 of that compressor vane 400.

In FIG. 9, the compressor vanes 400 are also explicitly numbered so they can be more easily referred to. It is noted that the first vane 902, the second vane 904, the third vane 906, and the fourth vane 908 are respectively biased identically for each phase of operation as the fifth vane 910, the sixth vane 912, the seventh vane 914 and the eighth vane 916. That is, in this embodiment, each group of four adjacent compressor vanes 400 in the electrostatic compressor 206 forms a unique group with regard to how their biasing is sequenced and this biasing is repeated over and over again for each successive group of four compressor vanes 400 in a cyclical manner. Other embodiments that may make use of different numbers of conductive regions in the compressor vanes 400, and/or may use other of other electrical drive signals, may or may not repeat their biasing in groups of four. To avoid any confusion, note that in the five schematic end views of the electrostatic compressor 206 shown in FIG. 9, each compressor vanes 400 are the same as the views are traversed horizontally in the figure. That is, the topmost compressor vane 400 in the rest phase 801, the first operating phase 806, the second operating phase 808, the third operating phase 810, and the fourth operating phase 812 are all the first vane 902. Similarly, the second vane 904, the third vane 906, and all the subsequent vanes are the same and are ordered the same in each view. The vanes have not all been numbered in each view only to avoid clutter in FIG. 9. The mounting plate 300 and dashed lines 803 are included in FIG. 9 for reference and have the identical meaning to their meaning in FIG. 8.

The magnitudes of biasing voltages used to drive the electrostatic compressor 206 can range from very small voltages of a few millivolts or less to very large voltages such as several thousand volts or more. The size of the compressor vanes 400, the materials used, the thickness and stiffness of the vanes, the frequency of operation, the peak compressed air temperature desired, and many other factors have bearing on the voltage levels utilized.

The first vane 902 has constant positive bias on both of its conductive regions through all phases of operation and the third vane 906 has constant negative bias on both of its conductive regions through all phases of operation. The second vane 904 begins in the first operating phase 806 with negative bias on both its inner conductive region 410 and its outer conductive region 408. In the second operating phase 808 the outer conductive region 408 of the second vane 904 is shifted from negative to positive to release (the use of a positive bias may result as well in a repelling force for some embodiments, however, electrostatic repulsion is difficult to achieve due to movement of charge in conductors, hence, the term "release" instead of "repel" is used for clarity) it from the first vane 902. And in the third operating phase 810, the inner conductive region 410 of the second vane 904 is also shifted to positive bias so that the formerly compressed air between the first vane 902 and the second vane 904 is allowed to escape. This same action and biasing facilitates to trap the air between the second vane 904 and the third vane 906 and to then compress it. The outer conductive region 408 of the second vane 904 is shifted negative in the fourth operating phase 812 to begin the process of trapping air between the second vane 904 and the first vane 902. The fourth vane 908 begins with positive bias on both of its conductive regions in the first operating phase 806, the bias of its outer conductive region 408 is shifted negative in the second operating phase 808, the bias of its inner conductive region 410 is shifted negative in the third operating phase 810, and the bias of its outer conductive region 408 is shifted positive in the fourth operating phase 812.

The biasing and phasing, as illustrated in FIG. 9, are novel. Both sides of each compressor vane 400 are used so that compression in the region between two adjoining compressor vanes 400 and expansion in the regions on the other sides of those same compressor vanes 400 happen substantially at the same time. This allows energy from the expanding compressed regions 814 to facilitate compression of air in the adjacent regions 816. It is also beneficial that the first vane 902 and the third vane 906 have constant polarity throughout the operating cycle. Since this is the case, there is no need for switching or control electronics on these vanes, and hence, half of the compressor vanes 400 in the electrostatic compressor 206 have constant bias polarity, representing a reduction in system cost and complexity. It is also noted that for these vanes with constant biasing polarity, the structure shown in FIG. 4 that included an inner conductive region 410 and an outer conductive region 408 could be simplified to a single conductive region over the entire compressor vane 400. This would allow simplified manufacturing and reduced cost for half of the compressor vanes 400 in the electrostatic compressor 206. It is also important that for every operating phase and condition in FIG. 9, each compressor vane 400 benefits from electrostatic attraction to it's adjoining compressor vane 400 on one side (above or below it) and electrostatic repulsion from it's adjoining compressor vane 400 on the other side. As noted parenthetically above, electrostatic repulsion may not be substantial in most embodiments, but the biasing and phasing of the compressor vane 400 signals take benefit of what, if any, repulsive force is available.

It was noted previously that the operation and biasing for the first four compressor vanes 400 in FIG. 9 are identical for the second four compressor vanes 400. That is, the first vane 902 and the fifth vane 910 have identical biasing and can be controlled from the same biasing conductors. Only one conductor is needed to bias them as they are always biased positively in both their inner and outer conductive regions. Similarly, the second vane 904 and the sixth vane 912 are identically biased. They require two conductors for biasing, one conductor is needed for their inner conductive regions 410 and a second conductor is needed for their outer conductive regions 408. The third vane 906 and the seventh vane 914 are both always biased negative, so only one conductor is needed for them. And the fourth vane 908 and the eighth vane 916 are identically biased and require two conductors since their biasing changes over the operating phases. For the embodiment shown with two conductive regions in each compressor vane 400 and the biasing and operating phases shown in FIG. 9, no matter how many compressor vanes 400 are used in the electrostatic compressor 206, only six total conductors are needed to carry the biasing levels used to support them. Hence, the reason for showing six explicit conductors for this purpose in FIGS. 1-7*b* is now made fully clear. It is also clear that electrical connection 416 and electrical connection 418 in FIG. 4 need only connect the inner conductive region 410 and the outer conductive region 408 of each compressor vane 400 to the appropriate via 401 consistent with the biasing used for that specific compressor vane 400 based on its sequence in the construction of the electrostatic compressor 206.

It is noted incidentally that some embodiments may benefit in reducing the number of compressor vanes 400 designs that are needed by taking the benefit that some of the compressor vane 400 electrical connections could be achieved by connecting the inner conductive regions 410 and the outer conductive regions 408 to the vias 401 so that one electrical contact is made if the compressor vane 400 is assembled into the electrostatic compressor 206 one way and a different electrical connection is made if it is simply flipped over. As a simple example, the need for a compressor vane 400 with continuous positive bias on both conductor regions and the need for a compressor vane 400 with a continuous negative bias on both conductive regions could be met with a compressor vane 400 having both conductive regions tied to a single outside via and that connection could be made to either the positive or negative bias level by simply assembling the electrostatic compressor with the vanes needing a positive bias oriented with that connected via on one end of the electrostatic compressor 206 and those needing a negative bias would simply be flipped over so they are oriented with that connected via on the other end of the electrostatic compressor 206.

To avoid confusion, it is again noted that the first operating phase 806 and the third operating phase 810 are similar in that both of these operating phases serve to complete the process of trapping air and then compressing it against the thermally conductive vane spacers 500 (but these operating phases trap and compressor air on alternate sides of the compressor vanes 400). In FIGS. 8 and 9, these operating phases are drawn differently to illustrate the earlier portion of this phase in trapping air (as is shown for the third operating phase 810) and the later phase of compressing air (as is shown for the first operating phase 806). However, FIG. 9 makes it clear that the biasing is the same for these conditions. Of course, since the compressor vanes 400 trap and compress air on both of their sides, it is clear that the first operating phase 806 shows the conditions for compressing air between alternate compressor vanes 400 and the third operating phase 810 shows the conditions for compressing air between the other sides of those compressor vanes 400.

Figure 10A:
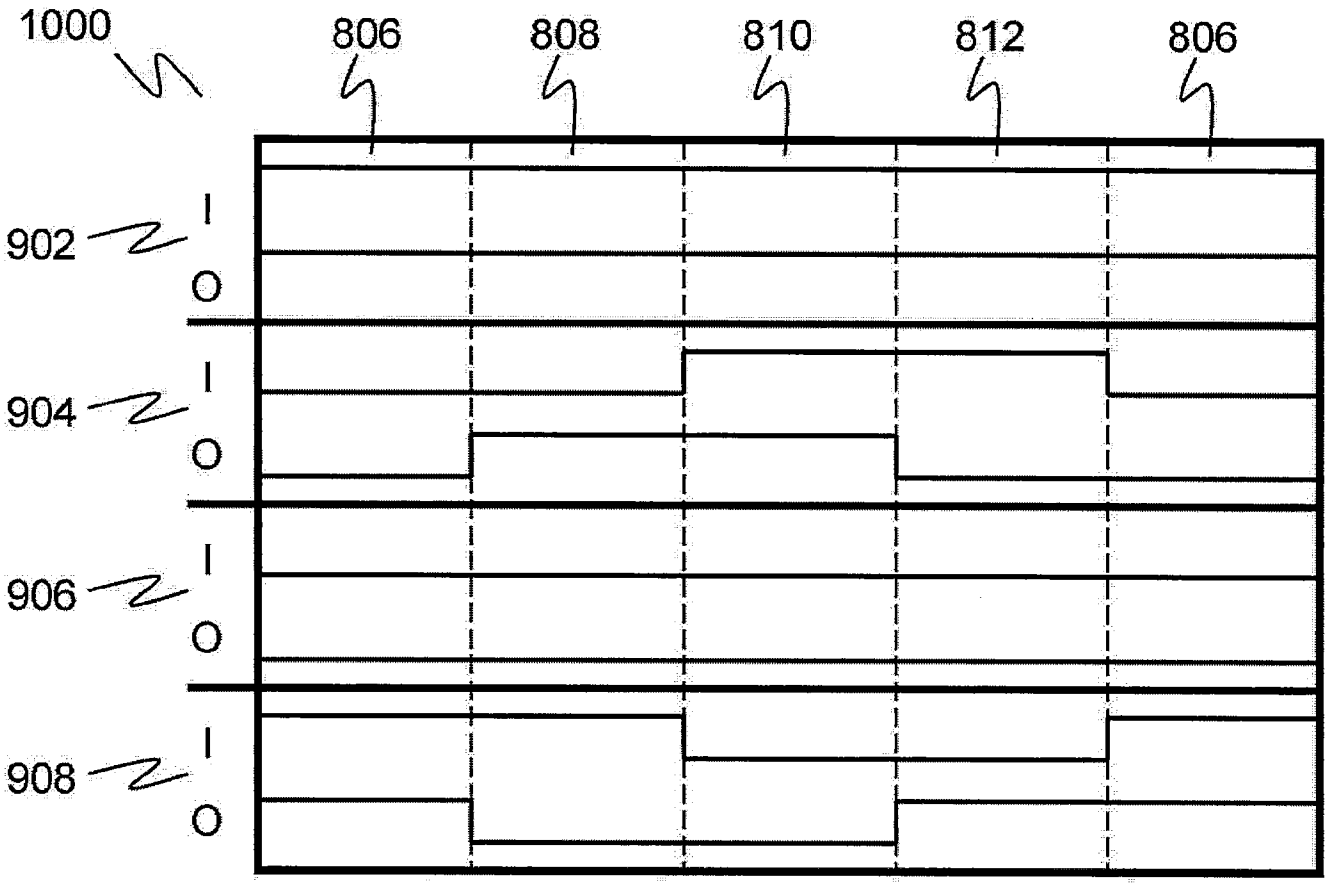
FIG. 10*a* illustrates a timing diagram explaining how the charging polarities used on the vanes of the electrostatic compressor are sequenced.

FIG. 10*a* illustrates an example of a timing diagram 1000 for the operation explained in FIG. 9. As is conventional, common practice for timing diagrams, the timing diagram 1000 in FIG. 10*a* represents time horizontally and voltage vertically, with positive polarity of voltage represented upwards and negative polarity represented downwards for each waveform shown. The timing and polarity of the bias on the first vane 902 is shown with the top two waveforms, the upper waveform marked with an "I" referring to the bias levels as a function of time for the inner conductive region 410 of the first vane 902, and the lower waveform marked with an "O" referring to the bias levels as a function of time for the outer conductive region 408 of the first vane 902. The second vane 904, the third vane 906, and the fourth vane 908 are all similarly represented in the timing diagram 1000. Horizontally across the timing diagram 1000, the first operating phase 806, the second operating phase 808, the third operating phase 810 and the fourth operating phase 812 are shown. The first operating phase 806 is shown a second time on the far right hand side of the timing diagram 1000 to make it explicitly clear that the operation is cyclic and that the phases are cycled through over and over again.

The timing and polarity of signals in the timing diagram 1000 of FIG. 10*a* is a restatement to ensure clarity of information substantially provided in FIG. 9. The first vane 902 has constant positive bias on both of its conductive regions through all phases of operation and the third vane 906 has constant negative bias on both of its conductive regions through all phases of operation. The second vane 904 begins in the first operating phase 806 with negative bias on both its inner conductive region 410 and its outer conductive region 408. In the second operating phase 808 the outer conductive region 408 of the second vane 904 is shifted from negative to positive. And in the third operating phase 810, the inner conductive region 410 of the second vane 904 is also shifted to positive bias. The outer conductive region 408 of the second vane 904 is shifted negative in the fourth operating phase 812. The fourth vane 908 begins with positive bias on both of its conductive regions in the first operating phase 806, the bias of its outer conductive region 408 is shifted negative in the second operating phase 808, the bias of its inner conductive region 410 is shifted negative in the third operating phase 810, and the bias of its outer conductive region 408 is shifted positive in the fourth operating phase 812. As already stated, once the fourth operating phase 812 is completed, the first operating phase 806 is started again.

As the efficiency of operation of the electrostatic compressor 206 is very important, a power saving opportunity is noted in FIG. 10*a*. Note that when the waveforms are shifted from one polarity to another at the transition times between the operating phases, one waveform makes a positive to negative transition and one waveform makes a negative to positive transition at each transition time. This observation can be used to advantage in the design of the drive electronics in the control module 108 shown in FIG. 1. How the energy stored in the capacitance between the compressor vanes 400 as the operating phases are sequenced can be substantially captured and utilized will be described in FIG. 15*a* and FIG. 15*b*.

In FIG. 10*a*, each of the operating phases is shown consuming equal amounts of time. However, there may be advantage to operate the electrostatic compressor 206 with different amounts of time in some phases. For example, a given design may benefit from more time for the heat from the compressed air between the compressor vanes 400 to transfer to the heat exchanger 200, it could be beneficial to extend the first operating phase 806 and the third operation phase 810 so that more of the total time of an operating cycle is dedicated to compression and heat transfer. Of course, the ideal proportion of time used in the first operation phase 806 and the third operating phase 810 may vary with many factors including the temperature of the incoming air, the temperature of the exhaust air, the temperature of the heat exchanger 200, the humidity level, the speed of airflow through the system, and other factors. For this reason the control module 108 can monitor all these factors and optimize the operating phases and the overall cyclic frequency of operation of the electrostatic compressor 206 to substantially maximize efficiency and/or other system performance metrics.

Figure 10B:
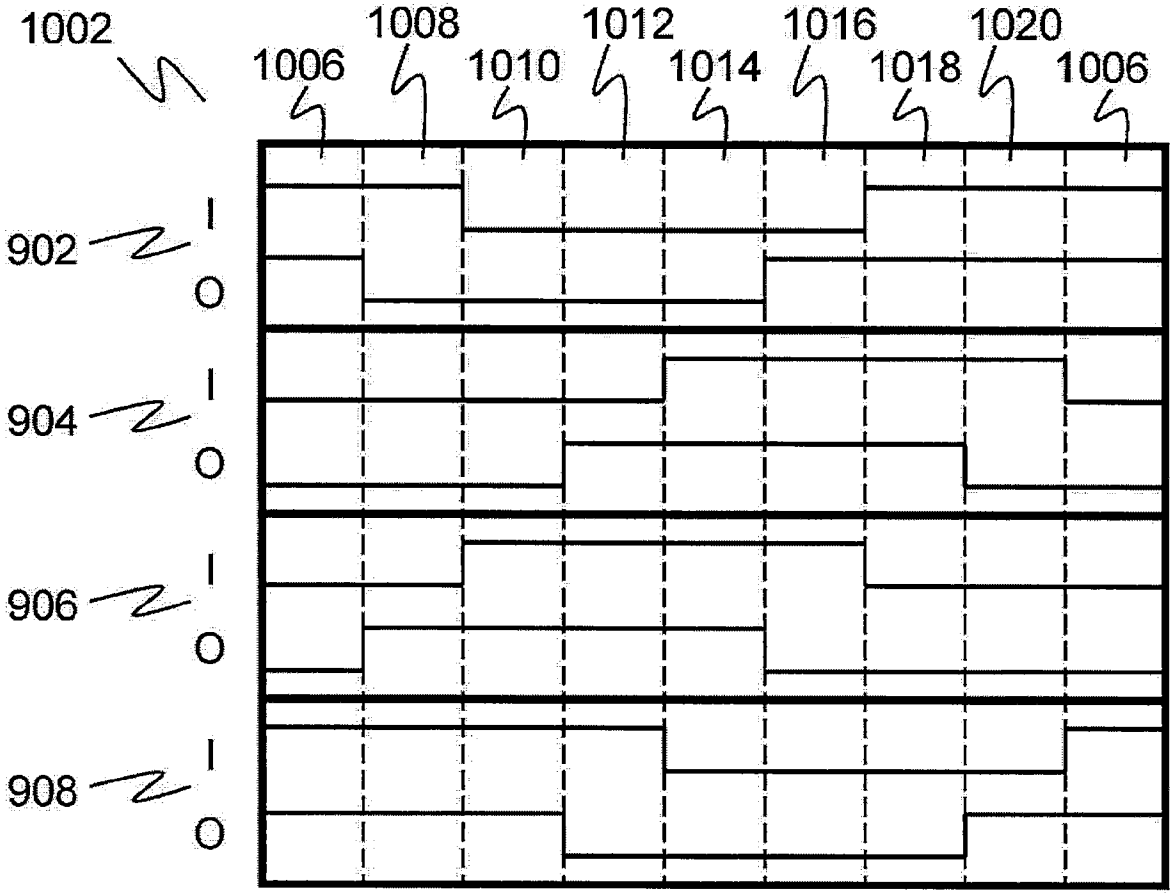
FIG. 10*b* illustrates a timing diagram showing waveforms that balance stress on vane dielectrics and reduce DC voltage exposure.

Some dielectric materials suffer wear out mechanisms if they are subjected to electric fields in the same direction for long periods of time. In FIG. 10*b*, an embodiment is shown of a timing diagram that provides substantial reduction in this DC voltage stress. Eight phase timing diagram 1002 shows eight operating phases including first operating phase 1006, second operating phase 1008, third operating phase 1010, fourth operating phase 1012, fifth operating phase 1014, sixth operating phase 1016, seventh operating phase 1018, and eighth operating phase 1020. The first operating phase 1006 is repeated on the far right of the eight phase timing diagram 1002 to make it clear that operation is cyclic through the phases and that the first operating phase 1006 begins again after the eighth operating phase 1020 ends. The signals associated with the inner and outer conductive regions for the vanes shown are in an identical format to FIG. 10*a*. And, as with FIG. 10*a*, the first vane 902, second vane 904, third vane 906, and fourth vane 908 are shown. The inner conductive region 410 of the first vane 902 begins positive in the first operating phase 1006, it goes negative in the third operating phase 1010 and positive again in the seventh operating phase 1018. The outer conductive region 408 of the first vane 902 begins positive in the first operating phase 1006, it goes negative in the second operating phase 1008 and positive again in the sixth operating phase 1016. The inner conductive region 410 of the second vane 904 begins negative in the first operating phase 1006, it goes positive in the fifth operating phase 1014 and negative again in the first operating phase 1006. The outer conductive region 408 of the second vane 904 begins negative in the first operating phase 1006, it goes positive in the fourth operating phase 1012 and negative again in the eighth operating phase 1020. The inner conductive region 410 of the third vane 906 begins negative in the first operating phase 1006, it goes positive in the third operating phase 1010 and negative again in the seventh operating phase 1018. The outer conductive region 408 of the third vane 906 begins negative in the first operating phase 1006, it goes positive in the second operating phase 1008 and negative again in the sixth operating phase 1016. The inner conductive region 410 of the fourth vane 908 begins positive in the first operating phase 1006, it goes negative in the fifth operating phase 1014 and positive again in the first operating phase 1006. The outer conductive region 408 of the fourth vane 908 begins positive in the first operating phase 1006, it goes negative in the fourth operating phase 1012 and positive again in the eighth operating phase 1020. Careful examination of the biasing polarities and timing of eight phase timing diagram 1002 reveals that the dielectric insulation between the conductive regions spend substantially equal amounts of time biased in each direction so that DC voltage stress, over time, is substantially reduced. Another way to reduce DC voltage stress is to operate the electrostatic compressor 206 using the signals shown in FIG. 10*a* for some time interval and then switch all positive polarities to negative and all negative polarities to positive and operate the electrostatic compressor for a similar interval of time with the reversed polarities. Other schemes and waveform biasing and timing are also possible that reduce DC voltage stress levels.

Figure 11A:
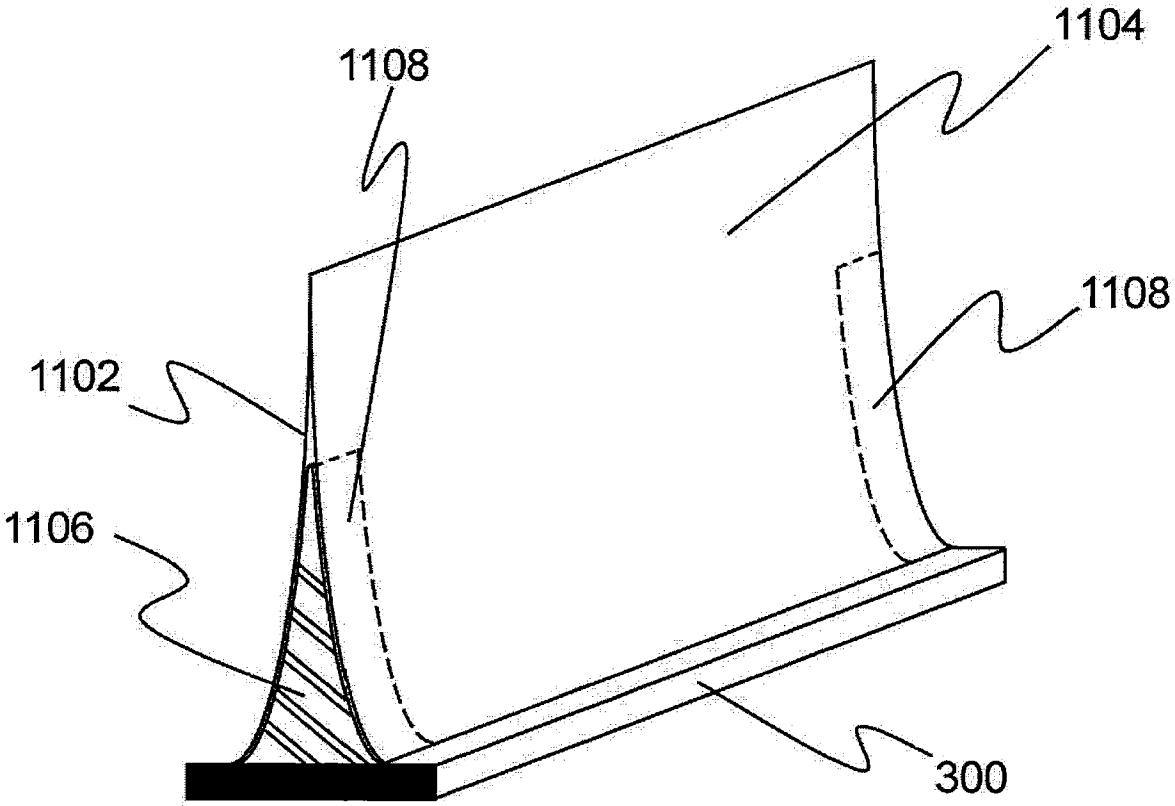
FIG. 11*a* illustrates an embodiment of a pair of compressor vanes in the compressed phase and shows the detail of how the vanes can be terminated at their ends with a fillet to minimize the escape of compressed air or other gases.

FIG. 11*a* illustrates a pair of compressor vanes 400 with fillets 1106 in the ends to stop the flow of compressed air or other gases from escaping from the ends of the compressor vanes 400. The fillets 1106 are mounted to or formed on the vane spacers 500 between each of the adjoining compressor vanes 400. The vane spacers 500 are not explicitly shown in FIG. 11*a*, but they are contained between the compressor vanes and the mounting plate 300 as previously described and the mounting plate 300 is shown to avoid any confusion. The two compressor vanes shown in FIG. 11*a*, first compressor vane 1102 and second compressor vane 1104 are shown compressed together. The region where the second compressor vane 1104 meets the fillet 1106 is shown as the outlined regions 1108. It may be beneficial to use a compliant material or some form of gasket, foam, grease, moisture, or seal in the outlined regions 1108 to facilitate a seal between the compressor vanes 400 and the fillet 1106. It is also possible to embed conductive layers in the areas of the fillets 1106 that come into contact with the compressor vanes (that is, under the outlined regions 1108) so that the first compressor vane 1102 and the second compressor vane 1104 are electro-statically forced into intimate contact with the fillet 1106 when the area between those two vanes is compressed. Of course, this may involve additional biasing and control electronics. It is noted that the conductive layer in the side of the fillet 1106 in contact with the first compressor vane 1102 would need to be biased to the same polarity as the second compressor vane 1104 in such a case. And similarly, the side of the fillet 1106 in contact with the second compressor vane 1104 would need to be biased to the same polarity as the first compressor vane 1102. Also, if positive and negative bias voltages are used to bias the compressor vanes 400 as were described in FIGS. 9, 10*a*, and 10*b*, then simply grounding the fillet 1106, that is, connecting it electrically to ground potential, will cause the compressor vanes 400 to be electrically attracted to it. It is also possible to use fillets 1106 at intervals along the length of the compressor vanes to limit longitudinal flow of air or other working fluids. That is, in addition to using fillets 1106 at the ends of the compressor vanes as shown in FIG. 11*a*, it may also be beneficial to have some spaced in the middle regions. This may be beneficial as the fillets 1106 may develop leaks at some point in the operating life of the electrostatic compressor 206 as the additional fillets 1106 could allow at least part of the region between the first compressor vane 1102 and the second compressor vane 1104 to remain sealed and substantially functional in the face of the failure of one or more of the fillets 1106 shown in FIG. 11*a*. Other techniques for sealing the ends of the compressor vanes 400 in the electrostatic compressor 206 are also possible and some of these will be described later as additional embodiments.

Figure 11B:
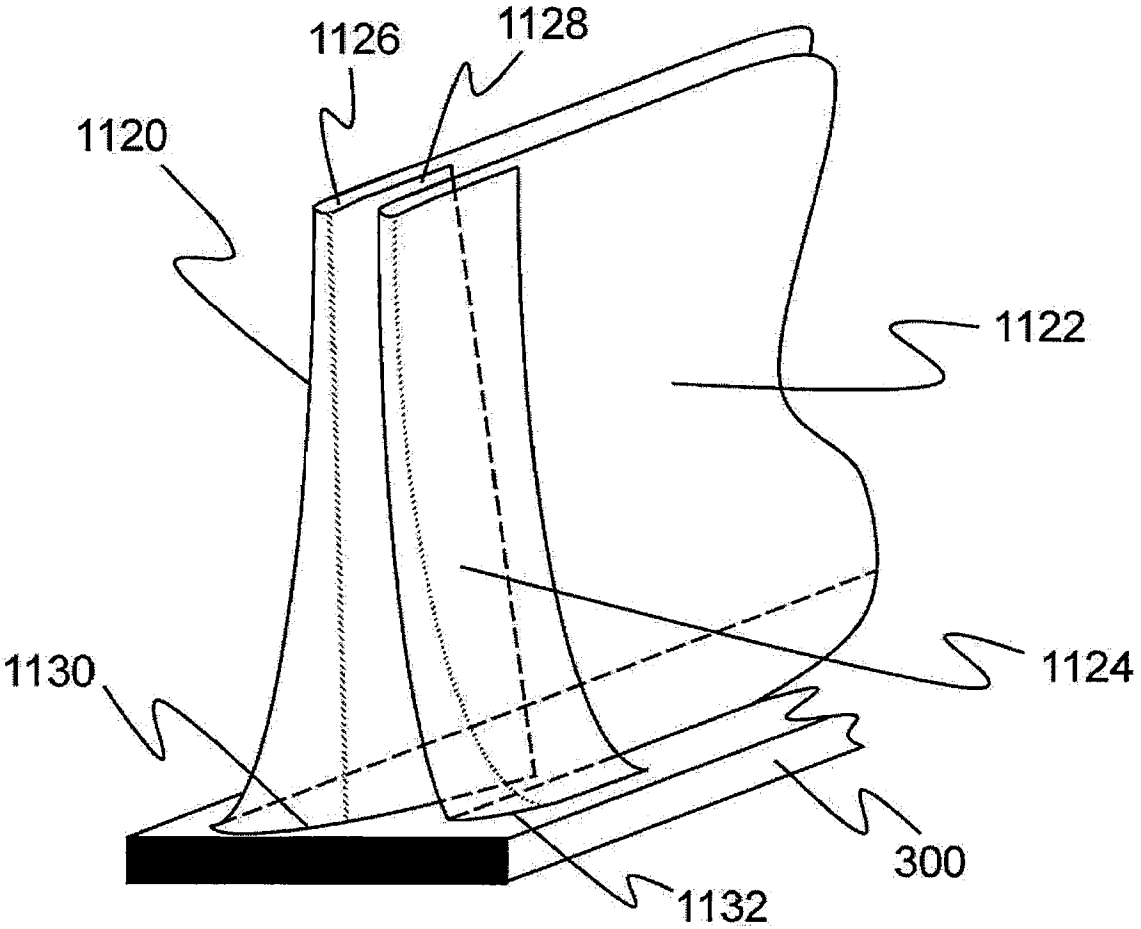
FIG. 11*b* illustrates an embodiment of a pair of compressor vanes in the compressed phase and shows how the vanes can be terminated at their ends by folding them to create an end seal.

FIG. 11*b* illustrates an alternative technique for sealing compressor vane ends in which a first vane 1120 is folded at an end and bonded to a second vane 1122 to create an overlap 1124 where the two vanes are partially or fully bonded together. In FIG. 11*b*, the first vane 1120 and the second vane 1122 are shown with a small gap 1128 between them to improve clarity of the figure. In actual operation, the two vanes would be in intimate contact in the overlap 1124 so that a seal is generated. The second vane 1122 is also folded at an end so that it can seal against the next vane adjoining to it (this vane is not shown in FIG. 11*b*) when the adjacent regions between those vanes is compressed in a subsequent phase of operation. The mounting plate 300 is shown for reference and the first vane 1120 may also be bonded, affixed, or otherwise attached to the mounting plate through part or all of first vane end seal region 1130 where the first vane 1120 is folded and where the overlap 1124 abuts the mounting plate 300. A second vane end seal region 1132 related to the second vane 1122 may also be bonded, affixed, or otherwise attached to the mounting plate 300. It is noted that the second vane end seal region 1132 has a somewhat different shape from the first vane end seal region 1130 due to the different orientation of the stress on the vanes due to their compression together. The folded opening 1126, may include some amount of adhesive, thermal grease, foam rubber, filler, glue, moisture, or other materials or features to facilitate sealing so that loss of compression is avoided between the first vane 1120 and the second vane 1122.

Figure 12A:
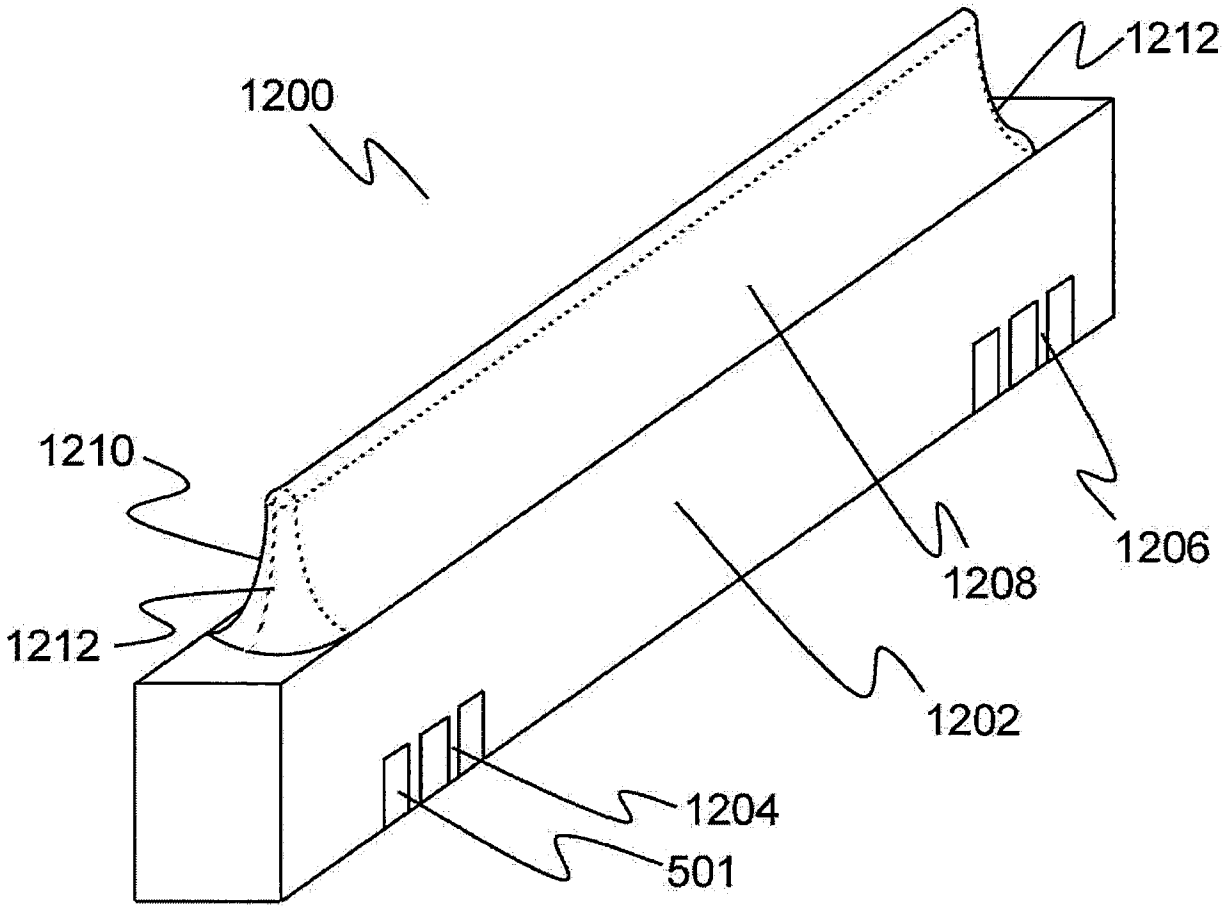
FIG. 12*a* illustrates an embodiment of an enhanced vane spacer.

A novel feature that may offer benefit in some embodiments is an enhanced vane spacer 1200 illustrated in FIG. 12*a*. As described regarding the vane spacer 500 of FIG. 5, the enhanced vane spacer 1200 is used between the compressor vanes 400 to properly space them and to facilitate conduction of the electrical bias levels needed in the electrostatic compressor 206 from one compressor vane 400 to the next. It is noted that the view of the enhanced vane spacer 1200 in FIG. 12*a* has been rotated from that shown for the vane spacer 500 in FIG. 5. This was done so that a specially shaped top surface of the enhanced vane spacer 1200 can be more fully and easily viewed in the figure. In the enhanced vane spacer 1200, a specially shaped top surface consisting of a first curved surface 1210 and a second curved surface 1208 is used to reduce the volume of space between the compressor vanes 400 when they are compressed (that is, the volume of space in the compressed region 814 shown schematically in FIG. 8). Vias 501, the first via bank 1204, and the second via bank 1206 for the enhanced vane spacer 1200 perform substantially similar functions to their equivalents in the regular vane spacer 500. Also, the enhanced vane spacer body 1202 would be composed of a similar material to those described with regard to the vane spacer body 502 of the vane spacer 500. It is noted that the enhanced vane spacer 1200 could be extended as was the extended vane spacer 604 of FIG. 6*b* to facilitate options for conducting heat to or even forming the heat exchanger 200. The enhanced vane spacer 1200 as shown in FIG. 12*a* also includes contoured ends 1212. The contoured ends 1212 are optional and an enhanced vane spacer 1200 may simply include the first curved surface 1210 and the second curved surface 1208 running all the way to the ends of the enhanced vane spacer 1200. It is noted that the shaping of the enhanced vane spacer 1200 due to the first curved surface 1210 and the second curved surface 1208 is similar to the shape of the fillets 1106 in FIG. 11*a*. While embodiments include first curved surfaces 1210 and second curved surface 1208 that are concave as shown, various embodiments may derive benefit from a wide variety of concave, convex, faceted, and many other shapes. As noted, the enhanced vane spacer 1200 may be designed to match the shape of the compressor vanes 400 when compressed to reduce the area of the compressed regions. Additionally, the enhanced vane spacer 1200 provides a greater surface area to conduct heat from the compressed regions and forms the compressed air or other gas as a thin layer over the surface of the enhanced vane spacer 1200 so that heat conduction is further enhanced. Other techniques and combinations of possible techniques are also possible, some of these are shown in the embodiments illustrated in FIGS. 16, 17*a-c*, and 18*a-c*.

The enhanced vane spacer 1200 may also benefit from texturing of the first curved surface 1210, the second curved surface 1208, and the contoured ends 1212 to further increase the surface area available for heat conduction. Use of special coatings, textures, patterns, features, fins, embedded posts, pits, and many other features may be used to enhance heat conduction. It is noted that a surface formed with the concepts of fractal geometry could provide a very high level of surface area for heat conduction. Embedding or coating the enhanced vane spacer 1200 with highly heat conductive materials such as metals, diamond, carbon nanotubes, other nanomaterials, or other special materials may also be beneficial to heat conduction.

Additionally, and as was described with regard to the end fillet 1106 of FIG. 11*a*, conductors may be embedded under the first curved surface 1210 and the second curved surface 1208 so that electrostatic attraction between the enhanced vane spacer 1200 and the compressor vanes 400 is achieved when those conductors are properly biased. It is noted further that if positive and negative bias voltages are used to bias the compressor vanes 400 as were described in FIGS. 8, 9, 10*a*, and 10*b*, then simply grounding the enhanced vane spacer 1200, that is, connecting it electrically to ground potential, will cause the compressor vanes 400 to be electrically attracted to the enhanced vane spacer 1200.

Figure 12B:
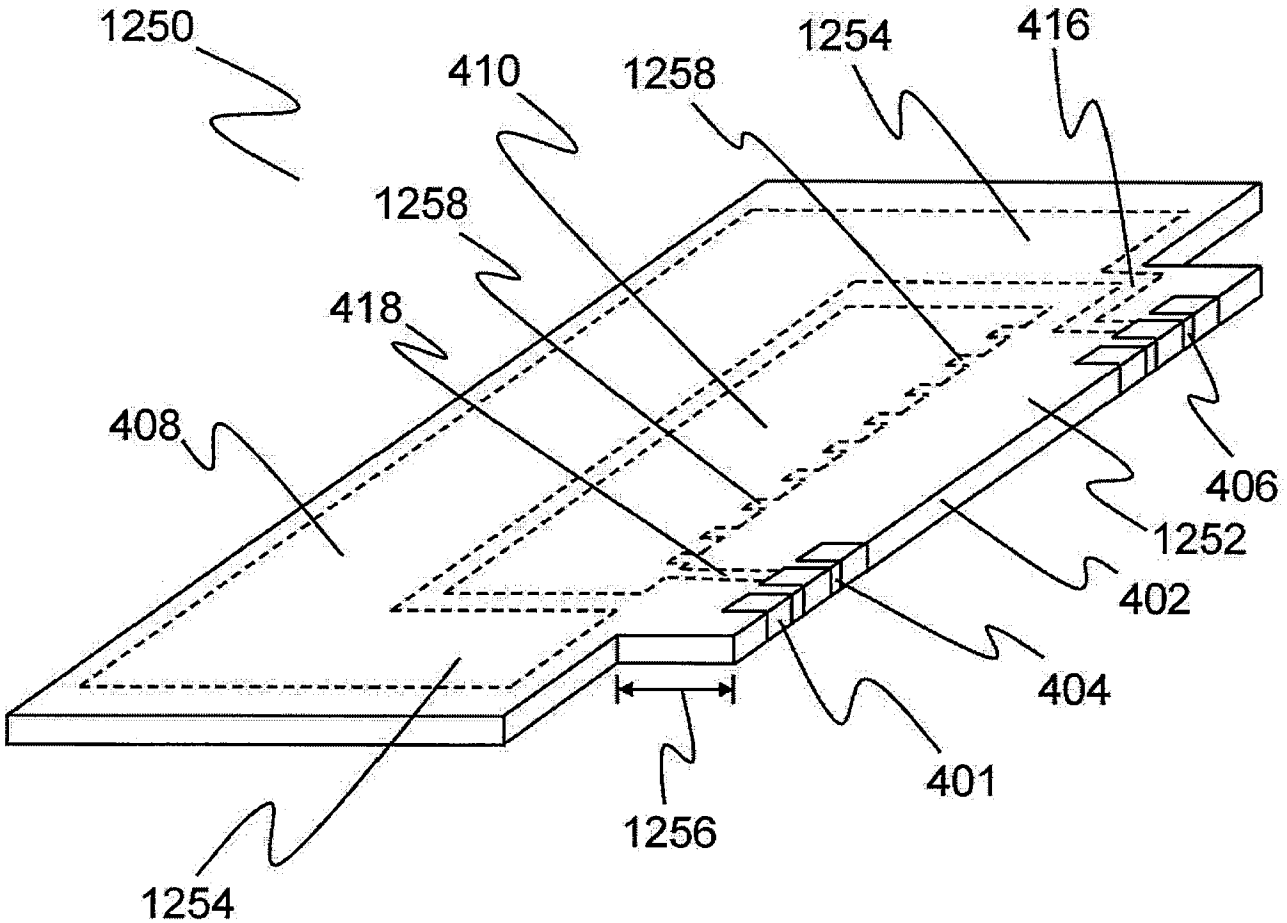
FIG. 12*b* illustrates an embodiment of an extended compressor vane that may be used with an enhanced vane spacer.

As noted previously, in FIG. 12*a*, the first curved surface 1210 and the second curved surface 1208 meet to form a contoured end 1212. The use of a contoured end 1212 is optional, but offers benefit if an extended compressor vane 1250 as shown in FIG. 12*b* is utilized. The extended compressor vane 1250 includes an offset dimension 1256 that allows flag extensions 1254 of the outer conductive region 408 to wrap around the enhanced vane spacer's 1200 contoured end 1212 when the outer conductive region 408 is biased so that it compresses against an associated adjoining vane. If the enhanced vane spacer 1200 is grounded electrically, then either a positive or negative bias potential on the extended compressor vane's 1250 outer conductive region 408 will cause the flag extensions 1254 to attract both the associated adjoining vane it is compressing against and, additionally, against the enhanced vane spacer's 1200 contoured ends 1212. In this way, the extended compressor vane 1250 creates a seal at each end of the compressed region before the inner conductive region 410 is biased for the final phase of compression. As was the case with earlier descriptions, the fixed body area 1252 of the extended compressor vane 1250 is mated to the vane body 1202 of the enhanced vane spacer 1200 in the assembly of the electrostatic compressor 206 so that it is fixed in place and does not move relative to the enhanced vanes spacer 1200 in the course of operation. The flag extensions 1254 sections of the enhance compressor vane 1250, however, are free to move and compress against each other (in adjoining pairs) and against the enhanced vane spacer's 1200 contoured end 1212 to generate a seal.

It is noted that since electrical biasing of the extended compressor vane 1250, or a regular compressor vane 400, serves to compress it against an adjoining compressor vane to create compression of air or other gases, that the voltage levels applied and the electrostatic forces realized that are beneficial for operation with regard to the adjoining compressor vane may be sub-optimal with respect to interaction with the enhanced vane spacer 1200. Simply put, the electrostatic force exerted to the enhanced vane spacer 1200 may be too weak or strong if the compressor vane 400 is designed only with compression against an adjoining compressor vane 400 in mind. The conductive region notches 1258 shown in FIG. 12*b* serve to open a degree of design freedom on this regard. That is, if the electrostatic attraction of either the outer conductive region 408 (including the flag extensions 1254) or the inner conductive region 410 to the enhanced vane spacer 1200 are too strong, this effective force can be reduced by reducing the area of the conductive regions near where the enhanced vane spacer 1200 is present during operation. Of course, many other techniques can be used to achieve similar results. Instead of the square notches 1258 shown in FIG. 12*b*, triangular, round, other shapes can be used. Similarly, electrostatic force can be reduced by increasing the thickness of the electrical insulation over the conductive regions in the vicinity of the enhanced vane spacer 1200. Using a lower dielectric constant material in these regions has a similar effect. And, of course, additional conductive regions could be introduced in the compressor vanes 400 in the vicinity of the enhanced vane spacer and these could be driven with electrical signals to provide appropriate levels of force. It is also possible to vary the driving waveforms shown in FIG. 10*a* by momentarily reducing the voltage bias levels on the conductive regions, or even momentarily grounding them, to relieve electrostatic forces on the enhanced vane spacer 1200 when and as desired. Finally, it is noted that for compressor vanes using other drive techniques such as artificial muscles, magnetic forces, piezoelectric force, or other drive techniques that means for weakening or strengthening the forces generated around the enhanced vane spacer 1200, either along its sides or contoured ends 1212, are also possible. In addition to controlling the force between the enhanced vane spacer 1200 or contoured ends 1212 and the extended compressor vane 1250, the use of notches, different electrical insulation thicknesses, and other techniques may be used to minimize physical stress on the extended compressor vanes 1250 to extend their working life.

Figure 12C:
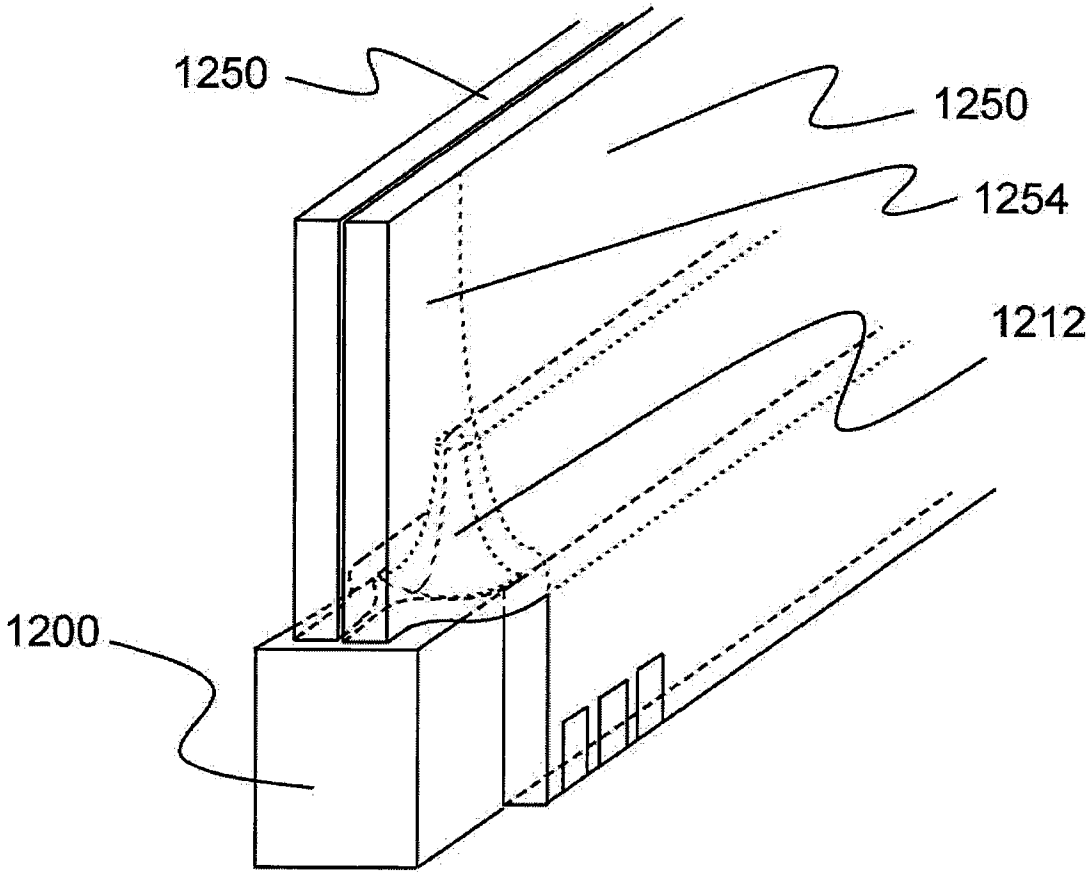
FIG. 12*c* illustrates an embodiment of how an extended compressor vane may seal in conjunction with an enhanced vane spacer.

FIG. 12*c* illustrates an example of a view of one end of an enhanced vane spacer 1200 with a contoured end 1212 and an extended compressor vane 1250 mated to either of its sides. The extended compressor vanes 1250 are shown in compression together with the outer conductive regions present along the edge of the extended compressor vane 1250 and through the flag extensions 1254 biased to compress the extended compressor vanes 1250 together creating a seal along both the outer edge and the ends of the extended compressor vanes 1250. It is noted that while the contoured end 1212 of the enhanced vane spacer 1200 shown in FIGS. 12*a* and 12*c* is formed from smooth concave surfaces, that convex surfaces, faceted surfaces, roughened or textured surfaces or other surfaces formed with coatings may also be used for various embodiments. Additionally, it is noted that use of lubricants, grease, gels, moisture, foam materials, on the enhanced vane spacer 1200 and, in particular, on the contoured end 1212 and/or the flag extensions 1254 of the extended compressor vane 1250 may be beneficial in forming a reliable seal for compression and may also serve to extend the operating lifetime of the system. In particular, small amounts of moisture collecting around the contoured end 1212 and other areas where the extended compressor vanes 1250 and the enhanced vane spacer 1200 seal together may be beneficial. In such a design, it may be beneficial to use specially designed surfaces to allow moisture to form smooth layers in some areas (hydrophilic) and bead in others (hydrophobic). For example, making the contoured end 1212 hydrophobic and the other sealing surfaces hydrophilic may be beneficial in concentrating condensed moisture and maintaining it where it may be most beneficial to creating a reliable seal.

Figure 13:
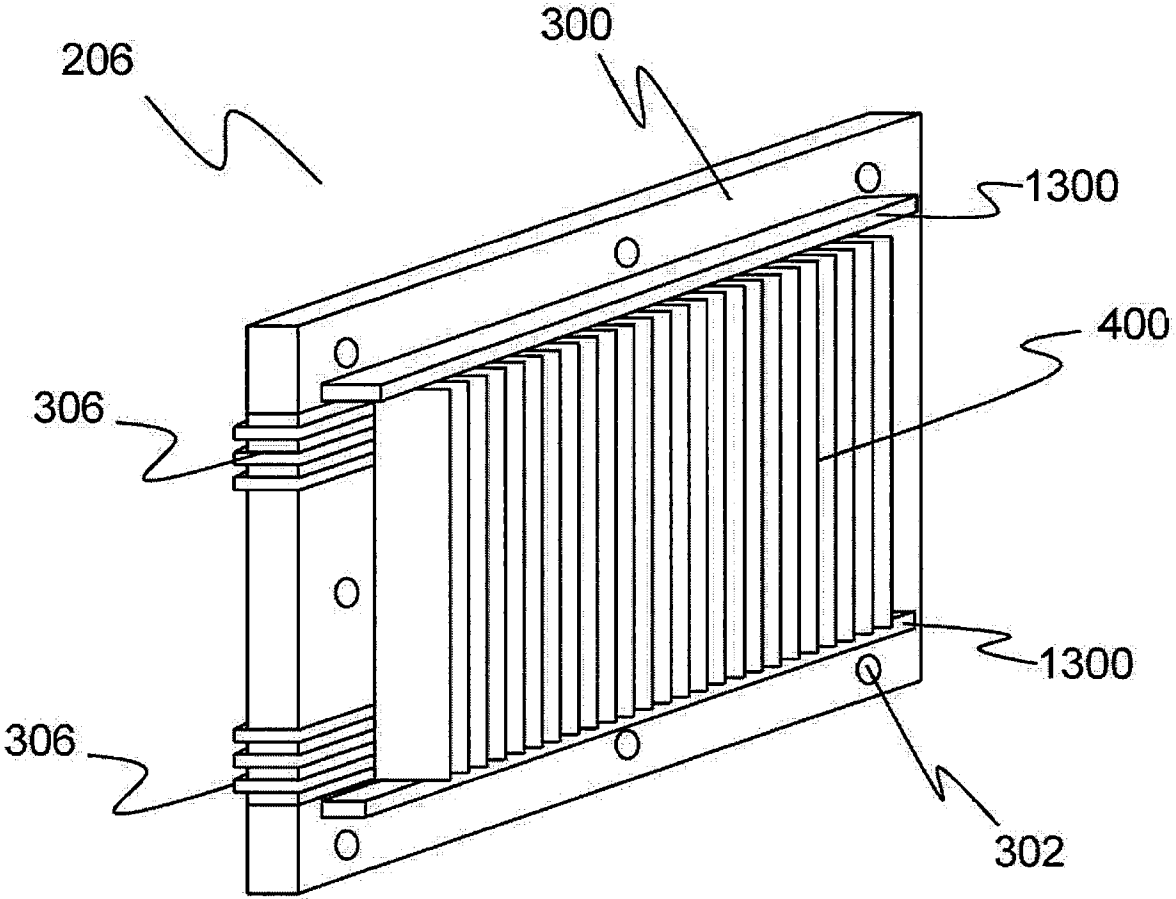
FIG. 13 illustrates an embodiment of an electrostatic compressor with features to minimize compressed air leakage from the ends of the vanes.

There are also other techniques for sealing the ends of the compressor vanes 400 to avoid loss of compressed air. One example of these techniques is illustrated in FIG. 13. FIG. 13 shows the electrostatic compressor 206 of FIG. 3 with air seals 1300 along the top and bottom ends of the compressor vanes 400. The air seals 1300 are fixed structures that the compressor vanes 400 "sweep" across so that air leaking from the ends of the compressor vanes 400 is reduced. The air seals 1300 may be in contact with the compressor vanes 400 or may be spaced slightly apart from them. The air seals 1300 may be made from metals, plastics, ceramics, or other materials and they may be attached to the mounting plate 300 with adhesive, glue, welding, screws, mechanical fasteners, or other methods. It is also noted that the air seals 1300 of FIG. 13 could be used with or without the fillets 1106 shown in FIG. 11*a*, the folded ends shown in FIG. 11*b*, the extended compressor vanes 1250 of FIG. 12*b*, or any other techniques for sealing the ends of the compressor vanes 400. It is also possible to implement the air seals 1300 from materials or configurations of materials that expand in the presence of heat or air pressure so that they press against the vanes beneficially and serve to generate a more robust seal. The air seals 1300 could also be mounted on actuators so that they may be physically pressed against the vanes when end seals are needed.

One embodiment of this invention was for an implementation with compressor vanes 400 having two conductive regions. However, it is also possible to build an electrostatic compressor with a single conductive region in each vane. FIG. 14 illustrates an example of a schematic diagram explaining the operation in such an embodiment. As with FIG. 9, FIG. 14 shows a rest phase 1401 along with two operating phases. Eight compressor vanes 400 are shown starting with the first vane 1402 and subsequently, the second vane 1404, the third vane 1406, the fourth vane 1408, the fifth vane 1410, the sixth vane 1412, the seventh vane 1414, and the eighth vane 1416 are all shown. In this embodiment, only two operating phases, a first operating phase 1420 and a second operating phase 1422 are used and the electrostatic compressor 206 operates by cycling between them back and forth. The dashed lines 1403 indicate that in some implementations, many more vanes would be included in the full construction of the electrostatic compressor 206. Note the plus (+) and minus (−) signs in FIG. 14 next to the compressor vanes 400 in the schematics for the first operating phase 1420 and second operating phase 1422. As was the case in FIG. 9, these plus (+) and minus (−) signs indicate the polarity of the electrical signals driving the compressor vanes 400 in each operating phase. Note that the first vane 1402 and the fifth vane 1410 have constant positive bias and the third vane 1406 and the seventh vane 1414 have constant negative bias polarity. The second vane 1404 and the sixth vane 1412 have negative bias in the first operating phase 1420 and positive bias in the second operating phase 1422. The fourth vane 1408 and the eighth vane 1416 have positive bias in the first operating phase 1420 and negative bias in the second operating phase 1422. Note also that, as for the embodiment as described in FIG. 9 and as illustrated in FIG. 14, each group of four subsequent compressor vanes 400 are biased substantially identically over time. As was the case for the driving scheme shown in FIG. 9, the driving scheme shown here in FIG. 14 can also benefit from the fact that in each operating phase transition, a substantially equal number of compressor vanes change polarity from positive to negative bias as from negative to positive bias. Techniques for conserving operating power based on this fact will be explained with regard to FIGS. 15*a* and 15*b*. While it is presently believed that the implementation of the electrostatic compressor in the embodiment of FIG. 9 will offer improved efficiency, the embodiment of FIG. 14 is shown here as it offers simplified construction. Of course, many of the enhancements and improvements discussed with respect to the embodiment of FIG. 9 may also be applied to the embodiment of FIG. 14.

Figure 15A:
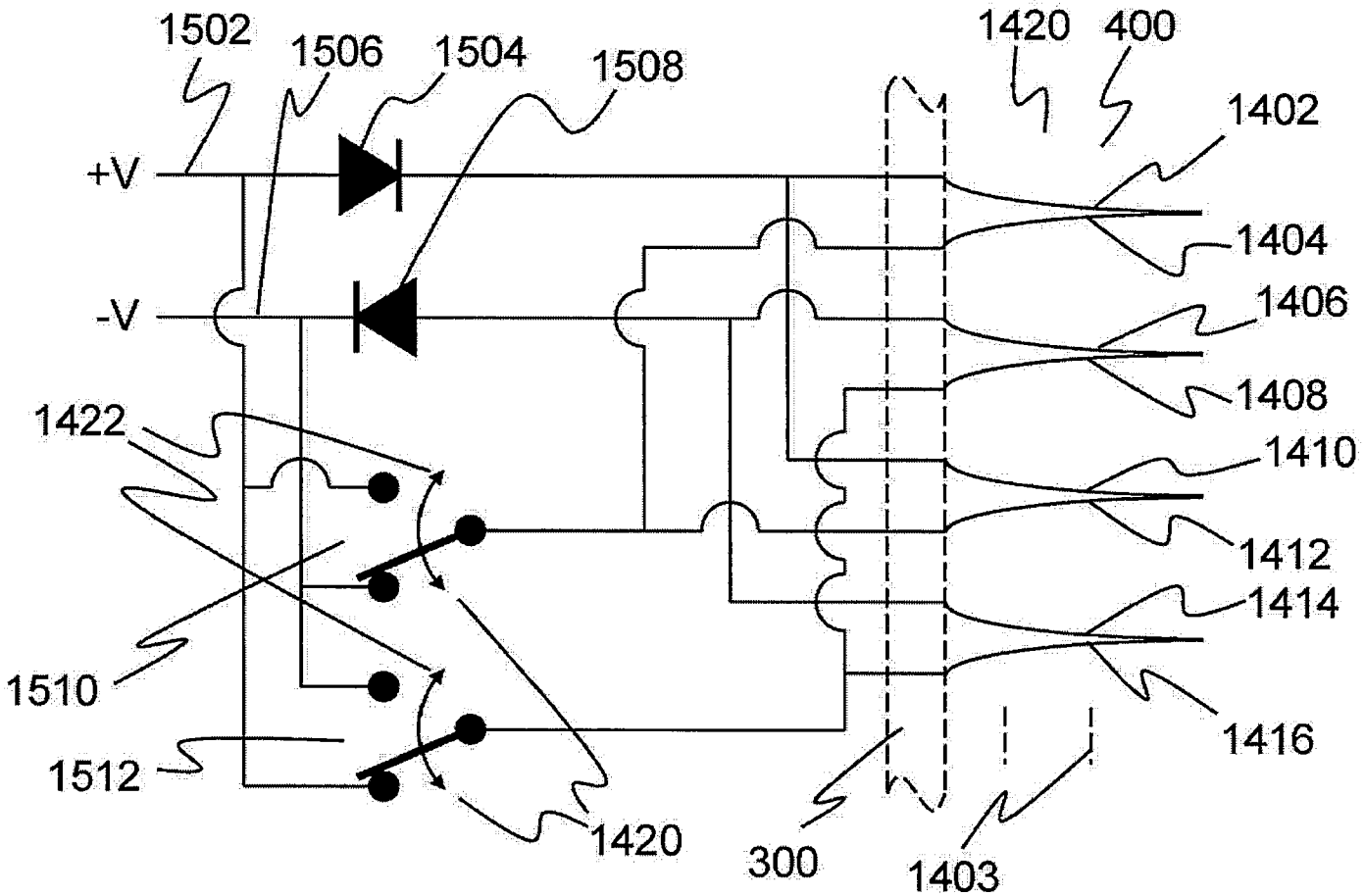
FIG. 15*a* illustrates an electrical schematic of a circuit that reduces power consumption by conserving and reusing charge.

Several embodiments have been explained that allow power to be conserved with electrical signals applied to an electrostatic compressor 206. Another embodiment uses a strategy of conserving electrically biased charge and transferring it from one compressor vane 400 to another in the course of operation. Since energy is stored on capacitors as electrically biased charge, this technique allows energy stored in the capacitance arising between pairs of compressor vanes to be transferred and used between other pairs of compressor vanes so that it benefits operation of the electrostatic compressor 206. FIG. 15*a* provides an electrical schematic illustration for such an embodiment. In particular, the schematic in FIG. 15*a* illustrates an example of how a charge conserving circuit can be used to drive the electrostatic compressor with compressor vanes with a single conductive region that is shown schematically in FIG. 14. The mounting plate 300 is shown as a dashed outline in FIG. 15*a* for clarity. The eight compressor vanes 400 are shown starting with the first vane 1402 and subsequently, the second vane 1404, the third vane 1406, the fourth vane 1408, the fifth vane 1410, the sixth vane 1412, the seventh vane 1414, and the eighth vane 1416 and all are identical to the eight compressor vanes 400 of FIG. 14 and are identically numbered. Of course, additional compressor vanes 400 are indicated by the dashed lines 1403 as practical implementations of this embodiment may have additional vanes. For simplicity, the compressor vanes 400 of FIG. 15*a* are shown in the first operating phase 1420 described in FIG. 14. The switch conditions for the first switch 1510 and the second switch 1512 as shown in FIG. 15*a* are also consistent with the first operating phase 1420. As was described for FIG. 14, the vanes will cycle back and forth in operation between the first operating phase 1420 and the second operating phase 1422. Note that in the first operating phase 1420, the first switch 1510 connects the second vane 1404 and the sixth vane 1412 to the negative power supply 1506. And, in the first operating phase 1420, the second switch 1512 connects the fourth vane 1408 and the eighth vane 1416 to positive power supply 1502. It is noted incidentally that positive power supply 1502 is also designated in FIG. 15*a* with a V+ symbol to indicate a positive polarity and negative power supply 1506 is designed with a V− symbol to indicate a negative polarity. These symbols are included for clarity. Note that plus (+) and minus (−) signs were used in FIG. 14 to indicate the presence of positive and negative charge, but in FIG. 15*a*, the V+ and V− symbols are used to indicate that positive and negative supply voltages are present (that is, they indicate voltage supplies, not just charge polarity, so different symbols were chosen for clarity). The first vane 1402 and the fifth vane 1410 are biased from the cathode of a first diode 1504 with its anode connected to the positive power supply 1502. The third vane 1406 and the seventh vane 1414 are biased from the anode of a second diode 1508 with its cathode connected to the negative power supply 1506. The first switch 1510 and the second switch 1512 are shown in FIG. 15*a* connected in the first operating phase 1420. These switches operate together and move together at the same time back and forth between the operating phases. The first operating phase 1420 and the second operating phase 1422 are shown on the switches and indicate the switch position associated with each phase. In the second operating phase 1422, the first switch 1510 connects the second vane 1404 and the sixth vane 1412 to the positive power supply 1502. And, in the second operating phase 1422, the second switch 1512 connects the fourth vane 1408 and the eighth vane 1416 to the negative power supply 1506.

A benefit of the circuit shown in FIG. 15*a* can be understood by considering the transition from the first operating phase 1420 to the second operating phase 1422 and, as an example, the conditions of the fourth vane 1408, the fifth vane 1410 and the sixth vane 1412 through this phase transition. Note that in the first operating phase 1420, the fifth vane 1410 and the sixth vane 1412 are compressed together. Since they are compressed, the capacitance between them is substantial and they store substantial charge. Alternately, the capacitance between the fourth vane 1408 and the fifth vane 1410 is less significant since these vanes are separated in the first operating phase 1420. With the transition to the second operating phase 1422, the sixth vane 1412 moves from being connected to the negative power supply 1506 voltage to being connected to the positive power supply 1502 voltage. The substantial charge stored on the capacitance between the fifth vane 1410 and the sixth vane 1412 is such that the potential of the fifth vane 1410 is elevated during this phase transition and, due to the action of first diode 1504, the potential of the fifth vane 1410 can rise substantially above the positive power supply 1502 in this process. Thereby, the charge between the fifth vane 1410 and the sixth vane 1412 is substantially conserved during the phase transition. Now, once the second operating phase 1422 is established, the fourth vane 1408 and the fifth vane 1410 are attracted to each other and compress together. As this occurs, the positively biased charge stored on the fifth vane 1410 is used to charge the resulting capacitance between the fourth vane 1408 and the fifth vane 1410. In this way, the energy associated with the positively biased charge that was stored when the potential of the fifth vane 1410 rose above the positive power supply 1502 due to the presence of the first diode 1504 was substantially conserved and re-used.

Some embodiments of FIG. 15*a* may benefit from the addition of a capacitor or multiple capacitors with their respective terminals tied to the cathode of first diode 1504 and the anode of second diode 1508. These capacitors could also be implemented as a first capacitor (or capacitors) tied to the cathode of the first diode 1504 and with its other terminal at ground (or another constant potential) and a second capacitor (or capacitors) tied to the anode of the second diode 1508 and with its other terminal at ground (or another constant potential). In either embodiment, these additional capacitors serve to relax the voltage across the compressor vanes 400 that are compressed together before the phase transition begins so that the compressed vanes can more easily release in the course of the phase transition and allow the compressed gas between them to escape. Some embodiments may have sufficient capacitance already present due to the capacitance of the first diode 1504, the second diode 1508, the capacitance of the vanes, and other sources so that these additional capacitors are not needed. For this reason, the embodiment of FIG. 15*a* is presented without these capacitors explicitly present.

Careful examination of the capacitances, stored charge, and phase transitions of the compressor vanes 400 in FIG. 15*a* reveals that similar conditions to those described for the fourth vane 1408, the fifth vane 1410 and the sixth vane 1412 in the paragraphs above exist for other vanes as well. That is, positively or negatively biased charge is substantially stored, conserved, and re-used. This beneficial action reduces power consumption. It is further noted that the charge stored between the uncompressed vane pairs is also partially conserved in the operation of this circuit. And it is noted that this circuit also allows energy from the elastically flexed compressor vanes 400 and the expanding air pressing on the compressor vanes 400 during phase transitions to generate and store electrical energy and re-use it subsequently.

It is noted that other implementations of the circuit of FIG. 15*a* are also possible. For example, instead of using the first diode 1504 and the second diode 1508 to bias the vanes, it would be equally possible to use a power supply that allows its output voltage to exceed its regular absolute value without transferring charge (so that the charge is conserved as it is in FIG. 15*a* due to the diodes). Such a power supply is easily constructed and many switched-mode and linear power supplies are capable of or can be modified to provide such operation. Providing power to the first switch 1510 and the second switch 1512 through such a power supply is also possible, but it is noted that separate power supplies would be needed to replace the first diode 1504 and the second diode 1508 versus those used to supply the switches. Instead of using simple switches, the circuit can also benefit from more complex waveforms used to drive the compressor vanes. For example, a waveform that rapidly changes polarity to quickly drive the compressed vanes apart, but then ramps slowly to its final value so that energy can be collected from the expansion of the compressed air may be beneficial in some designs. It is clear that, if such a waveform is used, the conservation of charge explained in FIG. 15*a* can still be maintained. And, of course, the implementation using first switch 1510 and the second switch 1512 was shown for simplicity as is customary in explanations of electrical systems. In an actual system, these functions would be implemented with relays, contactors, semiconductor switches, transistors, multiplexers, or other techniques and would be controlled electronically with a control module 108 such as the one illustrated in FIG. 1.

Figure 15B:
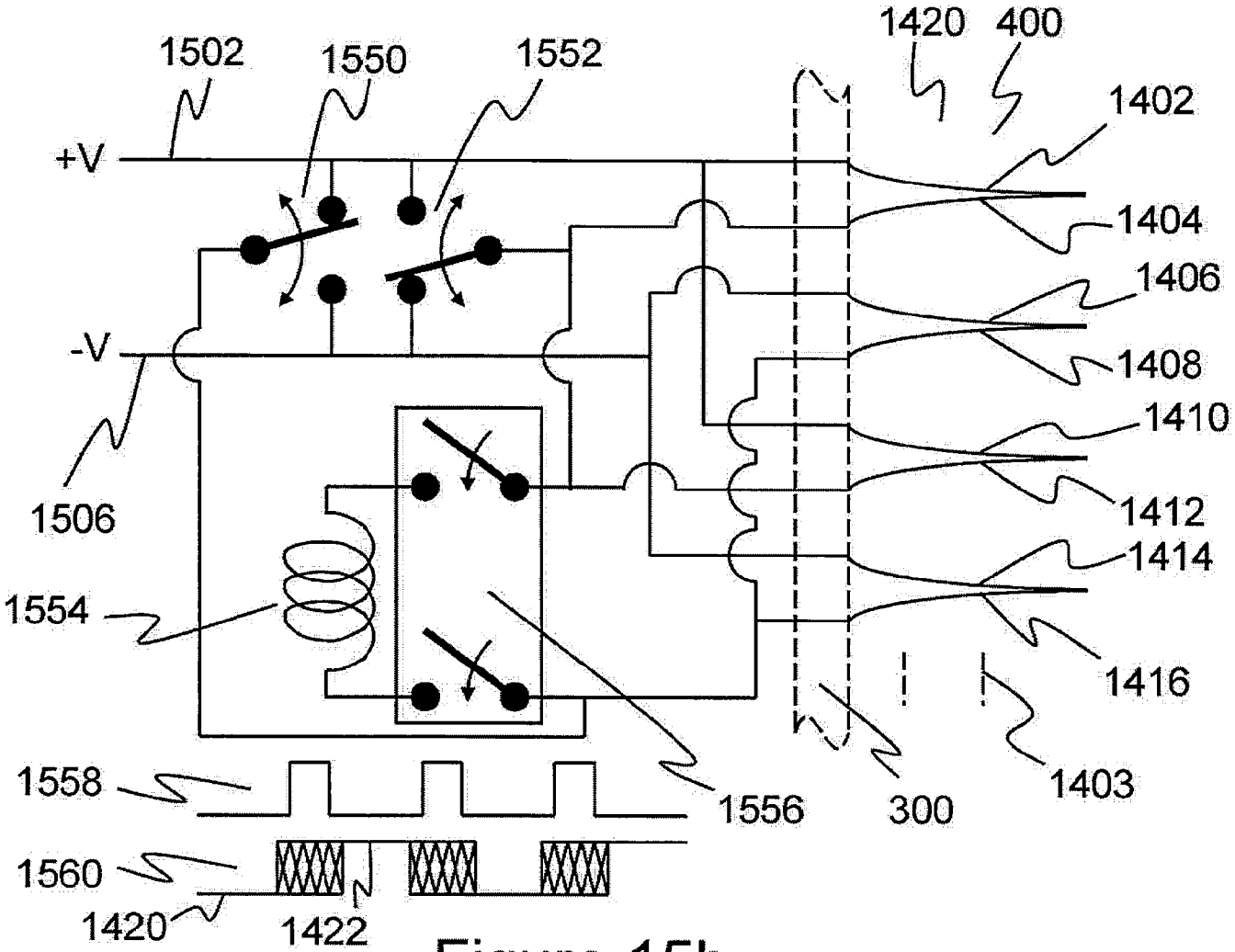
FIG. 15*b* illustrates an electrical schematic of a circuit that reduces power consumption by converting stored electrostatic energy into magnetic energy and then re-using that energy.

FIG. 15*b* illustrates an example of another embodiment of a circuit that conserves and re-uses energy stored between pairs of compressor vanes. In FIG. 15*b*, the mounting plate 300 and the compressor vanes 400 including the first vane 1402, the second vane 1404, the third vane 1406, the fourth vane 1408, the fifth vane 1410, the sixth vane 1412, the seventh vane 1414, and the eighth vane 1416 are identical to those in FIG. 14 and in FIG. 15*a*. The positive supply voltage 1502 and the negative supply voltage 1506 are also identical to those in FIG. 15*a*. Additionally, the circuit is also shown in the first operating phase 1420 with the switch positions as shown and the dashed lines 1403 indicate a plurality of vanes may be present in practical implementations. The circuit of FIG. 15*b* conserves and reuses energy by converting the energy stored in the capacitance between the vanes at the end of each operating phase into current in inductor 1554 and then re-applying that energy to charge the vanes to the opposite polarity. This is achieved by momentarily closing gang switch 1556, which shorts the positively and negatively biased vanes that are to switch polarity in the next phase transition through inductor 1554. The second vane 1404 and the sixth vane 1412 are tied to one side of the gang switch 1556 while the fourth vane 1408 and the eighth vane 1416 are tied to the other side of the gang switch 1556. When the gang switch 1556 is turned on, the two sides of the gang switch 1556 and the vanes tied to them are shorted together through the inductor 1554. For additional clarity, gang switch control waveform 1558 shows a positive pulse for the condition in which the gang switch 1556 is turned on connecting inductor 1554 to the vanes. First switch 1550 and second switch 1552 operate together as a cross switch for the vanes tied to them. In the first operating phase 1420, the second vane 1404 and the sixth vane 1412 connected to the second switch 1552 are connected to the negative supply voltage 1506 while the fourth vane 1408 and the eighth vane 1416 connected to the first switch 1550 are connected to the positive supply voltage 1502. In the second operating phase 1422, the vanes connected to second switch 1552 are connected to the positive supply 1502 and those vanes connected to the first switch 1550 are connected to the negative supply 1506. However, the first switch 1550 and the second switch 1552 are also capable to operate in a high impedance state in which the vanes connected to both switches are connected to neither power supply and the switches simply present a high impedance to the vanes tied to them. The cross switch control waveform 1560 shows how the first switch 1550 and the second switch 1552 are controlled and indicates a low level for the first operating phase 1420 and a high level for the second operating phase 1422. The cross switch control waveform 1560 also shows the timing of the high impedance condition for the first switch 1550 and the second switch 1552 as the cross-hatched regions (this high impedance condition is sometimes referred to in electronics as a "tri-state" condition). It is noted that the first switch 1550 and the second switch 1552 are kept in the high impedance or tri-state condition whenever the gang switch 1556 is pulsed on and the inductor is connected to the vanes. It is further noted that the state of the cross switch control waveform 1560 indicates that the first switch 1550 and the second switch 1552 operate to connect the vanes alternatively in the first operating phase 1420 and the second operating phase 1422 on an alternating basis each time the gang switch 1556 is pulsed on. In effect, when the gang switch 1556 is pulsed on, the capacitance of the vanes operate in conjunction with the inductor 1554 so that the stored charge is discharged through the inductor 1554 and converted from electrostatic energy to magnetic energy stored in the magnetic field of the inductor 1554. As the current in the inductor 1554 increases, it builds to a peak value and then, as it continues to flow, it begins to charge the capacitance of the vanes to the opposite polarity. Disregarding circuit losses, the inductor, if the gang switch is kept pulsed on for substantially the ideal length of time, will invert the phase of the vanes as needed to move the compressor from the first operating phase 1420 to the second operating phase 1422. However, due to electrical losses that occur in practical circuits, the first switch 1550 and the second switch 1552 operate to complete the charging of the vanes so that the full voltage is restored on each vane in each of the operating phases. The specific phases and operation of the electrostatic compressor 206 implemented with compressor vanes 400 having a single conductive region was described in detail with regard to FIG. 14. And it was noted in that description that on each phase transition that a substantially identical number of compressor vanes 400 were moved from a positive to a negative bias voltage as the number moved from a negative to a positive bias voltage. Now that FIG. 15*b* has been described, it is clear that with use of the inductor 1554 and the switches operated as described, that the energy stored in the capacitance of the compressor vanes 400 before each phase transition can be substantially recovered and applied to drive the compressor vanes 400 as needed to achieve the needed phase transition.

The size of the inductor 1554 and the duration time that the gang switch 1556 is pulsed on is tuned appropriately for the amount of capacitance present in the vanes, the operating frequency, and possibly other considerations. The procedure for this is very simple and can be easily determined from basic LC circuit analysis, so it will not be presented here. In the case that the compressor operates at higher or lower voltages in some conditions, or if fewer or more vanes are used in certain operating conditions, variable timing functions for the gang switch control waveform 1558 or variable inductor 1554 sizes may be needed to maintain acceptable operation. Other configurations employing an inductor are also possible. For example, it is possible to use a configuration commonly referred to as a DC-to-DC converter. In such a configuration, an inductor would be energized from charge stored between a first group of vanes and would then be switched away from the vanes charging it and would be discharged into a second group of vanes. This cycle could be repeated multiple times to consume energy stored in the first group and transfer it to the second group, charging the second group to the desired voltage and polarity in the process. DC-to-DC converter technology is widely used in power supply design, but the use of it in an electrostatic compressor 206 is believed to be novel.

FIGS. 15*a* and 15*b* illustrated examples of compressor vanes 400 with a single conductive region. However, similar electrical implementations that conserve energy are also possible for implementations with multiple conductive regions. For example, in the embodiment of FIG. 9, an implementation with two conductive regions was shown. By simply duplicating the circuit of FIG. 15*a* or 15*b* and properly connecting the first such circuit to the inner conductive regions 410 and the second such circuit to the outer conductive regions 408 of the embodiment of FIG. 9, similar energy conservation can be achieved. And clearly, this approach can be extended to any number of conductive regions. Of course, other implementations of circuits that conserve energy are also possible.

Other enhancements to the waveforms used to drive the compressor vanes 400 are also possible. In FIGS. 10*a* and 10*b*, rectangular waveforms are used that provide constant voltage bias to the compressor vanes throughout each operating phase. However, it is clear that as the compressor vanes 400 come into contact with each other the electrostatic force increases dramatically due to the closer proximity of the vanes. At the same time, the capacitance between the vanes is increasing. Since the charge delivered to the compressor vane 400 on each cycle is linearly related to the total current needed to drive the vanes, it may be beneficial to reduce the voltage applied during the course of some operating phases to minimize the charge applied to the compressor vanes 400 and reduce overall power consumption. This would mean that the waveforms in FIGS. 10*a* and 10*b* would no longer be purely rectangular, but may become trapezoidal or even curved to optimize the total amount of charge delivered to each vane in each operating phase to the lowest level possible while still achieving suitable compressor vane 400 actuation.

It is also possible to overlay high frequency signals on the waveforms used to drive the compressor vanes 400. In particular, as the region between the vanes being compressed becomes a cavity, it is possible to create a resonance and tune a high frequency drive signal so that vibration of the compressor vanes 400 can be achieved at a substantially similar frequency to the resonant frequency of the cavity formed between adjoining compressor vanes 400. As the compressor vanes 400 are drawn together, this resonant frequency will change as the size of the cavity changes, so the drive frequency of this overlaying waveform will also change in time. This overlay waveform would be of substantially smaller amplitude than the original waveforms used so that the polarity of the drive signals and overall action of the compressor vanes 400 would remain substantially unchanged. The addition of the overlay waveform may help to circulate and mix the air between the compressor vanes 400 in order to help facilitate heat transfer to the vane spacers 500 or to produce other desirable effects. It is noted that while an overlay waveform frequency near the resonant frequency of the cavity formed between the compressor vanes 400 is desirable, using other frequencies is also possible. It is also noted that some benefit in compression of the air and transferring heat may be achieved due to electrical effects from the electric fields between the compressor vanes 400 (some recent research in electrohydrodynamics has shown some benefit due to electrical effects on cooling systems).

FIG. 16 illustrates an example of a view of an electrostatic compressor with single conductive regions 1606, convex enhanced vane spacers 1608, and enhanced compressor vanes 1602. The convex enhanced vane spacers 1608 include a relief shape 1610 and have a convex contour 1612. Enhanced compressor vanes 1602 are used that are responsive to electrostatic forces through their conductive regions 1606 and are also responsive to the elevated temperatures generated in the compression process. It is noted that the conductive regions 1606 may not extend the full width of the enhanced compressor vanes 1602 (the reader is reminded that the length, width, and thickness dimensions of a compressor vane were defined with reference to FIG. 7*a*). Such an embodiment is shown in FIG. 16. Also, the electrical connections to the conductive regions 1606 are not shown specifically in FIG. 16, as they are made in regions of the system not shown in the view of FIG. 16 and the method for making such connections has already been well established (as shown in FIG. 4). One of the enhanced compressor vanes 1602 has a center line 1604 drawn for reference. Other features in FIG. 16 include a heat exchanger 200, vane spacer adhesive 1616 and heat exchanger adhesive 1614. Vane spacer adhesive 1616 and heat exchanger adhesive 1614 are shown for completeness. They may not be present in all embodiments and, when present, may consist of gaskets, adhesives, thermal compounds, thermal grease, solder, or other materials.

The relief shape 1610 and the convex contour 1612 of the convex enhanced vane spacer 1608 are designed to create a thin substantially uniform layer of air over the convex enhanced vane spacer 1608 surface when the enhanced compressor vane 1602 is fully compressed. The enhanced compressor vane 1602 is composed entirely or partially from materials that change their shape or dimension with temperature. Here, such materials will be referred to as thermally responsive materials. Materials such as metals, ceramics, polymers, thermally responsive artificial muscles, shape memory metals, shape memory polymers, shape memory alloys, alloys of nickel and titanium, polymer muscles, and other materials are possible for thermally responsive materials. In the particular embodiment of FIG. 16, the enhanced compressor vanes 1602 are composed from a thermally responsive material with a negative coefficient of thermal expansion. That is, the enhanced compressor vane 1602 of FIG. 16 is made from a material that contracts to a smaller physical dimension as temperature rises. With operation of the compressor vanes, the region of the enhanced compressor vane 1602 from the center line 1604 to the compressed area between the enhanced compressor vane 1602 and the convex enhanced vane spacer 1608 is substantially hotter than the region of the vane to the other side of the center line 1604. Due to this effect, the thermal contraction property of the enhanced compressor vane 1602 material acts to substantially form the enhanced compressor vane 1602 to the shape of the convex contour 1612. In doing so, the enhanced compressor vane 1602 serves to harvest heat energy from the compressed region between the enhanced compressor vane 1602 and the convex enhanced vane spacer 1608 and uses that heat energy to further the process of compression. Additionally, the stress incorporated in the enhanced compressor vane 1602 due to the action of the thermal contraction of the materials used in its construction serves to lever the force due to the electrostatic attraction of the conductive regions 1606 across the region of the enhanced compressor vane 1602 where no conductive regions are present. That is, the enhanced compressor vane 1602 may be designed so that it is sufficiently stiff and of the appropriate shape (due to the thermal contraction response and due to the materials used) that electrostatic forces are not needed to compress it over the entire area of the enhanced compressor vane 1602.

It is noted that the embodiment of FIG. 16 and also other embodiments making use of thermally responsive materials may benefit from adjustments of the timing and electrical drive levels to the enhanced compressor vanes 1602 so that the temperatures experienced by the enhanced compressor vanes 1602 substantially maximize the benefit gained from the thermally responsive materials used. The optimization of drive levels and signal timing could be adjusted with the design of the system or could be optimized during operation by the control module 108.

Figure 17C:
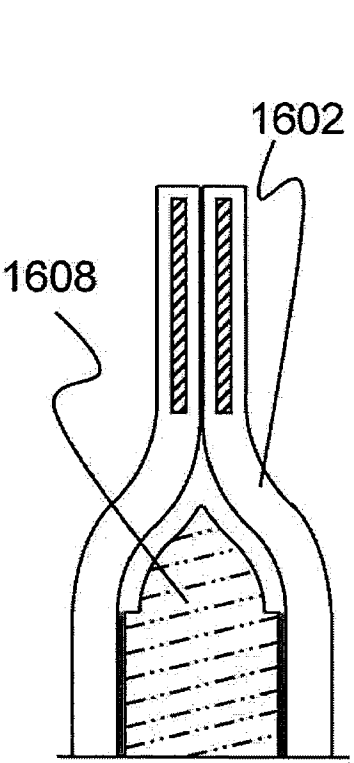
FIG. 17*c* illustrates an embodiment of two electrostatic compressor vanes in the fully compressed position where the benefit of vane materials having a negative temperature coefficient of expansion in conjunction with a convex shaped enhanced vane spacer is shown.
Figure 17B:
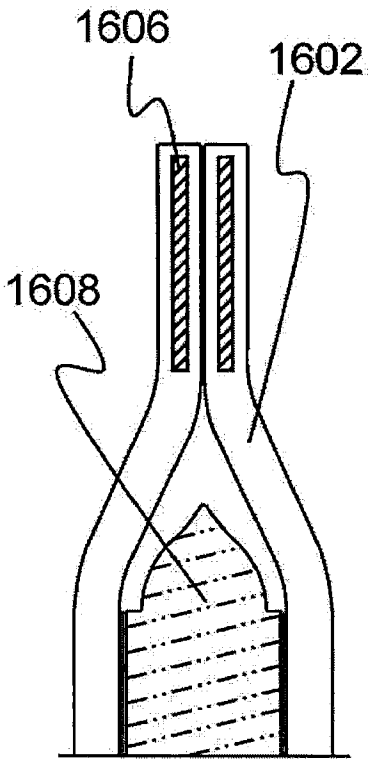
FIG. 17*b* illustrates an embodiment of two electrostatic compressor vanes in the partially compressed position, the enhanced vane spacer shown is of a convex shape.
Figure 17A:
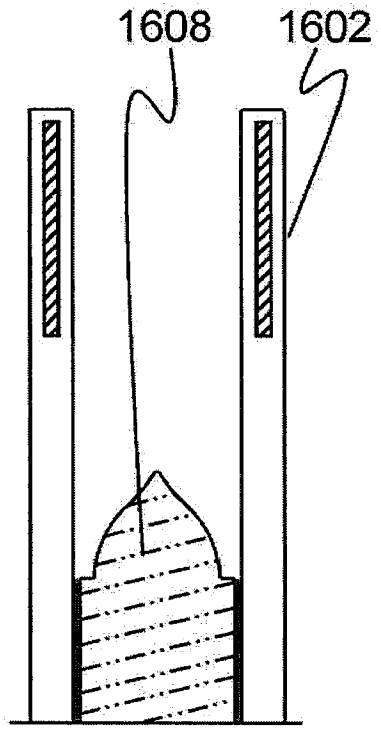
FIG. 17*a* illustrates an embodiment of two electrostatic compressor vanes in the open position, the enhanced vane spacer shown is of a convex shape.

The operation of the enhanced compressor vane 1602 implemented with a material with a negative coefficient of thermal expansion is further illustrated in FIG. 17*a*, FIG. 17*b*, and FIG. 17*c*. In FIG. 17*a*, two enhanced compressor vanes 1602 are shown in the rest position. In FIG. 17*b*, two enhanced compressor vanes 1602 are shown that are partially compressed. Note that in FIG. 17*b*, the region of the vanes near the conductive regions 1606 is substantially compressed, but the region near the convex enhanced vane spacer 1608 is not. In FIG. 17*c*, the effect of the enhanced compressor vanes 1602 constructed from material with a negative coefficient of thermal expansion shows how the heat generated in the air between the enhanced compressor vane 1602 and the convex enhanced vane spacer 1608 has caused further contraction and compression of the air. Embodiments of this technique may benefit if the convex enhanced vane spacer 1608 has a shape that is substantially matched to the shape the enhanced compressor vane 1602 will assume at full compression.

Figure 18C:
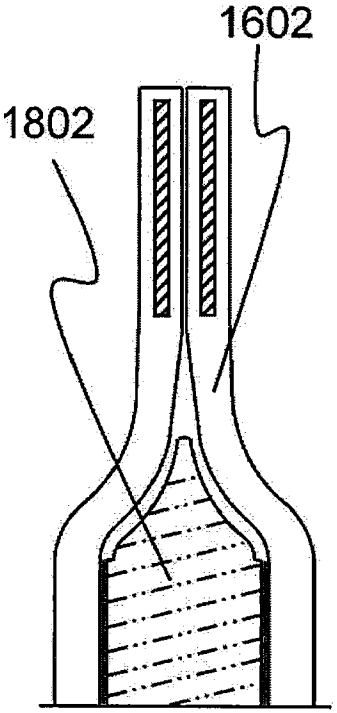
FIG. 18*c* illustrates an embodiment of two electrostatic compressor vanes in the fully compressed position where the benefit of vane materials having a positive temperature coefficient of expansion in conjunction with a concave shaped enhanced vane spacer is shown.
Figure 18B:
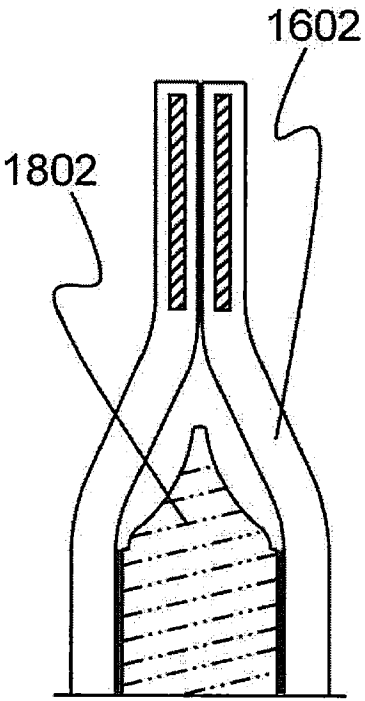
FIG. 18*b* illustrates an embodiment of two electrostatic compressor vanes in the partially compressed position, the enhanced vane spacer is of a concave shape.
Figure 18A:
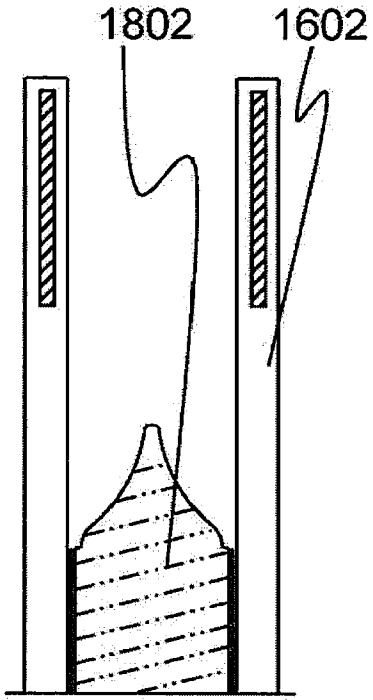
FIG. 18*a* illustrates an embodiment of two electrostatic compressor vanes in the open position, the enhanced vane spacer shown is of a concave shape.

It is also possible to enhance performance with an enhanced compressor vane 1602 constructed from a material having a positive coefficient of thermal expansion. This is illustrated in FIG. 18*a*, FIG. 18*b*, and FIG. 18*c*. Here, a concave enhanced vane spacer 1802 is shown. The view in FIG. 18*a* is the rest condition. The view in FIG. 18*b* is partially compressed. And the view in FIG. 18*c* is fully compressed where the effect of a material with a positive coefficient of thermal expansion (a material that expands at higher temperatures) is clear. The ability to build a system with materials with either positive or negative coefficients of thermal expansion provides useful flexibility in material selection. Some embodiments may also benefit from use of enhanced vane spacers 1608 that are partially or completely constructed from thermally responsive materials. That is, just as the enhanced compressor vanes 1602 can benefit operation by changing their shape and generating stress in response to changes in temperature, it is also possible to use thermally expanding or contracting materials in the enhanced vane spacers 1608 to also provide benefits.

It is noted that the design of a compressor vane to take advantage of the vane's coefficient of thermal expansion should consider how the vane will react to temperature along its length (longitudinally) in addition to its width. As shown in FIGS. 16, 17*a-c* and 18*a-c*, thermally induced expansion or contraction can be used to benefit operation of the electrostatic compressor 206. However, at the same time, it can lead to warping or twisting of the compressor vanes along their length in ways that may make the vanes leak or operate at high levels of friction. One solution to this problem is to use anisotropic materials that have different coefficients of thermal expansion in different directions. Such anisotropic materials, may for example, allow the design of an enhanced compressor vane 1602 that maintains substantially constant length to avoid warping and twisting while providing the benefits of additional compression from thermal contraction or expansion of the enhanced compressor vane 1602 width as described. Some other techniques are also possible and these will be discussed with regard to FIG. 19*a* and FIG. 19*b*.

Many options exist for the construction of enhanced compressor vanes 1602. As has already been described, constructing them from thermally responsive materials may offer benefit. Depending on the operating frequency, voltage, peak temperature, and other factors, a wide selection of materials and construction techniques are possible. In FIG. 19*a* and FIG. 19*b*, an embodiment of and example of enhanced compressor vane 1602 illustrates some of the additional possible materials and design options. FIG. 19*a* shows a cross-section view of the end of an enhanced compressor vane 1602 and FIG. 19*b* shows a perspective view so that the components making up the enhanced compressor vane 1602 are all clear. The enhanced compressor vane 1602 includes thermally responsive material 1904 embedded into both sides of the vane. This material allows the effect of a material with either a positive or negative coefficient of thermal expansion to be realized by laminating or embedding such a material into the sides of the vanes. The thermally responsive material 1904 allows the enhanced compressor vane 1602 to operate as was described in FIGS. 17*a-c* or FIGS. 18*a-c* without needing to use the same thermally responsive material throughout the entire vane construction. Metals such as alloys of nickel and titanium, ceramics, polymers, thermally responsive artificial muscles, shape memory alloys, shape memory polymers, polymer muscles, and other materials are possible for the thermally responsive material 1904. And thermally responsive material 1904 may be affixed to the enhanced compressor vane 1602 through bonding, adhesives, glues, molded features, interlocking elements, mechanical fastening, and other methods. And as was described, anisotropic materials may offer benefit as thermally responsive materials 1904. Note that applying thermally responsive materials 1904 that have textured, roughened, pitted, specially coated, or otherwise specially structured surfaces may improve heat conduction into the thermally responsive material 1904 and benefit operation.

A core vane material 1906 is also shown in FIG. 19*a* and FIG. 19*b*. This material may be very strong and allow the enhanced compressor vane to operate for many cycles without fatigue or failure. Using a core vane material 1906 in this fashion may allow for lighter vanes that can move faster and consume less power. It is beneficial in some embodiments to use a thermally conductive material for the core vane material 1906 that has a coefficient of thermal expansion similar to that of the vane spacers and the heat exchanger. By doing so, the enhanced compressor vane 1602 will expand and contract longitudinally (along its length direction in parallel to the surface where the heat exchange touches the vane) at substantially the same rate as the heat exchanger and the vane spacer. This will reduce thermally induced stress in the system and reduce the likelihood that the enhanced compressor vane 1602 will warp or twist along its longitudinal direction. Thermal vias 1914 are shown in FIG. 19*a* and FIG. 19*b* to facilitate constant temperature between the core vane material 1906 and the vane spacers. It may be beneficial to position the thermal vias 1914 close to where the enhanced compressor vane 1602 contacts the heat exchanger 200 to partially avoid the rapid thermal transients that will occur in the vane spacers during operation.

Enhanced compressor vane 1602 includes conductive regions 1908. In the enhanced compressor vane 1602, the conductive regions 1908 are split so that the core vane material 1906 can extend through substantially the entire vane. In some embodiments, the core vane material 1906 may be the same as the material used to form the conductive regions, but in others the materials may be different. By using the design as shown, the thickness of the vane dielectric 1918 over the conductive regions 1908 can be optimized to provide safe operation without dielectric breakdown and appropriate levels of electrostatic compression force. It is noted that while the dielectric 1918 over the conductive regions 1908 in FIG. 19*a* and FIG. 19*b* is shown as being uniform, that it may be beneficial in some designs to use thicker dielectric 1918 in some regions of the enhanced compressor vane 1602. For example, if higher voltage levels are used during the initial portion of a vane actuation phase, thicker dielectric 1918 may be needed on the outer portion of the vane (nearer the outer edge of the vane 1912, note that the convention of referring to elements furthest from the mounting plate and heat exchanger as "outer" elements is followed here). Also as previously noted, the operation of the enhanced compressor vane 1602 near an enhanced vane spacer 1608 may benefit from tailoring the shape of the conductive regions 1908 and/or the thickness of the dielectric material over them in the vicinity of the enhanced vane spacer 1608. Stress relief 1902 is provided on both sides of the enhanced compressor vane 1602 to allow the vane to flex more easily between the vane spacer attach region 1910 (the part of the vane that will be between the vane spacers after the electrostatic compressor is assembled) and the remaining portion of the vane. The outer edge of the vane 1912 shows use of thicker material that may improve the life of the vane as the outer edges of the compressor vanes rub together in operation. The thicker outer edge of the vane 1912 also acts as a ballasting weight that may be designed to optimize the movement of the enhanced compressor vane 1602 when in operation. The enhanced compressor vane 1602 shown in FIG. 19*a* and FIG. 19*b* shows the outer edge of the vane 1912 made from a thicker region of vane dielectric 1918 material, but other materials could also be used in this region of the vane to improve operation, optimize ballasting, improve reliability, or benefit other desirable characteristics. And, of course, while a thicker and heavier material is shown along the outer edge of the vane 1912 some designs may benefit from lighter and/or smaller or thinner materials in this region.

Some additional techniques to deal with multiple materials that have different coefficients of thermal expansion are illustrated in FIG. 19*b*. In FIG. 19*b*, the thermally responsive material 1904 is not shown continuous along the length (longitudinal direction) of the enhanced compressor vane 1602, but is implemented in sections. While the thermally responsive material 1904 may also be implemented in a continuous sheet, implementing it in shorter sections allows thermal stress that would build up in the longitudinal direction to be relieved between the sections so that the enhanced compressor vane 1602 won't tend to warp as much as it might otherwise. Other implementations that manage stress such as applying the thermally responsive materials in thin layers, using anisotropic materials, or other techniques may also be used or combined. Similarly, the conductive regions 1908 have been similarly implemented in sections, but since electrical continuity is maintained along the vane, stress relaxing connections 1916 have been implemented. Stress relaxing connections 1916 are shown as diagonal connections in thin material, but may also be implemented in serpentine or other shapes to advantageously allow the enhanced compressor vane to maintain its proper shape in the face of high temperatures. It is noted that the core vane material 1906 is shown in the end cross-sectional view of the enhanced compressor vane 1602 in FIG. 19*b*, but has not been carried through with dashed lines through the side view in the figure. This was done to avoid clutter in the figure especially around the stress relaxing connections 1916. From the figures and description it is clear that the core vane material 1906 may extend through the entire length of the enhanced compressor vane 1602 and that the conductive regions 1908 and stress relaxing connections 1916 may be formed with the core vane material 1906 passing through them if such a material is actually present.

The use of thermally responsive material 1904 or an enhanced compressor vane 1602 that takes advantage of the thermal expansion or contraction of the vane is especially important. Note that the heat in the air being compressed is being harvested in such a configuration to do work to help with the compression. That is, the heat that the air cycle heat pump 100 is ultimately trying to remove from the air is actually being used to help power the system. In this way, very high efficiency may be achieved. It is noted that with appropriate materials, it may be possible to power a very substantial amount of compression of the air between the compressor vanes from the heat in the air. A positive feedback condition may occur in which the vanes compress due to the heat from the air sufficiently rapidly so that the additional compression generates sufficiently higher temperatures to further drive the vanes to compress even harder. Such a condition may be advantageous if the materials used in the system can withstand the resulting elevated temperatures. If this is not the case, the system control module 108 along with the design of the system should ensure that it does not occur. Monitoring of system variables and varying the operating voltages and frequency may be used to ensure that the system does not experience temperatures beyond material limits. For example, if the intake port 104 air temperature and other characteristics are known, the control module 108 can compute an estimate of the peak temperature in the compressed regions 814 and limit the operating voltage or vary the operating frequency to ensure that the compressor vanes 400 (or enhanced compressor vanes 1602) are not damaged due to excessive temperature. Additionally, a very small thermal sensor may be included in one or more vane spacers to directly monitor the temperature of the compressed regions 814 so that the control module 108 has direct information on the peak temperatures.

It is also possible to construct the enhanced compressor vane 1602 shown in FIG. 19*a* and FIG. 19*b* with thermally responsive materials 1904 so that conductive regions 1908 and electrostatic force are not used or are used in conjunction with other techniques. Some artificial muscle materials, for example, are responsive to both thermal and electrical stimulus. In such a case, an artificial muscle material could be used to construct the enhanced compressor vane 1602 so that conductive regions 1908 may not be needed. The resulting system would make use of artificial muscles for actuation of the vanes, but would operate as the embodiments shown here in other respects. Such a system may operate by actuating the vanes first by electrical stimulus of the artificial muscle material and then later by taking advantage of the thermal energy generated to further actuate the muscle. And while artificial muscles are specifically mentioned here, it is noted that any material that is thermally responsive and has other appropriate properties for use as a compressor vane 400 or an enhanced compressor vane 1602 may be used in such a design.

Figure 19C:
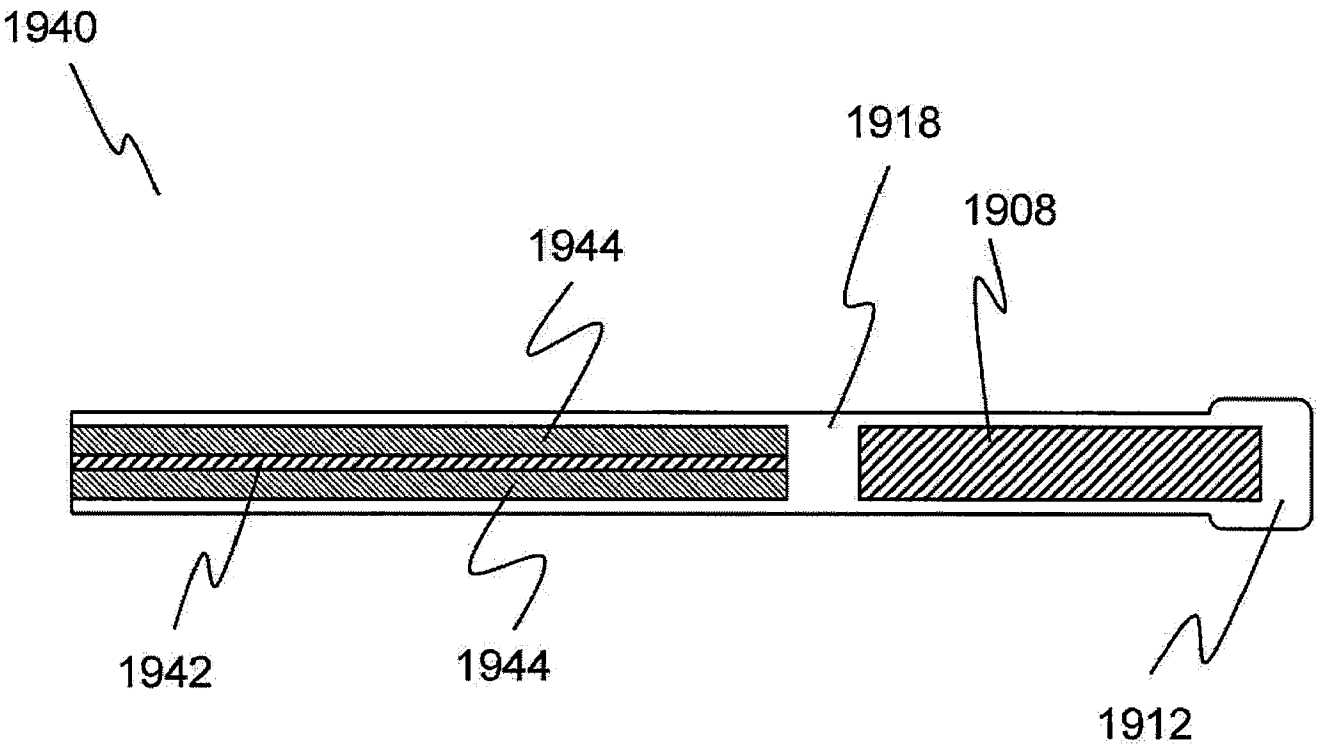
FIG. 19*c* illustrates a cross section of a compressor vane with enhanced construction and including piezoelectric material.

Actuating the compressor vanes 400 and the enhanced compressor vanes 1602 with electrostatic forces are illustrated in various embodiments of the invention. However, other possible techniques may also be used. For example, constructing the compressor vanes from piezoelectric materials such as piezo-film would allow them to be actuated due to the mechanical response of the piezoelectric materials to electrical stimulus. This is illustrated in FIG. 19*c*. FIG. 19*c* illustrates an embodiment of a cross-section of a piezo-compressor vane 1940 with piezo-film 1942 and piezo-electrodes 1944. The enhanced compressor vane 1602 body is formed from dielectric 1918. It also includes a conductive region

1908 for electrostatic actuation. However, the conductive region 1908 is included for clarity to illustrate how piezoelectric materials and actuation may be applied and differ from the use of electrostatics. Indeed, it is possible to create and apply a compressor vane using only piezoelectric actuation or to use piezoelectric actuation with artificial muscles or other techniques besides electrostatics. Piezo-film 1942 is responsive to electric fields across the piezo-electrodes 1944. If one of the piezo-electrodes 1944 is biased positively with regard to the other, the piezo-film 1942 will create a stress in either the upward or downward curving direction in the FIG. 19*c*. If the polarity of this bias is reversed, the piezo-film will create a stress in the opposite direction. In this way, by controlling the bias polarity across the piezo-electrodes 1944, the vane can be actuated as needed to facilitate compression when used in an electrostatic compressor 206 (as previously stated, we consistently refer to the heat pump compressor as an electrostatic compressor even for embodiments where other mechanisms are used for actuation). It is noted that in the course of piezoelectric actuation, charge is stored across the piezo-electrodes and techniques similar to those described in FIGS. 15*a* and 15*b*, or other electric energy recovery techniques can be applied to capture and re-use this energy. The piezo-film material may be lead-zirconate-titanate (PZT), aluminum-nitride (AlN), or many other possible piezo electric materials. It is noted that the piezo-film and piezo-electrodes may also create stress along the longitudinal dimension of the vanes, so applying them in limited dimensions, creating anisotropic implementations of them, using some of the techniques shown in FIG. 19*b* to control longitudinal stresses, or using other methods may be beneficial. It is also possible to include thermally responsive materials 1904 in the piezo-compressor vane 1940 by laminating or embedding them in the sides of the vane as was shown in FIG. 19*a* or through other ways of including them.

Application of artificial muscles or other thermally responsive materials in configurations different from those discussed here already may be possible. And as was explained in some embodiments, it may be possible to use heat energy from the compressed air to help actuate the artificial muscles and improve system efficiency. Using magnetic forces may also be possible. For example, currents flowing in conductors in the compressor vanes may interact with magnetic fields to generate actuation of the vanes. Materials with magnetic properties that change with temperature may be used to control forces in the vanes at various locations and, in particular, may be used to concentrate or relax forces in regions at higher temperatures. Even directly actuating the vanes with mechanical force from rods, gears, or other mechanisms may be possible. Still other possibilities exist such as using compressed or heated gases or air to pneumatically drive the vanes. And finally, combinations of multiple methods for actuating the compressor vanes 400 or the enhanced compressor vanes 1602 or similar structures achieving similar results are also possible.

Figure 20:
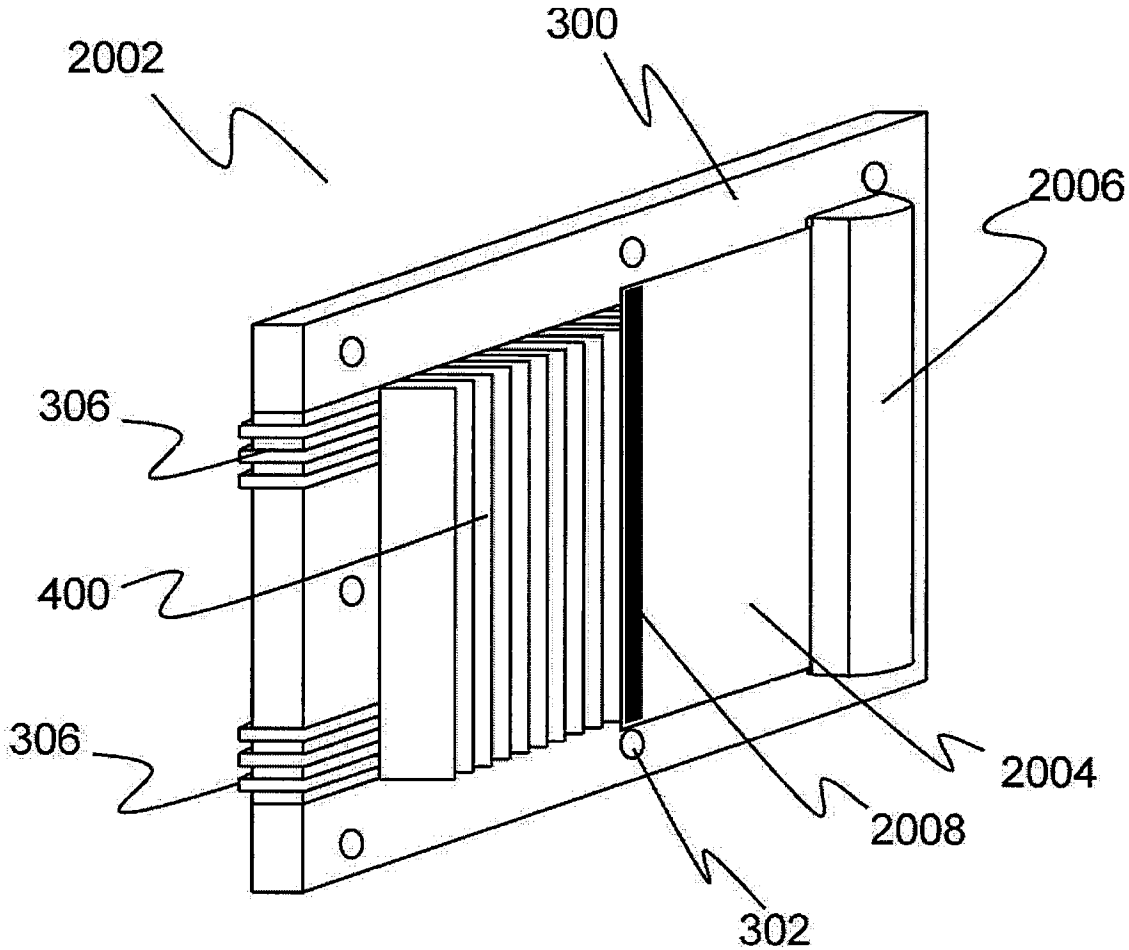
FIG. 20 illustrates an embodiment of an electrostatic compressor with a partially extended air screen.

In FIG. 20 an embodiment of an electrostatic compressor with an air screen 2002 is illustrated. The air screen 2004 is shown partially extended across the compressor vanes 400. An air screen housing 2006 stores the portion of the air screen 2004 not extended and may consist of a spring loaded roller or other techniques for storing the air screen 2004. A stiffener 2008 is shown on the edge of the air screen 2004 that stabilizes the air screen to avoid excessive motion of the air screen 2004 during operation. The air screen 2004 may be extended across the vanes by many well known techniques such as pulling on the stiffener 2008 with a lever, cabling, a miniature winch, an electric solenoid, or many of a wide variety of means (since these are very common techniques they are not shown in FIG. 20). Also, while the air screen 2004 shown in FIG. 20 is a rolled sheet that can be extended across the compressor vanes 400, many other approaches are also possible. Shutters, adjustable solid covers, fan-folded screens, telescoping sheets, or many other possible configurations may also be used. While many approaches to the air screen 2004 are possible, the function of the air screen 2004 would be similar. That is, when all or a portion of the electrostatic compressor with an air screen 2002 is not in active use, there is heat conduction through the vane spacers 500 from the outside ambient air to the air internal to the building or other enclosure being cooled or heated. Consequently, there is a benefit to cover the electrostatic compressor 206 when it is not being used. Of course, air circulation fans and ductwork vents may also be closed when the air cycle heat pump 100 is not active. However, the addition of the air screen 2004 allows the air cycle heat pump 100 to continue to provide ventilation without substantially moving heat from the outside ambient into the enclosure being cooled or heated. The air screen 2004 may be constructed from polymers, canvas, plastics, metals, or other materials. As the purpose of the air screen 2004 is to avoid heat movement, thermally insulating materials are preferred for it.

Figure 21:
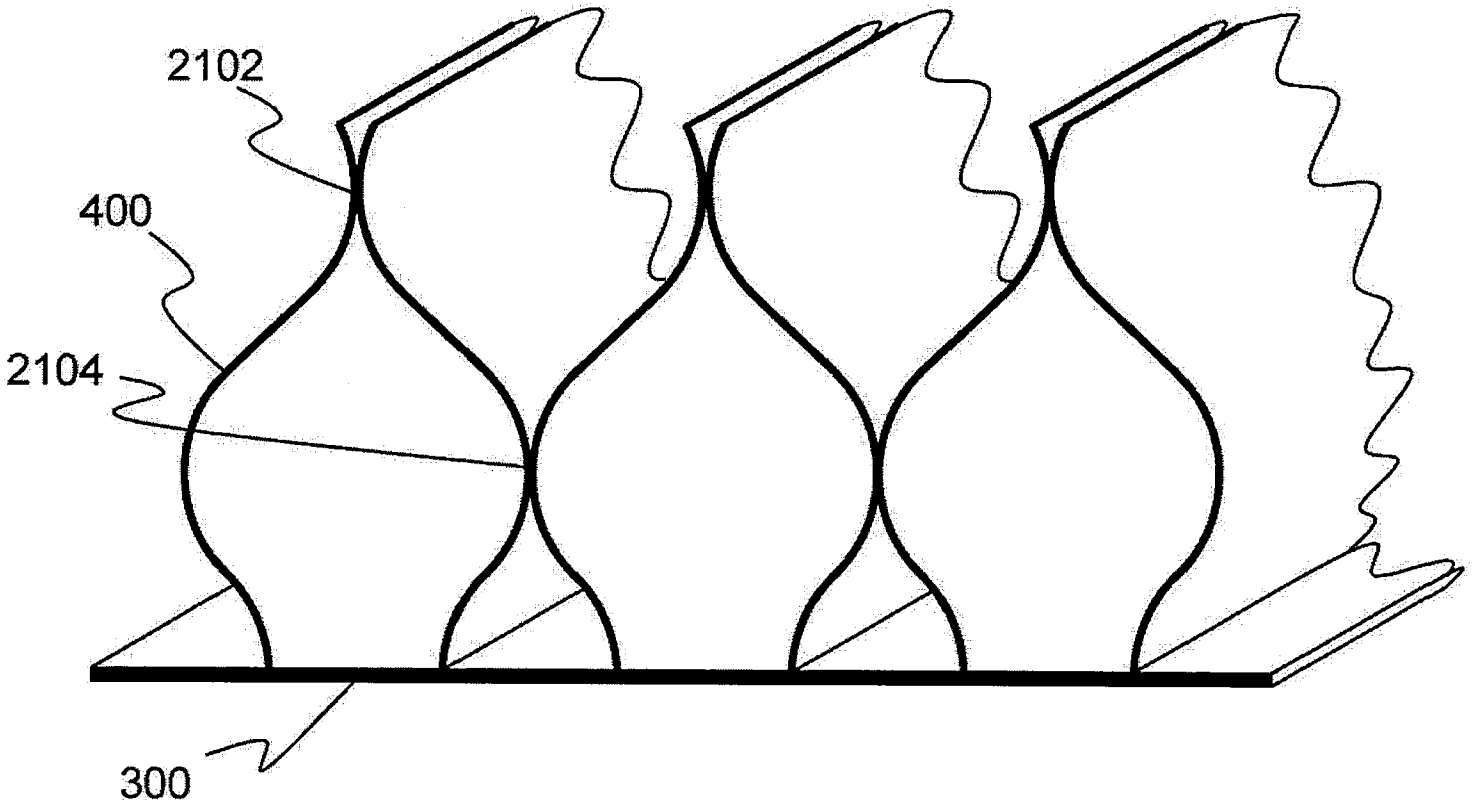
FIG. 21 illustrates a view of how compressor vanes with multiple conductive regions can be actuated to close them to air flow.

In FIG. 21, an example of another approach to closing the vanes of the electrostatic compressor 206 is shown schematically. The compressor vanes 400 in FIG. 21 are assumed to have multiple conductive regions and will require at least two conductive regions to implement the embodiment shown. The inner conductive regions 410 of the compressor vanes 400 in FIG. 21 are electrically biased to draw them to adjoining compressor vanes 400 in pairs as shown. This configuration results in the formation of inner compression points 2104. The outer conductive regions 408 of the vanes are electrically biased to cause outer compression points 2102 across the areas between the pairs of compressor vanes 400 that would otherwise be open. In this way, areas of the electrostatic compressor 206 can be fully closed to air circulation. Since no additional air screens 2004 or other techniques are need, this embodiment provides benefit in allowing a great deal of flexibility in closing any or all of the compressor vanes 400. Of course, to make use of this technique, the compressor vanes 400 should have at least two conductive regions and be sufficiently wide and flexible to form the configuration shown in FIG. 21. It is noted incidentally that in the absence of a capability as illustrated in FIG. 21 and if no air screen 2004 is implemented, the electrostatic compressor 206 may be best kept in an idle configuration with pairs of compressor vanes 400 compressed together. For example, in either the first operating phase 1420 or the second operating phase 1422 illustrated in FIG. 14. Keeping the idle electrostatic compressor 206 in the rest phase 1401 may be disadvantageous as all the vane spacers 500 would then be exposed, versus only half of them in one of the operating phases. And, of course, maintaining the electrostatic compressor 206 in one of the operating phases, or in the configuration shown in FIG. 21 takes little or no additional power since the system is biased in a static condition.

Figure 22:
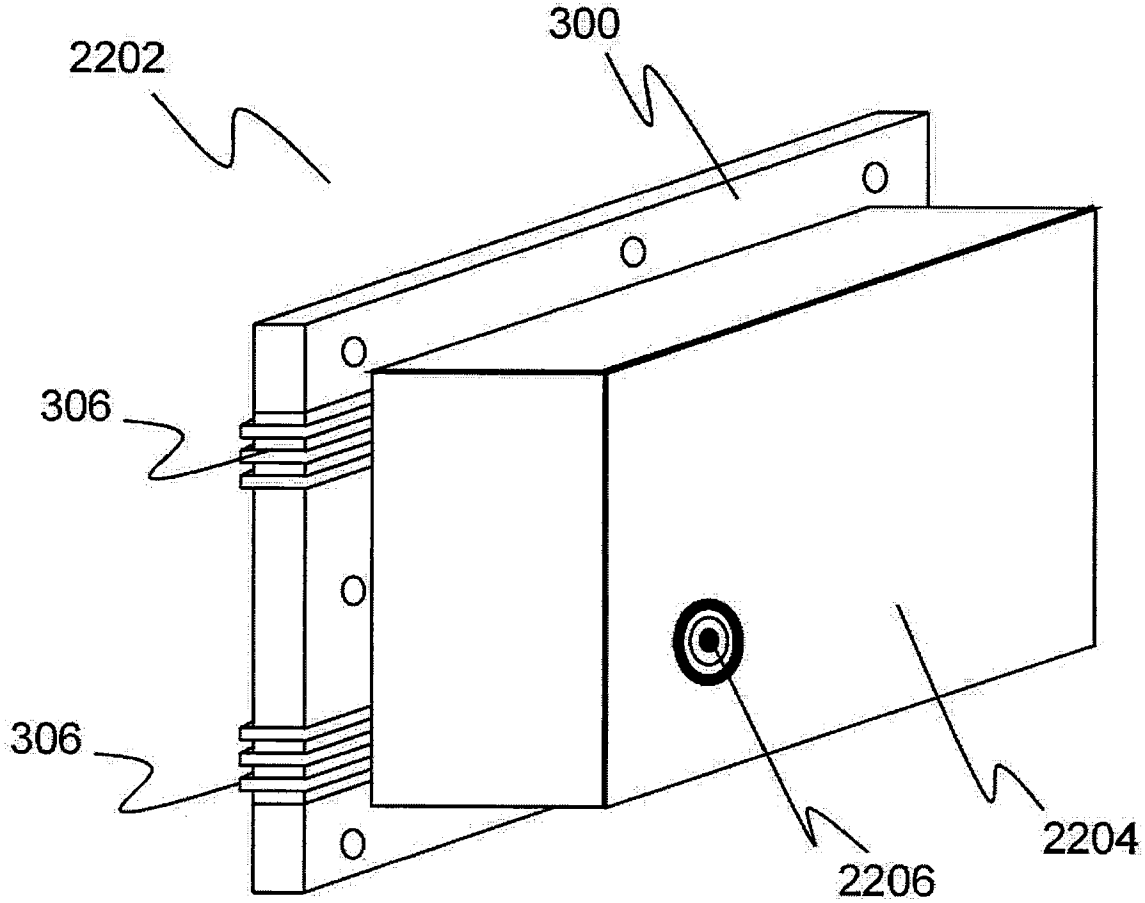
FIG. 22 illustrates an embodiment of an electrostatic compressor that is fully enclosed so that various working fluids can be used.

In FIG. 22, an embodiment of an electrostatic compressor with a sealed enclosure 2202 is illustrated. Casing 2204 may be made from plastics, metals, ceramics, or other materials and is solidly mounted to the mounting plate 300 of the electrostatic compressor with a sealed enclosure 2202. The casing 2204 may be mounted to the mounting plate 300 with welding, screws, bolts, pins, clips, gaskets, adhesive, or other techniques to form a substantially gas-tight seal. Valve 2206 is used to evacuate the inside of the casing 2204 and then fill it with a working fluid material. The working fluid material may be a refrigerant gas, other gases, or may simply be pressurized air. Many possible designs are available for a valve 2206, so no specific detail is shown. Many types of valves for similar purposes are widely available and used and would be suitable for the embodiment shown in FIG. 22. In operation, the electrostatic compressor with a sealed enclosure 2202 will pump heat from the inside of the casing 2204 to the side of the mounting plate 300 not visible in FIG. 22 (and from there, on to the heat exchanger 200 as illustrated in FIG. 2). Hence some form of heat exchanger is beneficial on the surface of the casing 2204 to better couple heat from the building or other enclosure being cooled to the electrostatic compressor with a sealed enclosure 2202. Many forms of commonly used heat exchangers can be used for this purpose including heat exchangers with metal fins, liquids flowing in them, or many other possible heat exchanger structures.

The electrostatic compressor with a sealed enclosure 2202 may also be used with refrigerant working fluids that change phase from a gas to a liquid when cooled or may be used directly for the liquefaction of gases. For such an implementation, a condenser 118 similar to that shown in FIG. 1 would be installed inside the casing 2204 so that the cold gas from the electrostatic compressor 206 would condense on the condenser 118 and be collected in a condensate drain 120. Once liquefied, the refrigerant or other gas could be collected from additional valves on the casing 2204 so that the liquid is removed and additional gas may be introduced into the casing 2204. If the casing 2204 is supplied with pressurized gas, the gas pressure could also be used to help drive the cooled liquid from the casing 2204. Clearly, for such a solution, valves to introduce gas into the casing 2204 may be best placed near the top of the casing 2204 while liquid may be removed from the bottom and kept to a level so as not to interfere with the movement of the compressor vanes 400.

While it is not likely in the case of heating or air conditioning a building or other typical enclosure, some heating and/or refrigeration applications may require isolation of the building or enclosure air from the electrostatic compressor 206. For example, controlling air temperature in an industrial paint booth or coating facility may require that the hazardous and potentially flammable chemicals in use not come into contact with the electric field levels used in the electrostatic compressor 206. For such applications, the electrostatic compressor with a sealed enclosure 2202 provides a beneficial solution since the building or other enclosure air can be kept separate from the air or other gas contacting the electrostatic compressor 206.

It is also noted that as an alternative to using a working fluid in applications where hazardous or flammable materials may be present in the building or other enclosure air flow, the air cycle heat pump 100 could include monitoring electronics to shut itself off quickly and ground all the compressor vanes 400 very quickly if even small quantities of flammable or otherwise hazardous materials are detected. The air cycle heat pump 100 could also include fire detection systems inside the enclosure 101 and even fire extinguishing mechanisms so that in the unlikely event of fire, the system may take action to warn building occupants and make efforts to put out the fire.

Figure 23A:
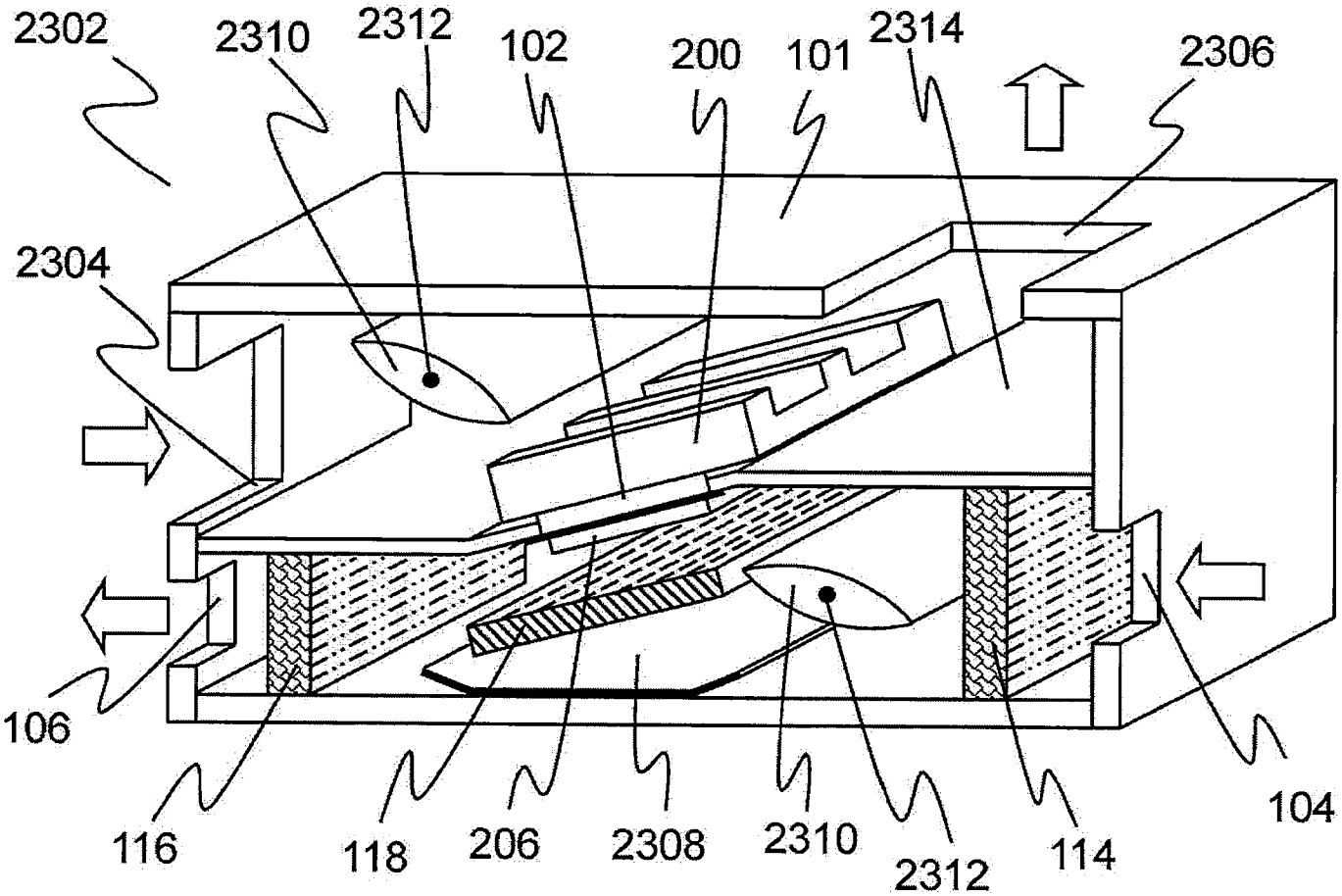
FIG. 23*a* illustrates an embodiment of an enhanced air cycle heat pump with one side of the system enclosure removed so that the internal operation and components can be observed.

In FIG. 23*a*, an embodiment of enhanced air cycle heat pump 2302 is illustrated. This system shares several common features with the air cycle heat pump 100 of FIG. 1. In particular, the intake port 104, exhaust port 106, intake filter 114, exhaust filter 116, condenser 118, electrostatic compressor and heat exchanger assembly 102, and the enclosure 101 perform substantially the same functions as those shown in FIG. 1. And as was done in FIG. 1, the enhanced air cycle heat pump 2302 is shown with one side of the enclosure 101 removed so that the internal construction is visible and can be explained. The enhanced air cycle heat pump 2302 includes an outside air circulation path. Outside air passes in through the outside air intake port 2304, passes over the heat exchanger 200, and flows out the outside air exhaust port 2306. While the outside air need not be carried through duct work, it may be beneficial to connect the enhanced air cycle heat pump 2302 to duct work so that the air supplied to the outside air intake port 2304 is as relatively cool as possible (this is assuming a cooling application, for a heating applications relatively warmer outside air would be preferred). For example, if the enhanced air cycle heat pump 2302 is installed in an attic, bringing air into the outside air intake port 2304 from under the eave of the house or from a cool area of the attic would be beneficial. Cooler outside air may be found in shaded areas, where there are trees, light colored external ducts to shaded or cool areas and the like. There may also be benefit to providing ductwork from the outside air exhaust port 2306. If, for example, vertical duct work is provided from the outside air exhaust port 2306 to the roof above, the heat from the heat exchanger will cause the air in the ductwork to rise creating a chimney effect that will help draw air through the system. Of course, forced air ventilation of the outside air through the enhanced air cycle heat pump 2302 is also possible and one option for such a system will be shown in FIG. 23*b*.

The outside and inside air in the enhanced air cycle heat pump 2302 is kept separate by the divider 2314. The placement of the electrostatic compressor and heat exchanger assembly 102 as shown in FIG. 23*a* is beneficial as warmer air from the intake port 104 will rise and flow preferentially near the electrostatic compressor and heat exchanger assembly 102 versus cooler air that may be present. Additionally, the cooler air flowing into the outside air intake port 2304 will preferentially flow over the heat exchanger 200 versus warmer air that may be present. Condensation forming on the condenser 118 will build up and drip into the condensate drain pan 2308 where it will either be drained away (drain not shown in FIG. 23*a*) or pumped into the heat exchanger 200 to help cool it (no pumping or other plumbing for this is shown in FIG. 23*a*). It is noted that the construction of the enhanced air cycle heat pump 2302 orients the electrostatic compressor 206 so that the effect of gravity will substantially help the electrostatic compressor 206 expel water. Hence, this orientation may be beneficial to the removal of condensation. Additionally, the vibration of the moving vanes of the electrostatic compressor 206 may be controlled to (momentarily or continuously) vibrate in a fashion to beneficially shake moisture from them.

Air foils 2310 supported on axles 2312 are shown in both the inside and outside air circulation paths. These air foils 2310 may be fixed permanently in place, adjustable, or electronically controlled. The air foils 2310 serve to direct the flow of air to preferentially flow beneficially through the system. In the case of the air flowing from the intake port 104 into the system, the air foil 2310 in the inside air circulation path can be turned to direct more or less of the incoming air to the electrostatic compressor and heat exchanger assembly 102. As an example, consider a situation where the enhanced air cycle heat pump 2302 is working to substantially reduce the humidity of the inside air, the air foil 2310 in the inside air path may be turned to direct the air flow away from the electrostatic compressor and heat exchanger assembly 102. In this way, some of the air near the electrostatic compressor and heat exchanger assembly 102 will be cooled and cooled again further reducing its temperature and, in turn, further reducing the temperature of the condenser 118 so that it is cooled below the dew point of the inside air. Alternatively, for maximum total cooling effect, the air foil 2310 may be directed to create a Venturi effect over the electrostatic compressor and heat exchanger assembly 102 to increase circulation and increase overall system cooling.

Similarly, the air foil 2310 in the outside air circulation path can be used to create a Venturi over the heat exchanger 200 and improve heat transfer. When the system is not in operation, it may be beneficial to turn the air foil 2310 in the outside air flow to allow the system to more easily ventilate and keep the temperature in the outside air channel cooler.

Of course, many different approaches to air foil 2310 and control are possible and FIG. 23*a* only illustrates one possible embodiment. Air foils 2310 with special aerodynamic features, asymmetrical shapes, and the like are all possible. Air foils 2310 may be formed from wood, metal, plastics, and other materials. The control module 108 and the associated sensors and wiring shown in FIG. 1 have been left out of FIG. 23*a* for simplicity and to avoid clutter in the drawing. System control for the enhance air cycle heat pump 2302 is similar to that of the air cycle heat pump 100 of FIG. 1 and similar approaches, control laws, sensors, and system optimization algorithms apply to both of them. If the air foils 2310 are electronically controlled, a control module 108 may be used to provide the needed electrical stimulus.

While examples of cooling applications were preferred in most cases for the descriptions of the air cycle heat pump 100 of FIG. 1 and the enhanced air cycle heat pump 2302 of FIG. 23*a* it is clear that they can be reversed to create a heat pump for heating purposes. This is done in an analogous fashion to how a typical air conditioning system is reversed to create a heat pump in legacy Heating, Ventilating, and Air Conditioning (HVAC) systems. In FIG. 1, the system can be readily reversed by simply mounting the electrostatic compressor and heat exchanger assembly 102 with the heat exchanger inside the system enclosure 101 and the electrostatic compressor 206 on the outside. Of course, additional air filters may be needed in such a case as the electrostatic compressor 206 may not operate properly if there are significant levels of particulates in the air. Similarly, the enhanced air cycle heat pump 2302 of FIG. 23*a* could be reversed to form a heat pump by either mounting the electrostatic compressor and heat exchanger assembly 102 so that the outside air contacts the electrostatic compressor and the inside air contact the heat exchanger 200. Or, alternately, by reversing the duct connections to the enhanced air cycle heat pump 2302 so that the outside and inside air are swapped and each flows through the path normally used for the other (as would normally be used for cooling). Automated duct controls can be used for this purpose as illustrated in the embodiment shown in FIG. 23*b*, or it could be performed manually. It is noted that when used as a heat pump, the condenser 118 would normally be removed from the system to avoid build up of frost or ice on it that could lead to a system malfunction (it could alternatively be bypassed or moved inside the system to avoid restricting air flow). As was already described with regard to FIG. 1, when the air cycle heat pump 100 or enhanced air cycle heat pump 2302 are used for cooling, some build up of frost or ice on the condenser 118 would not normally be an issue as the warm building air flow through the system would cause it to melt. If ice build up did become a problem due to high humidity or other special conditions, an auxiliary heating approach to defrost the condenser 118 would clearly be possible. The simplest technique to achieve this may simply be to flow electrical current through the condenser 118 (assuming proper electrical connections and insulation is in place) to heat it and defrost it.

Figure 23B:
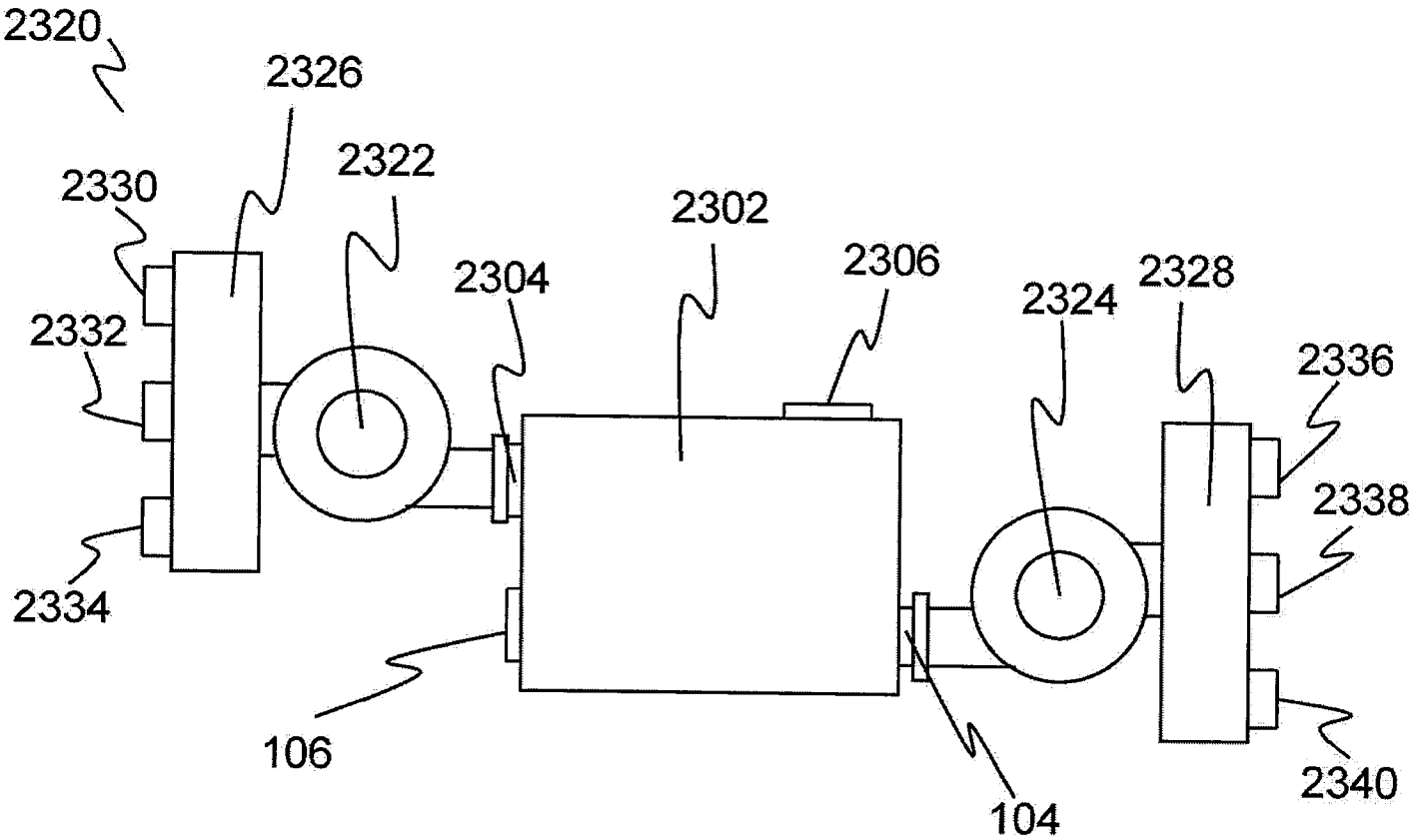
FIG. 23*b* illustrates an embodiment of an enhanced air cycle heat pump in a system implementation including fans and automated air vents.

Some examples of how the enhanced air cycle heat pump 2302 may be used are illustrated in FIG. 23*b*. Since the air cycle heat pump 100 and the enhanced air cycle heat pump 2302 have access to both building or enclosure air and outside air, the potential exists to mix air and operate a system in novel ways. The system implementation 2320 shows a possible embodiment. System implementation 2320 includes the enhanced air cycle heat pump 2302 with a first automated air vent 2326, a first fan 2322, a second automated air vent 2328 and a second fan 2324. The first automated air vent 2326 and the second automated air vent 2328 each have three inputs that are automatically controlled to allow air from them to be mixed and output to the fan connected to that respective automated air vent. That is, the automated air vents include automatically controlled dampers or other mechanisms that can open, close, or mix air in desired proportions. The temperatures of the air at each of the three ports may be monitored electronically so that air may be mixed in optimal proportions in view of incoming air temperatures. The automated air vents may be actuated electrically, pneumatically, hydraulically, mechanically, or by other techniques under the control of the control module 108 or another suitable controller. The fans shown may be implemented as centrifugal fans, axial fans, or by other suitable types of fans. The fans may be powered by electric motors or by other methods.

The automated air vents allow a great deal of flexibility in operation of the system implementation 2320. As an example, consider the use of the system implementation 2320 operating as an air conditioner for a house. In this case, the first automated air vent 2326 might provide air from it's first port 2330 that may be externally connected to a source of outside air, perhaps from a shaded location adjacent to the house. The first fan 2322 would force this air into the outside air intake port 2304, through the enhanced air cycle heat pump 2302 and out the outside air exhaust port 2306 (where it might be vented to the attic or to the outside). The second automated air vent 2328 might also take input air from its first port 2336 that would be connected to the house's air through a duct system. The second fan 2324 would force the house air through the intake port 104, on through the enhanced air cycle heat pump 2302 for cooling, through the exhaust port 106, and back into the house. However, the second automated air vent 2328 might also introduce some air from its second port 2338 that might be a source of outside air (possibly the same source of air as the first port 2330 on the first automated air vent 2326) so that some amount of fresh air may be introduced into the house. The capability to introduce outside fresh air into the house allows forced ventilation. This may be used to keep the house at a slightly positive air pressure relative to the outside air so that allergens, dust, and other contaminates cannot easily enter the house through cracks and other leaks (additional fans and ducting may be required to establish and control the air pressure in the house). And since the air forced into the house passes through the air filters inside the enhanced air cycle heat pump 2302, indoor air quality can be improved. Other benefits may be to cycle cool outside air into the house if the house is hotter inside than the outside air (for example, when the occupants come home on a hot day and want the house to cool down quickly). Another option is to introduce cool outside air into the house in the mornings or evenings when the outside air is cool.

The second port 2338 on the second automated air vent 2328 may also be used to introduce outside air into the second fan 2324 in the situation where the enhanced air cycle heat pump 2302 is used as a heat pump for winter heating. In that case, the first automated air vent 2326 may take air from its second port 2332 that would be a source for the house inside air so that it may be heated. Of course, for this use, the exhaust port 106 air would be vented to the attic or the outside and the outside air exhaust port 2306 would be vented back to the house. The vents, ducting and controls for these exhaust port connections are not shown in FIG. 23*b*, but can be implemented with well known techniques. Additional air filters, as previously mentioned, may be beneficial in the outside air path (actually carrying the house's air when used in this mode as a heat pump) through the enhanced air cycle heat pump 2302 for this use as a heat pump. In this application, it is noted that the second automated air vent 2328 might also take air from its third port 2340 that may be attic air or another source of warmed air that would improve the efficiency of the system's use as a heat pump. For example, on a sunny winter day, the attic air in the house may well be warmer than the outside air and using it as an input to the enhanced air cycle heat pump 2302 would allow heat loss through the attic insulation and solar heat from the sun on the roof to be recovered and used for heating the house. The third port 2340 on the second automated air vent 2328 might alternatively provide warmed air from a geothermal system, heat recovery from an industrial system, or other sources of warmed air that may be present. It is also noted that it may be desirable to use the system implementation 2320 shown in FIG. 23*b* to introduce some outside air into the house when the system is used for heating in the winter time. The first automated air vent 2326 might allow this, especially at times when the outside air is somewhat warmer (for example in the afternoons), by mixing some air from it's first port 2330 that is connected to outside air as was previously explained.

The third port 2334 on the first automated air vent 2326 may be an alternative source of cool air for when the system is used cooling. For example, if two outside cool air sources exist on each side of a house, one might be preferred in the morning and the other in the afternoon (that is, cool outside air could then be taken from the cooler side of the house when the sun may not be so direct depending on the time of day). Alternatively, an auxiliary system such as an evaporative cooler, geothermal system, or other sources of cool air may be routed to the third port 2334 and used advantageously by the first automated air vent 2326.

From the description of FIG. 23*b*, it is clear that significant flexibility to heat or cool air from inside the house or other enclosure, to mix it with fresh outside air, and to make use of preferred sources of air for heating or cooling such as multiple sources of outside air or attic air, is possible with the system implementation 2320. Further novel capability to operate the house or enclosure at a controlled positive pressure to improve the cleanliness of the house air is also possible. And, of course, while the automated air vents illustrated in FIG. 23*b* each included three ports, implementations with other numbers of automated air vents with different numbers of ports; and also systems in which some air vents are automated and others are operated manually are also possible. The system implementation 2320 of FIG. 23*b* may also operate cooperatively with power systems in a residential, commercial, or other implementation. For example, if a solar energy generation system is available, the system implementation 2320 could take benefit from it and maximize its cooling and use of power during times of maximum sunlight. In the case of a cloudy day, for example, the ability to provide maximum cooling during sunny intervals could substantially reduce the use of grid power. And since the electrostatic compressor 206 can very quickly increase or decrease its output, this flexibility is a significant benefit. And clearly, not only home cooling systems, but refrigeration systems, and other heaters or coolers based on electrostatic compressors 206 could be used in such a cooperative fashion with solar, wind, smart grid, and other systems to optimize power utilization.

Figure 24B:
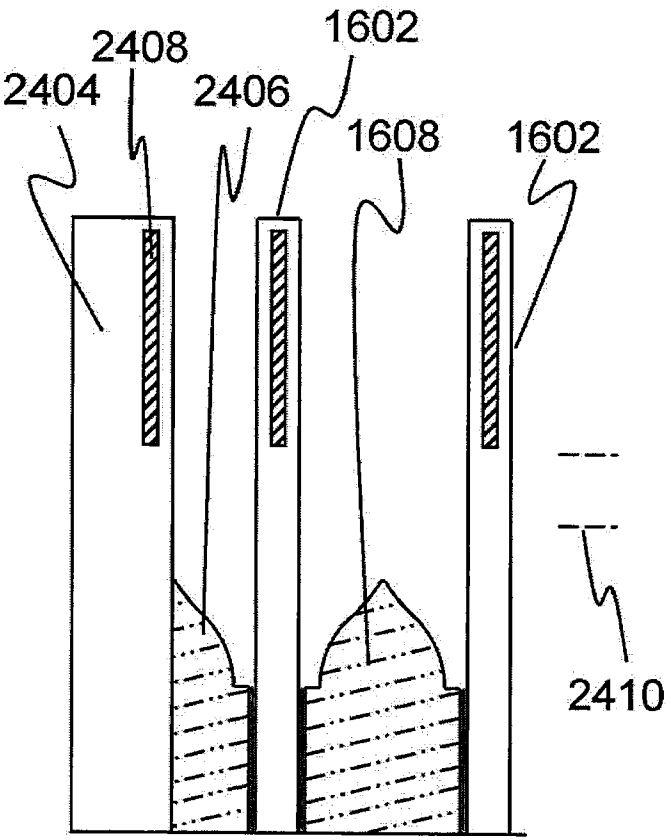
FIG. 24*b* illustrates an active edge piece with a partial vane spacer and how they are applied to an electrostatic compressor.
Figure 24A:
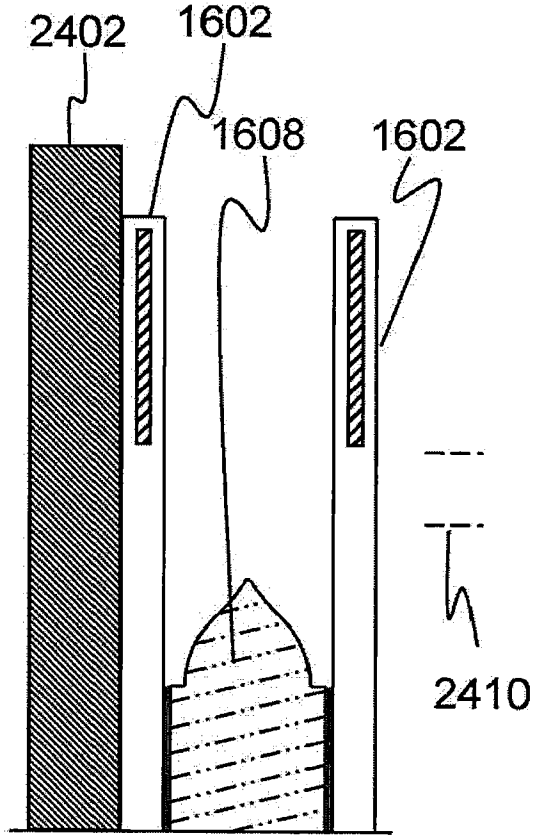
FIG. 24*a* illustrates an edge piece and how it is applied to an electrostatic compressor.

The electrostatic compressor 206 as illustrated in FIG. 3 consisted of a plurality of compressor vanes 400 that were substantially identical apart from some differences in their electrical connections. However, there may be benefit to using a different structure for the compressor vanes 400 implemented at the extreme edges of the array of vanes. In FIG. 24*a*, one such embodiment is illustrated in a cross-sectional end-view 700 (to be clear, the end view taken in FIGS. 24*a* and 24*b* is as defined in FIGS. 7*a* and 7*b*). Enhanced compressor vanes 1602 and the convex enhanced vane spacer 1608 are used for this illustration, but the techniques of FIG. 24*a* could be used with any of the compressor vanes 400 or vane spacers 500 described. The dashed lines 2410 indicate that many additional enhanced compressor vanes 1602 and convex enhanced vane spacers 1608 may make up the full system. The edge piece 2402 is simply a solid member of material that extends longitudinally along the full length of the left most enhanced compressor vane 1602 to support it and form a durable edge to the electrostatic compressor 206. Edge piece 2402 provides a stopping point that limits the motion of the left most enhanced compressor vane 1602 to keep it from deflecting beyond its elastic limit. Edge piece 2402 is shown as a shaded element to indicate that it may be of a different material from the enhanced compressor vane 1602, and it may be fabricated from many different possible materials including metals, wood, plastics, ceramics, and other materials. It is also possible to enhance the edge piece 2402 with cushioning materials, foam, special texturing or other treatments to reduce stress and wear suffered by the left most enhanced compressor vane 1602 when it strikes the edge piece 2402 in normal operation. And while edge piece 2402 is shown with a rectangular cross section, there may be benefit to contouring it so that the left most enhanced compressor vane 1602 contacts it more gradually as the vane completes its motion. Such enhancements to the edge piece 2402 may also reduce noise. And, of course, a similar edge piece 2402 would also normally be placed to the right of the far rightmost enhanced compressor vane 1602 that is not shown in FIG. 24*a* (that is, simply providing a similar structure at the other edge of the array of vanes).

In FIG. 24*b*, an additional embodiment is illustrated for the vanes at the edges of the electrostatic compressor 206. Here, an active edge piece 2404 is shown with an edge conductive region 2408 and a partial vane spacer 2406. In FIG. 24*b*, the left most enhanced compressor vane 1602 is allowed to deflect to the left until it reaches the active edge piece 2404. This is different from the situation in FIG. 24*a* where the edge piece 2402 stopped the left most enhanced compressor vane 1602 when it was vertically extended. By allowing the left most enhanced compressor vane 1602 to deflect to the left and meet the active edge piece 2404 the left most enhanced compressor vane 1602 has movement more similar to the other vanes in the electrostatic compressor and may suffer less stress and wear. The edge conductive region 2408 can be electrically biased so that the forces applied to and the movement of the left most enhanced compressor vane 1602 is substantially identical to the other vanes. Normally, the edge conductive region 2408 would simply be connected to the appropriate electrical signal applied to the electrostatic compressor as if it were simply another vane in the system. However, it is also possible to provide a special electrical signal to the edge conductive region 2408 to account for the fact that it is not a moving enhanced compressor vane 1602 and so to further make the forces on the left most enhanced compressor vane 1602 more similar to those acting on the other vanes in the system. It is noted that a partial thickness vane spacer 2406 is shown at half the usual thickness of the convex enhanced vane spacer 1608. In some designs, there may be some benefit to making the partial thickness vane spacer 2406 somewhat thicker or thinner than the half-thickness shown in FIG. 24*b*. It is also noted that while the partial thickness vane spacer 2406 is shown with a convex contour 1612 in FIG. 24*b* that a simple spacer (with a flat top surface such as the vane spacer 500 shown in FIG. 5) formed to the appropriate thickness would be adequate for many designs.

Applications of the air cycle heat pump 100 and the enhanced air cycle heat pump 2302 assumed use as a cooler or heater for a building, home, or other enclosure. But clearly, other applications such as automotive heating and air conditioning, aircraft heating and air conditioning, heating and air conditioning of buses (or trucks, trains, etc.), refrigeration, home refrigerators, freezers, chillers, cold storage facilities, window air conditioners, ice makers, wine coolers, systems for cooling electronics, systems for cooling lights (including Light-Emitting-Diode or LED lights), electrical enclosures, and many other systems requiring heating or cooling could make use of the concepts and embodiments presented. The fact that the electrostatic compressor 206 is driven electrically makes it attractive for incorporation in electric or hybrid vehicles. In electric or hybrid drive vehicles, where there is little or no waste heat available at some times, use of an electrostatic compressor 206 configured as a heat pump to provide vehicle heating; or configured to provide both cooling and heating as needed, may be especially beneficial. Additionally, as the electrostatic compressor 206 can be constructed as a relatively thin panel, it could easily be incorporated into the roof, doors, dashboard, or even in the floor of a vehicle. The electrostatic compressor and heat exchanger assembly 102 could be fitted into a vehicle with the heat exchanger 200 outside the vehicle's enclosure and the electrostatic compressor 206 would serve to pump heat out of the vehicle. A filter and cover to protect the electrostatic compressor 206 could be included and this structure could also include a condenser (such as the condenser 118 shown in FIG. 1) to collect moisture from the air. Alternatively, the vehicle's ventilation system could simply include the air cycle heat pump 100 or a version of the enhanced air cycle heat pump 2302, or other embodiments. It is noted that a rear-seat air heating and cooling system based on the electrostatic compressor 206 may be a nice feature for vans, luxury cars, and other vehicles. An additional benefit to use of an electrostatic compressor 206 in a vehicular application is that the power to the electrostatic compressor 206 can be momentarily reduced substantially close to zero if the control module 108 simply stops generating new phase transitions and holds the electrostatic compressor 206 in a single operating phase. This flexibility may be beneficial if, for example, an electric power steering system, braking system, or other system momentarily needs all or most of the power the vehicle's electrical system can offer. Other systems with limited electrical system capacity may also benefit from this flexibility of momentarily reducing power utilized by the electrostatic compressor 206.

A benefit to a refrigeration system based on the electrostatic compressor 206 is the ability to operate the electrostatic compressor 206 at higher voltage and frequency to achieve more rapid cooling action. While this operation may be sub-optimal in terms of power usage efficiency, it may allow for rapid cooling of meats, produce, and other items to reduce spoilage and waste. While conventional refrigeration systems used in refrigerators, freezers, food storage facilities and the like have limited ability to remove large amounts of heat quickly, the electrostatic compressor 206 can provide rapid cooling and avoid food safety issues if, for example, a large quantity of fresh meat or warm produce is put into a refrigeration unit.

It is noted that a cooling system based on the electrostatic compressor 206 could also be beneficial to fire fighters, soldiers, or other persons forced to work in elevated temperature environments. Since legacy air cooling systems tend to be heavy and include compressed gases and possibly hazardous chemicals, their use in dangerous environments is often avoided. Additionally, many of these systems are not capable of pumping heat efficiently over high thermal barriers (that is, pumping heat from one temperature environment to another that may be very hot relative to the first one). However, the electrostatic compressor 206 can be designed to be light weight and it can generate temperatures in the compressed regions 814 of several hundred degrees (Celsius or Fahrenheit) so that heat, for example, under a fire fighter's coat could be pumped to the ambient around him or her. Fitting such a cooler based on the electrostatic compressor into clothing could be done with adhesives, glues, sewing, mechanical fasteners, clips, or other techniques and the electrostatic compressor could be powered from batteries, electric cords, fuel cells, or many other techniques.

While the air cycle heat pump 100 and the enhanced air cycle heat pump 2302 both employed duct work and a system enclosure 101, it is also possible to cool a room or other enclosure by simply mounting the electrostatic compressor and heat exchanger assembly 102 in the ceiling or wall of the enclosure. That is, the electrostatic compressor and heat exchanger assembly 102 can act to pump heat out of an enclosure with no duct work at all. It can simply cool air as it passes over the surface of the electrostatic compressor 206. Such an implementation would be beneficial for use of the electrostatic compressor and heat exchanger assembly 102 in a refrigerator or freezer. It is noted that an air filter and some grill work would be beneficial in protecting the electrostatic compressor 206 in such an application, and a condenser 118 to facilitate removal of moisture from the air is also possible. Also, it is noted that using an auxiliary ventilation fan in the room or enclosure, such as a ceiling fan, to mix the air in the room or enclosure and operate cooperatively with an electrostatic compressor 206 may be beneficial. It is also possible to make use of a condenser 118 in the application of the electrostatic compressor and heat exchanger assembly 102 to a refrigerator, freezer, or other application to remove moisture by allowing moisture to actually freeze on the condenser 118 during a cooling operational cycle. The condenser 118 could be heated in a subsequent operational cycle by directing heat to it or by conducting electricity through it to melt the frozen condensation and drain it from the system.

The dimensions of the system enclosure 101 in FIG. 1 or FIG. 23*a* may be optimized with respect to the operating frequency of the electrostatic compressor 206 so that a resonant cavity is formed. Dimensions of a system using an electrostatic compressor 206 may be selected in such a way to create acoustic resonances to enhance system efficiency. In particular, such a resonance may facilitate the flow of air and/or heat from the electrostatic compressor 206 so that system efficiency improves.

Some embodiments may include operating the electrostatic compressor 206 so that the use of energy stored in the elastic flexing of the compressor vanes 400 and the energy stored in the compressed air in the compressed regions 814 between the vanes is used efficiently to help flex the compressor vanes 400 in the opposite manner and to help compress the air in the adjacent regions 816. Since the flexed compressor vanes 400 and the air in the compressed regions 814 store potential energy, this energy can be suitably released and converted to kinetic energy in the moving compressor vanes 400 and then subsequently recovered and stored again in the next phase of operation (and it will be stored again in the same fashion as compressed air and in the flexed vanes). By operating the electrostatic compressor 206 at an optimal or resonant frequency, this flow of energy can be used to reduce power consumption. Of course, such an optimal frequency can be found regardless of whether the compressor vanes 400 are actuated electrostatically, magnetically, mechanically, with thermally responsive materials, with artificial muscles, by a combination of techniques, or by other techniques. And, it is noted that several resonances may be found in embodiments of an air cycle heat pump 100 or an enhanced air cycle heat pump 2302 including resonances associated with the flexing compressor vanes 400, the size and shape of the enclosure 101, resonances in the electric circuitry used to drive the vanes, resonances associated with the size and shape of the compressed regions 814, and possibly other resonances as well. Embodiments may take benefit from designs making use of one or more of these resonances, possibly interoperating, to reduce system power consumption and improve overall performance. It is further noted that optimal operating conditions, including optimal operating frequency, voltage levels, and other factors, may be controlled in view of system parameters by the control module 108 to establish and maintain substantially optimal operation including taking benefit from resonances present in the particular embodiment.

It is noted incidentally that in view of the resonances described in the paragraph above, that it may be possible to operate the electrostatic compressor 206 at power levels that would be insufficient to provide adequate actuation of the compressor vanes 400 if they were applied without the benefit of the energy stored in the elements making up the resonant system. Such a condition is broadly found in resonant systems where several cycles of operation may be required to build up oscillations to sufficient levels for adequate operation. Electric oscillators, musical instruments, and even very simply systems like a child swinging on a playground swing often require multiple cycles of operation to build up sufficient stored energy to allow the given system to operate as intended. And so, some embodiments of the air cycle heat pump 100 or the enhanced air cycle heat pump 2302 may make use of several incomplete or partial cycles of operation when activated before nominal operation is realized. The control module 108 may modulate the voltage levels, frequency levels, and other parameters during this start up period to benefit operation (that is, to minimize power consumed, to reduce the time required for start up, and/or to possibly benefit other aspects of performance).

While the air cycle heat pump 100 and the enhanced air cycle heat pump 2302 each consist of only a single electrostatic compressor 206, it is also possible to create similar systems with multiple electrostatic compressors 206. In this way, two, three, or even very many electrostatic compressors could operate in parallel during system operation. In cases where reduced cooling is needed, some of these electrostatic compressors could be kept idle in such a case to reduce system power consumption. Instead of operating a single electrostatic compressor in such a case and controlling it on and off with changing room temperature (i.e. thermostatic control), the system can be optimized in a modular fashion with just enough electrostatic compressors 206 operating to meet the cooling demands. In this way, the room can be ventilated continuously (or nearly so) to improve comfort and reduce noise levels (and the noise of starting and stopping a large heat pump). And as was explained with regard to FIG. 20 and FIG. 21, the ability to use an air screen 2004 or other techniques to block air flow to part or all of an electrostatic compressor 206 provides additional flexibility. The use of multiple electrostatic compressors 206 in a parallel or modular fashion allows redundancy in an overall system and would allow some level of system operation in the face of failure of one or more of the electrostatic compressors 206 making up the system. Such failures may be detected automatically and signals may be sent noting the need for maintenance or service.

If a system is comprised of multiple electrostatic compressors operating in parallel, it is also possible to operate each of them at different phases and frequencies to whiten the ambient noise produced by the system. That is, instead of operating a single large electrostatic compressor 206 at a single frequency, which would potentially produce objectionable noise, multiple electrostatic compressors 206 would be operated in parallel at different frequencies to produce a more constant level of acoustic power over frequency and at lower peak levels. Such a system with very many modular electrostatic compressors 206 operating in parallel may only produce an acceptable "white noise" in the background. It is also possible for some designs to operate the electrostatic compressor (or compressors) at a sufficiently high or low frequency that ambient noise from it is above or below the human hearing range (often taken to extend from roughly 20 Hz to roughly 20 kHz). Of course, the hearing range of pets should also be considered in such a design as the system should also not be bothering animal inhabitants. This could mean operating the system at substantially higher or lower frequencies.

It is noted that in the examples shown, the compressor vanes 400 have been equally spaced and the dimensions of the vane spacers 500 have been constant. However, it may be beneficial in some embodiments to alter the compressor vane spacing 400. This could be especially true for designs that only compress air on one side of the vane. Such an embodiment would use different electrical signals and operating phases from the embodiments shown here. If only one side of the compressor vanes 400 are used for compression of air, then it could be useful to space the vanes so that the vanes are wider for the spaces to be compressed so that more air can be compressed on each cycle of the electrostatic compressor 206. In some applications such as when dealing with gases besides air, or when using compressor vanes 400 with many electrically conductive regions, variable vane spacing may also be beneficial.

It was noted in the explanation of FIG. 2 that thermal energy harvesters or scavengers may be used to generate electricity from the thermal energy passed to the heat exchanger 200. The embodiments shown offer benefits in that they allow heat energy to be highly concentrated into very small regions, potentially making thermal harvesting or scavenging more efficient. In many heat recovery systems, the low temperatures of the waste heat make it difficult to recover energy. Through use of an electrostatic compressor 206, it is possible to concentrate waste heat and create locally elevated temperatures so that energy can be recovered. Use of the embodiments described here as thermal energy concentrators for heat recovery is another novel embodiment.

It is also possible to use the electrostatic compressor 206 implementations explained in embodiment of this invention to compress air or other gases for uses besides air conditioning and heating. By collecting the compressed air in the compressed regions 814 shown in FIG. 8 and FIG. 9, compressed air can be produced. Small valves incorporated in the vane spacers 500 and a compressed air collection manifold in place of the heat exchanger 200 would facilitate such a use. Many of the enhancements explained in embodiments of this invention could be applied to enhance the operation of such a system.

The embodiments described so far have focused on using compressor vanes 400 to compress air in close proximity to a heat exchanger 200. However, other structures besides vanes are possible. As one example, a material made from artificial muscles could be produced in the form of a foam or sponge that could fill with air and then compress it due to electrical, thermal, or other stimulus. Much as a person can compress the air in a pillow or cushion by sitting on it, an implementation of a foam or sponge that could fill with air and then compress that air against a heat exchanger to release heat from it is also possible. In the case of a shape memory polymer or other artificial muscle material that is responsive to heat, the foam or sponge may be capable of using the heat from the compressed air to help the process of compression and so improve the efficiency of the system. Other alternative embodiments may make use of vanes that are curved or otherwise tilted or shaped along their lengths instead of being straight as shown in the embodiments presented here. Configurations of vanes in closed shapes as opposed to being straight, that is, in the form of squares, circles, concentric rings, triangular shapes and other configurations are also possible.

Figure 25:
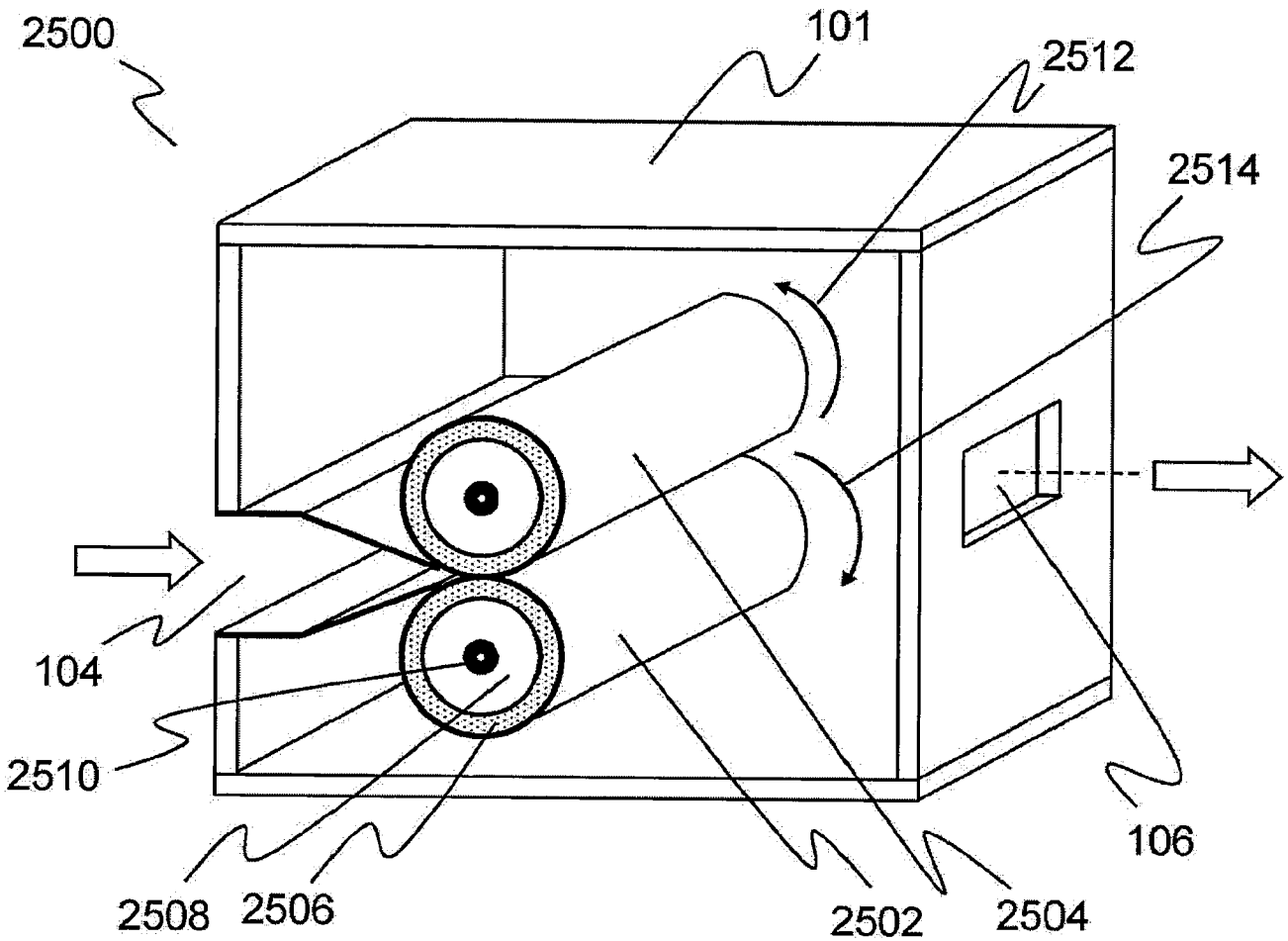
FIG. 25 illustrates an embodiment of a heat pump based on rollers that compress and expand an air flow to remove heat from it.

Some embodiments are possible that make no use of compressor vanes or electrostatics. An example of an embodiment of a rotating air cycle heat pump 2500 is illustrated in FIG. 25. In FIG. 25, a first cylinder 2502 and a second cylinder 2504 are rotated together in the directions shown by first direction arrow 2514 and second direction arrow 1512 respectively. The air intake 104 in enclosure 101 channels air to the first cylinder 2502 and the second cylinder 2504 so that it is compressed in the foam coating 2506 found on both cylinders. This foam coating 2506 forms small air pockets and isolates small volumes of air so that it is substantially compressed resulting in substantially adiabatic heating in the course of the compression between the rotating first cylinder 2502 and second cylinder 2504. The foam coating 2506 is intimately in contact with the hub 2508 of each cylinder and each hub is supported by a bearing and shaft 2510. In this way, the heat released due to the adiabatic compression process is conducted through the hub 2508 and then to the bearing and shaft 2510 of each cylinder so that it may be conducted outside the enclosure 101. That is, the hub 2508, and the bearing and shaft 2510 of each cylinder operate as a heat exchanger to conduct heat out of the enclosure 101. In this way, heat is removed from the air flow entering intake port 104 and substantially cooler air is released from exhaust port 106. It is noted that the rotation of the first cylinder 2502 and the second cylinder 2504 is powered by some means such as an electric motor. This powering means is not shown in FIG. 25 and may consist of motors, engines, gears, pulley, belts, or other powering and power conveying means.

Although the description above contains many specificities, these should not be construed as limiting the scope of the invention, but as merely providing illustrations of some of the embodiments of this invention. Thus the scope of the present invention should be determined by the appended claims and their legal equivalents, rather than by the examples given.

What is claimed is:

1. An apparatus, comprising:

a stack of compressor vanes, wherein:

said compressor vanes are responsive to electrical stimulus, and one end of each of said compressor vanes contact, and said compressor vanes are separated from each other by, thermally conductive vane spacers so that a fluid at least partially occupies a space between adjacent pairs of said compressor vanes;

a heat exchanger thermally coupled to said thermally conductive vane spacers; and an electrical circuit that provides said electrical stimulus, wherein said compressor vanes:

respond to said electrical stimulus by compressing and releasing said fluid between said adjacent pairs of said compressor vanes, and have a structure, contour, or geometry at one or more edges such that when said compression occurs, two or more adjacent vanes make contact, isolating a portion of the fluid that is compressed, and at least some heat of said compression is thereby transferred to said thermally conductive vane spacers.

2. The apparatus as recited in claim 1 wherein said fluid is air.

3. The apparatus as recited in claim 1 wherein each of said compressor vanes has at least one electrically separate conductive region embedded therein, wherein each of said at least one electrically separate conductive region is electrically connected to at least one via, and wherein said at least one via provides an electrical connection so that said electrical stimulus provided to said compressor vane is conducted to said at least one electrically separate conductive region.

4. The apparatus as recited in claim 1 wherein at least one of said compressor vanes is composed at least partially of a material selected from the group consisting of carbon fiber, graphite fiber, polyimide, para-aramid, aramid, silicon dioxide, silicon nitride, diamond, nickel, titanium, aluminum, copper, gold, and nanotube yarns or sheets.

5. The apparatus as recited in claim 1 wherein said compressor vanes include thermally responsive materials which change shape or dimension with temperature so that energy is recovered from said fluid.

6. The apparatus as recited in claim 1 wherein said electrical circuit at least partially recovers electrical energy stored in a capacitance formed between said adjacent pairs of said compressor vanes.

7. The apparatus as recited in claim 1 further comprising seals at least at both ends of each of said compressor vanes so that leakage of said fluid compressed by said compressor vanes from said ends is reduced.

8. The apparatus as recited in claim 1 wherein each of said vane spacers have curved surfaces that form an apex which protrudes into said space between said adjacent pairs of said compressor vanes.

9. The apparatus as recited in claim 8 wherein each of said compressor vanes have an offset dimension to allow each of said compressor vanes to wrap around contoured ends of said each of said vanes spacers having curved surfaces.

10. The apparatus as recited in claim 1 wherein each one of said compressor vanes has two electrically separate conductive regions embedded therein, wherein each of said electrically separate conductive regions are electrically connected to a set of vias located at said one end, and, said two electrically separate conductive regions receive said electrical stimulus through said vias.

11. The apparatus as recited in claim 10 wherein said set of vias are connected to another set of vias located on said vane spacers through which said electrical stimulus is provided.

12. The apparatus as recited in claim 10 wherein a first one of said two electrically separate conductive regions is located closer to said one end of said compressor vanes than a second one of said two electrically separate conductive regions.

13. A system, comprising:

an enclosure filled with a fluid; and an electrostatic compressor including:

a stack of compressor vanes, wherein:

said compressor vanes responsive to electrical stimulus, and one end of each of said compressor vanes of said stack contact, and said compressor vanes are separated from each other by, thermally conductive vane spacers so that said fluid extends to and at least partially occupies a space between adjacent pairs of said compressor vanes;

a heat exchanger thermally coupled to said thermally conductive vane spacers; and a control module including an electrical circuit that provides said electrical stimulus, wherein said compressor vanes:

respond to said electrical stimulus by compressing and releasing said fluid between said adjacent pairs of said compressor vanes, and have a structure, contour, or geometry at one or more edges such that when said compression occurs, two or more adjacent vanes make contact, isolating a portion of the fluid that is compressed, and at least some heat of said compression is thereby transferred to said thermally conductive vane spacers.

14. The system as recited in claim 13 wherein said fluid flows into said enclosure from at least one intake port of said enclosure and out of said enclosure through at least one exhaust port of said enclosure.

15. The system as recited in claim 13 wherein said fluid is air.

16. The system as recited in claim 13 wherein at least one of said compressor vanes is composed at least partially of a material selected from the group consisting of carbon fiber, graphite fiber, polyimide, para-aramid, aramid, silicon dioxide, silicon nitride, diamond, nickel, titanium, aluminum, copper, gold, and nanotube yarns or sheets.

17. The system as recited in claim 13 wherein said compressor vanes include thermally responsive materials which change shape or dimension with temperature so that energy is recovered from said fluid.

18. The system as recited in claim 13 further comprising a condenser mounted in said enclosure to collect moisture from said fluid.

19. The system as recited in claim 13 further comprising a filter mounted in said enclosure, said filter operative to filter contaminants from said fluid.

20. The system as recited in claim 13 further comprising safety screens or electrical interlocks to substantially ensure said system can be safely serviced or maintained.

21. The system as recited in claim 13 wherein said enclosure is at least partially constructed from a thermally insulating material.

* * * * *